US010654644B2

(12) United States Patent
Sell

(10) Patent No.: US 10,654,644 B2
(45) Date of Patent: May 19, 2020

(54) DUAL ACTUATED AEROSOL DEVICES

(71) Applicant: WestRock Dispensing Systems, Inc., Norcross, GA (US)

(72) Inventor: Steven A. Sell, Lee's Summit, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 241 days.

(21) Appl. No.: 15/069,015

(22) Filed: Mar. 14, 2016

(65) Prior Publication Data

US 2016/0194140 A1 Jul. 7, 2016

Related U.S. Application Data

(63) Continuation of application No. 14/317,596, filed on Jun. 27, 2014, now Pat. No. 9,315,314.

(51) Int. Cl.
*B65D 83/22* (2006.01)
*B65D 83/20* (2006.01)

(52) U.S. Cl.
CPC ..... *B65D 83/22* (2013.01); *B65D 83/201* (2013.01); *B65D 83/206* (2013.01)

(58) Field of Classification Search
CPC .... B65D 83/22; B65D 83/201; B65D 83/206; B65D 83/28; B65D 2215/04; B65D 83/56; B05B 11/3057; B05B 11/3059; B05B 11/0027
USPC ..... 222/153.11, 402.11, 402.13
See application file for complete search history.

(56) References Cited

U.S. PATENT DOCUMENTS 2,941,700 A * 6/1960 Gable ..... B65D 83/201 222/402.13
3,429,484 A * 2/1969 Baldwin ..... B65D 83/201 222/402.13
3,478,938 A * 11/1969 Krause ..... B65D 83/201 222/402.14
4,077,549 A * 3/1978 Beard ..... B05B 11/3057 222/321.8
4,186,855 A * 2/1980 Edman ..... B05B 11/3057 222/321.8
4,449,647 A * 5/1984 Reed ..... B65D 83/202 220/759
4,505,335 A * 3/1985 Hayba ..... B65D 83/202 169/76
4,862,968 A * 9/1989 Woodman ..... A62C 13/64 116/272
4,941,600 A 7/1990 Berriochoa
5,431,313 A * 7/1995 Renault ..... B05B 11/3057 222/402.13
6,305,578 B1 * 10/2001 Hildebrandt ..... B01F 5/0403 222/135

(Continued)

FOREIGN PATENT DOCUMENTS

EP 2060507 A2 5/2009

*Primary Examiner* — Paul R Durand
*Assistant Examiner* — Robert K Nichols, II
(74) *Attorney, Agent, or Firm* — Barlow, Josephs & Holmes, Ltd.

(57) ABSTRACT

An aerosol actuator having a button actuator on a top surface thereof and a lever actuator extending away from the button actuator may be assembled with an aerosol container and valve to provide ergonomic application of a product utilizing the aerosol actuator.

17 Claims, 37 Drawing Sheets

(56) References Cited

U.S. PATENT DOCUMENTS

| | | | | |
|---|---|---|---|---|
| 7,487,893 | B1 * | 2/2009 | Greer, Jr. | B65D 83/30 222/1 |
| 7,641,079 | B2 * | 1/2010 | Lott | B65D 83/201 222/153.07 |
| 7,784,650 | B2 * | 8/2010 | Bates | B05B 11/3052 222/321.8 |
| 8,528,794 | B2 * | 9/2013 | Wolf | B65D 83/22 222/402.13 |
| 2003/0209569 | A1 | 11/2003 | Jackson | |
| 2004/0188473 | A1 | 9/2004 | Groh | |
| 2004/0256418 | A1 * | 12/2004 | Scheindel | B65D 83/202 222/402.15 |
| 2005/0098584 | A1 * | 5/2005 | Do Rosario | B65D 83/206 222/321.7 |
| 2005/0178802 | A1 | 8/2005 | Groh | |
| 2007/0062980 | A1 | 3/2007 | Bates | |
| 2007/0290006 | A1 | 12/2007 | Lott | |
| 2011/0233235 | A1 | 9/2011 | Adams | |
| 2013/0001323 | A1 * | 1/2013 | Bodet | B05B 11/3057 239/337 |
| 2013/0037581 | A1 | 2/2013 | Anderson | |
| 2013/0146611 | A1 | 6/2013 | Sell | |
| 2013/0277397 | A1 | 10/2013 | Erickson | |
| 2014/0084026 | A1 * | 3/2014 | Gillespie | B65D 83/206 222/153.11 |
| 2014/0329918 | A1 | 11/2014 | Arora | |
| 2015/0001258 | A1 * | 1/2015 | Sell | B65D 83/201 222/402.13 |

* cited by examiner

DUAL ACTUATED AEROSOL DEVICES

CROSS-REFERENCE TO RELATED APPLICATIONS

This application is a continuation of, and claims the benefit of, U.S. application Ser. No. 14/317,596, entitled "DUAL ACTUATED AEROSOL DEVICES," filed 27 Jun. 2014, and incorporates the same herein by reference in its entirety.

BACKGROUND OF THE INVENTION

Field of the Invention

Embodiments of the invention relate to aerosol actuators and more particularly to aerosol actuators which may be actuated in multiple manners.

State of the Art

Aerosol products are widely used for a number of different applications, including paint, hair care, air care, sun care, cleaning, beauty products, food products, and others. Typically, aerosol dispensers include a button actuator mounted on top of a valve connected to an aerosol container. Actuation or depression of the button opens the valve and disperses the aerosol product from the container to the atmosphere. The use of such actuation buttons are well known and are found on the majority of aerosol dispensing devices.

More recently, some aerosol dispensing systems have adopted trigger actuated aerosol actuators in place of the button actuators. The use of trigger actuators with aerosols provides a user with a different experience when using the aerosol product. However, trigger actuators are typically more expensive than button actuators.

In some cases, however, conventional button actuators and trigger actuators are not ideal for certain applications. For example, when applying an aerosol product to a user's body, use of button actuators or trigger actuators can be cumbersome or awkward. In addition, conventionally available button actuators and trigger actuators have poor ergonomics in certain application positions. Therefore, it may be desirable to design improved or new aerosol actuators having better ergonomics and more favorable designs to improve user experience when using such aerosol actuators.

BRIEF SUMMARY OF THE INVENTION

According to certain embodiments of the invention, an aerosol actuator includes a locking ring, a manifold, a cap, and a trigger, wherein the manifold is supported by the locking ring and is in communication with the trigger which is mounted to the cap, the cap being mounted to the locking ring. The trigger includes both a button actuator and a lever actuator extending off of the button actuator.

According to some embodiments of the invention, an aerosol actuator may include a locking ring snapped into a cap. The locking ring may include a manifold guide in which an inlet portion of a manifold may be seated or positioned. An outlet portion of the manifold may be visible through a spray opening in the cap. Product dispensed from the manifold may pass out the manifold outlet and through the spray opening in the cap. A trigger may also be mounted or in communication with the cap. A trigger may include both a button actuator located generally on a top portion of the aerosol actuator and a lever actuator extending downward from the button actuator away from the cap. In some embodiments, a trigger may be pivotably mounted with the cap such that the trigger may pivot or rotate about one or more trigger posts when a force is applied to the button actuator, the lever actuator, or both. Rotation or pivoting of the trigger about the one or more trigger posts may cause one or more actuator wings on an under surface of the trigger to interact with one or more actuator posts on a manifold. The interaction of the one or more actuator wings on the one or more actuator posts may move the manifold.

In some embodiments of the invention, an aerosol actuator may be attached to an aerosol container containing a product and having a valve. The manifold of the aerosol actuator may engage with the valve when the aerosol actuator is attached to the container. Movement of the manifold—such as a result of interaction of the one or more actuator wings with the one or more actuator posts—opens the valve and dispenses a product.

According to various embodiments of the invention, a trigger on an aerosol actuator includes both a button actuator on a top portion of the aerosol actuator and a lever actuator extending off of the button actuator. The button actuator may be used for traditional actuation of the aerosol actuator. The lever actuator may provide more ergonomic positioning of an aerosol dispenser during use of the aerosol actuator. For example, using various embodiments of the invention, a user may apply a product—such as sunscreen—to portions of their back by gripping the bottom of a container and actuating the lever actuator of an aerosol actuator with their thumb.

In some embodiments of the invention, the trigger may be locked or unlocked in order to prevent or allow actuation of the aerosol actuator, respectively. In certain embodiments, the trigger may include an actuation lock and the lock ring may include a lock projection. In a locked state, the actuation lock and lock projection may interact, preventing actuation of the trigger. In an unlocked state, the actuation lock and lock projection may not touch or interact, allowing the trigger to move and actuation of the aerosol actuator to occur. In some embodiments, rotation of the cap may position the actuation lock and lock projection to interact or may move the two features away from each other to unlock the aerosol actuator. In some instances, features on the cap and locking ring may interact to create an audible "click" to designate locking or unlocking of the aerosol actuator.

In other embodiments of the invention, an aerosol actuator may only include a lever actuator such that the lever actuator must be engaged or moved to actuate the aerosol actuator.

According to still other embodiments of the invention, an aerosol dispenser may include an aerosol container having a container opening, a valve mounted to the container in the opening, a chime encompassing the valve, and a product contained in the container. An aerosol actuator according to embodiments of the invention may be fitted on or attached to the container and may include a locking ring, a manifold, a trigger and a cap. The locking ring may include a base, a rim about the base, a manifold guide, a lock projection, and a base snap structure for connecting the aerosol actuator to the container or the chime of the container. The manifold may include an inlet, an outlet, and a flow path between the inlet and outlet. An orifice cup seat may be adjacent to the outlet and an orifice cup may be seated therein in some embodiments. A valve seat may be adjacent the inlet and a valve may seat in the valve seat when the aerosol actuator is connected to or attached to an aerosol container. The cap may include a wall defining the aesthetic look of the cap and a base opening, a trigger opening, and a spray opening. The locking ring may be assembled with the cap through the base opening and one or more locking ring openings may hold the rim of the locking ring to secure the locking ring in the cap. The cap may be rotatable about the locking ring. The cap may also include one or more supports for the trigger with one or more trigger mount groove in which one or more trigger posts may fit or sit to allow the trigger to move relative to the cap. The trigger may also include a button actuator on a top surface thereof and a lever actuator extending from the button actuator. A portion of the trigger may fit in the trigger opening of the cap and may be mated with the cap such that the trigger can move. The trigger may also interact with the manifold. Actuation wings on an underside of the trigger may contact one or more actuator posts on the manifold. Movement of the trigger may apply a force to the one or more actuator posts, in turn moving the manifold and opening the valve to release a product from the aerosol actuator. A trigger may also include an actuation lock that interacts with a lock projection on the locking ring in a locked state. Rotation of the cap may rotate the trigger and the actuation lock such that the actuation lock and lock projection are not aligned and the aerosol actuator may be actuated.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1A:
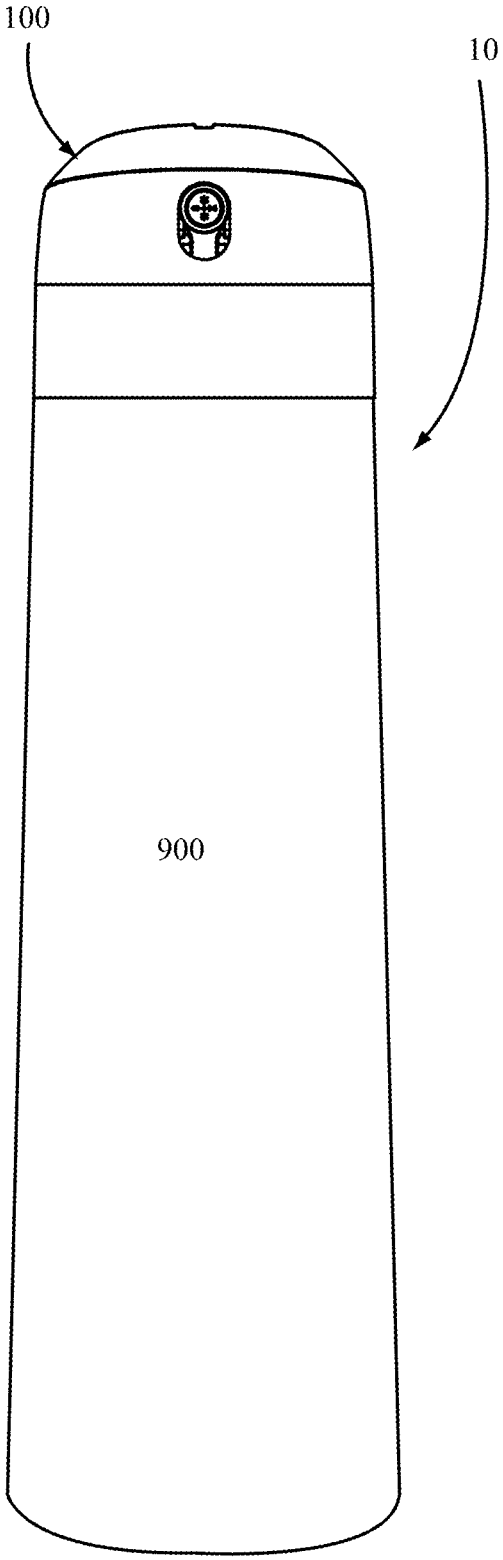
FIG. 1A illustrates a front view of an aerosol dispenser according to various embodiments of the invention.
Figure 1B:
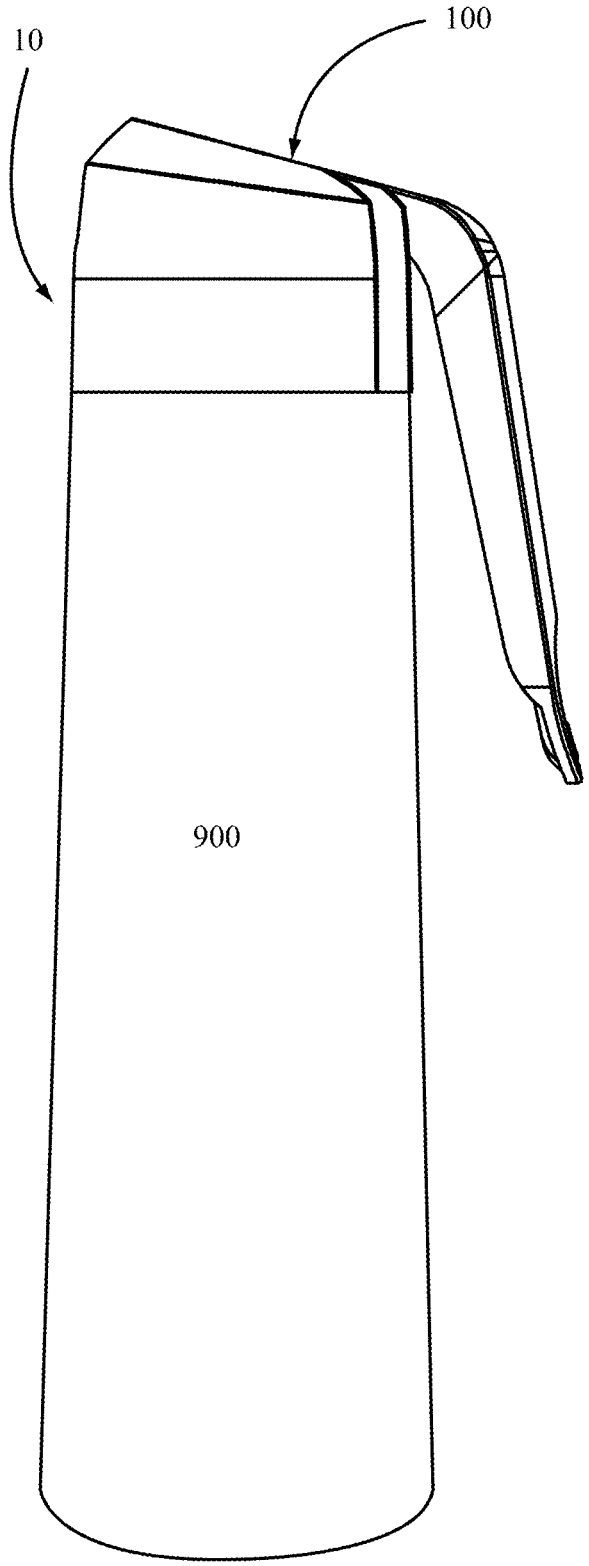
FIG. 1B illustrates a side view of the aerosol dispenser illustrated in FIG. 1A.

According to various embodiments of the invention, an aerosol dispenser 10 may include an aerosol actuator 100 attached to a container 900 as illustrated in FIGS. 1A and 1B, wherein FIG. 1A is a front view of an aerosol dispenser 10 and FIG. 1B is a side view of an aerosol dispenser 10. The aerosol actuator 100 may include one or more features capable of attaching the aerosol actuator 100 to the container 900, a valve associated therewith, or both the container 900 and valve. The aerosol actuator 100 may also include one or more features capable of actuating or opening a valve attached to the container 900 such that a product stored in the container 900 may be released into the environment or atmosphere by or through the aerosol actuator 100.

Figure 2:
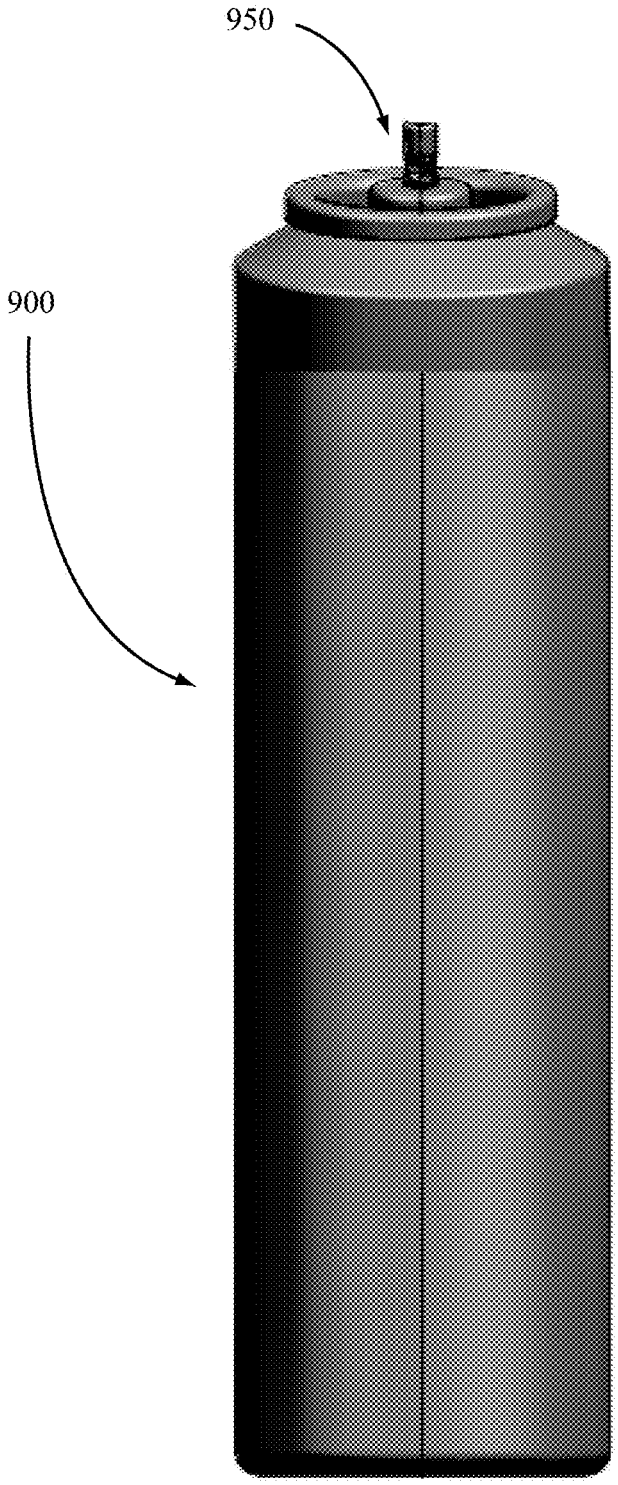
FIG. 2 illustrates a container and valve according to various embodiments of the invention.

A container 900 used with various embodiments of the invention may include a valve 950 sealed and engaged therewith as known in the art. An example of such a container 900 and valve 950 is illustrated in FIG. 2. While the container 900 and valve 950 illustrated in FIG. 2 are exemplary of a configuration of a container 900 and valve 950 used with aerosol systems, it is by no means limiting and it is understood that other configurations of a container 900 and valve 950 may be used with, or as part of, various embodiments of the invention. For example, the container 900 illustrated in FIG. 2 has straight walls and a generally circular cross-section. A container 900 having a different shape—or changing shape—and cross-section may be used with the various embodiments of the invention.

Figure 3:
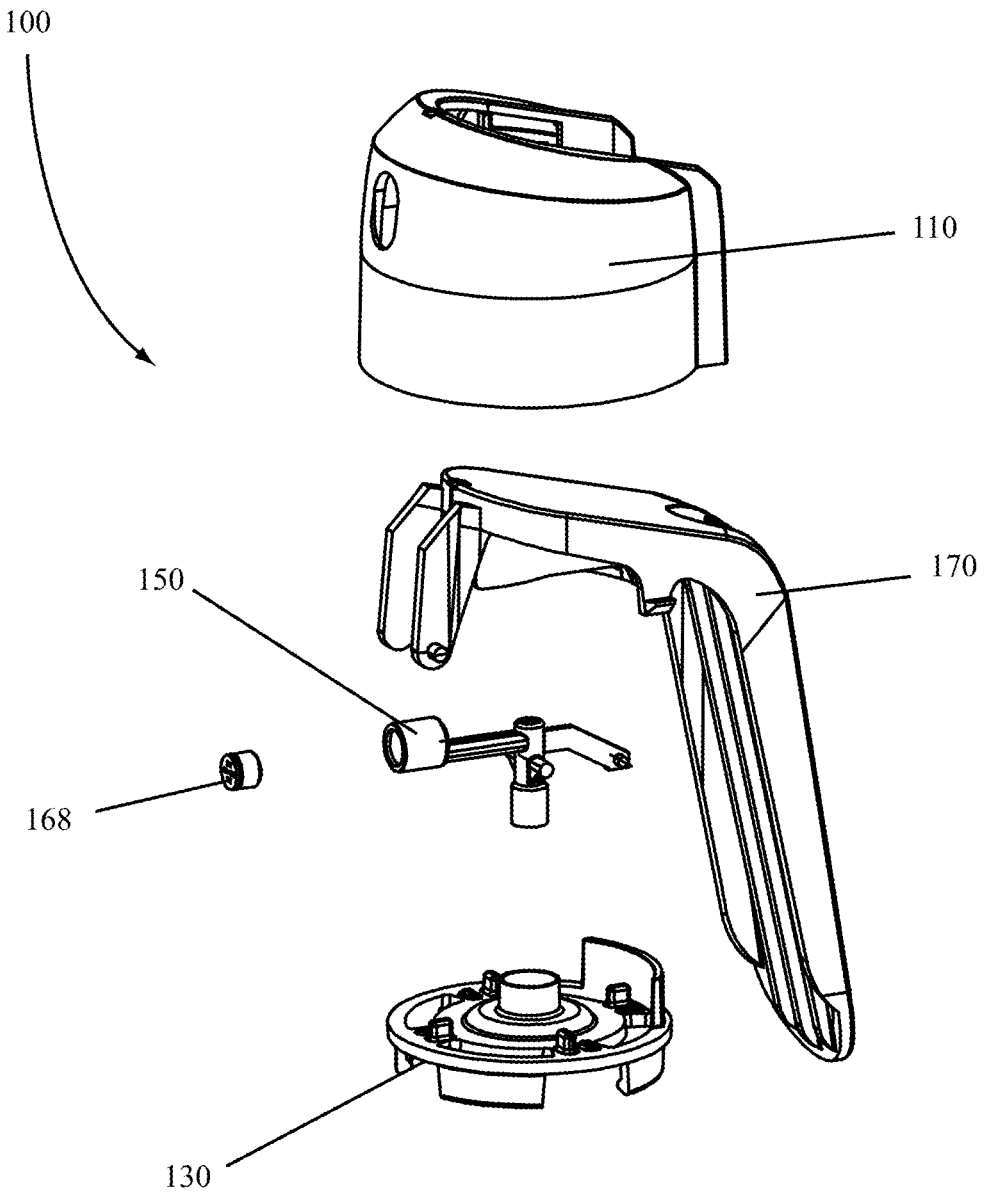
FIG. 3 illustrates an exploded view of an aerosol actuator according to various embodiments of the invention.

An exploded view of an aerosol actuator 100 such as that illustrated in FIG. 1A is illustrated in FIG. 3. According to various embodiments of the invention, an aerosol actuator 100 may include a cap 110, a locking ring 130, a manifold 150, and a trigger 170. In some embodiments, an orifice cup 168 may also be fitted into or otherwise engaged with a portion of a manifold 150, especially in those embodiments wherein the manifold 150 does not include integral spin mechanics. When assembled as an aerosol actuator 100, a cap 110 may be engaged with a locking ring 130 such that a manifold 150 and at least a portion of the trigger 170 are contained within an interior portion of the cap 110.

Figure 4:
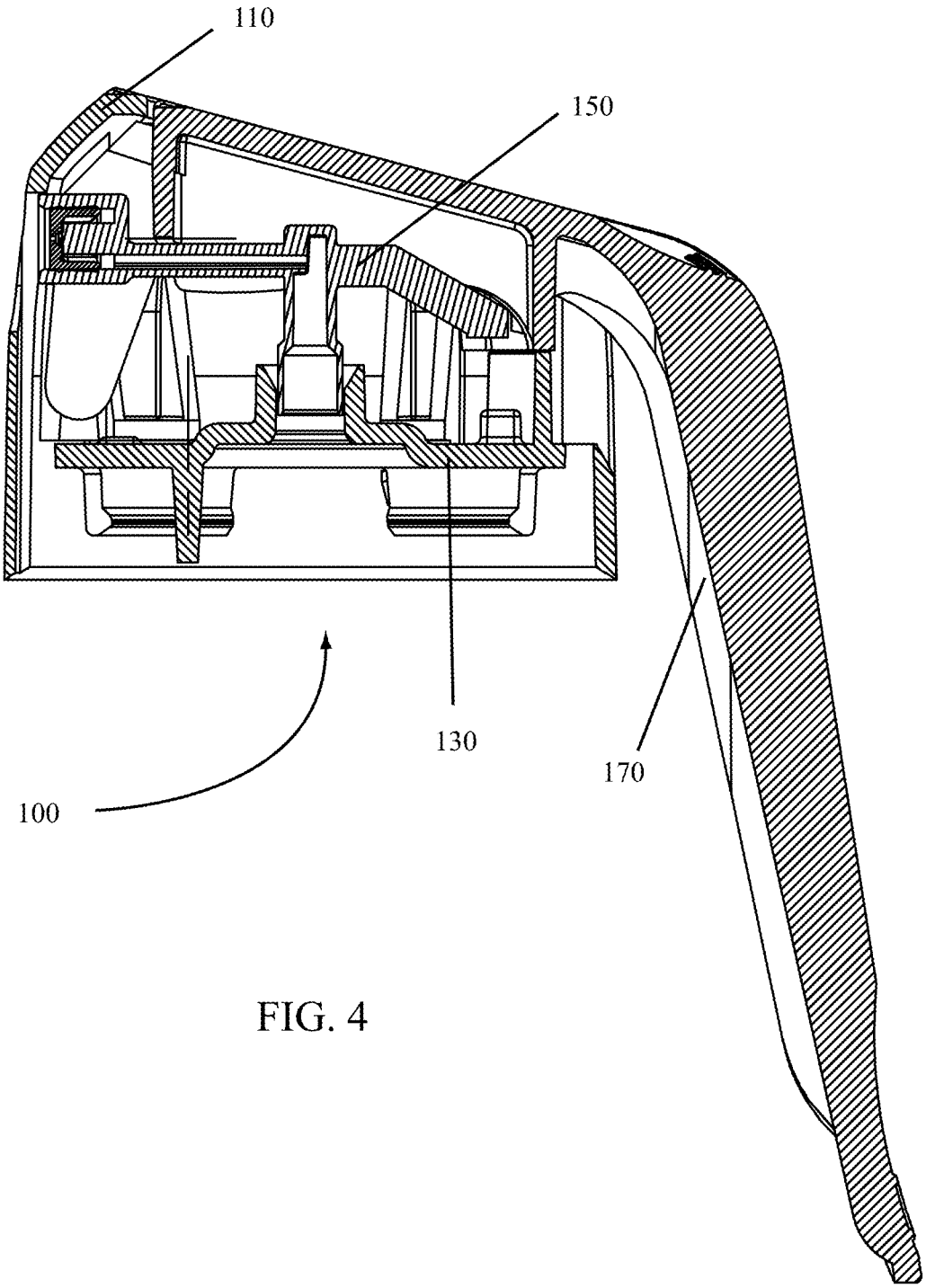
FIG. 4 illustrates a cross-sectional, side view of an aerosol actuator according to various embodiments of the invention.

An enlarged, cross-sectional side view of an assembled aerosol actuator 100 according to some embodiments of the invention is illustrated in FIG. 4. The aerosol actuator 100 illustrated in FIG. 4 includes a locking ring 130 clipped into the cap 110 of the aerosol actuator 100. A manifold 150 having an inlet opening and an outlet opening is seated between the locking ring 130 and the trigger 170 with a portion of the manifold 150 inlet opening fitted within a manifold guide of the locking ring 130. A portion of the manifold 150 outlet opening is positioned such that a product exiting the outlet opening may pass through an opening in the cap 110. A trigger 170 is A locking ring 130 according to certain embodiments of the invention is illustrated in FIGS. 5 through 8. While various features of a locking ring 130 are described, it is understood that a locking ring 130 according to various embodiments of the invention may include additional features or fewer features than illustrated and describe in the exemplary embodiments.

Figure 5:
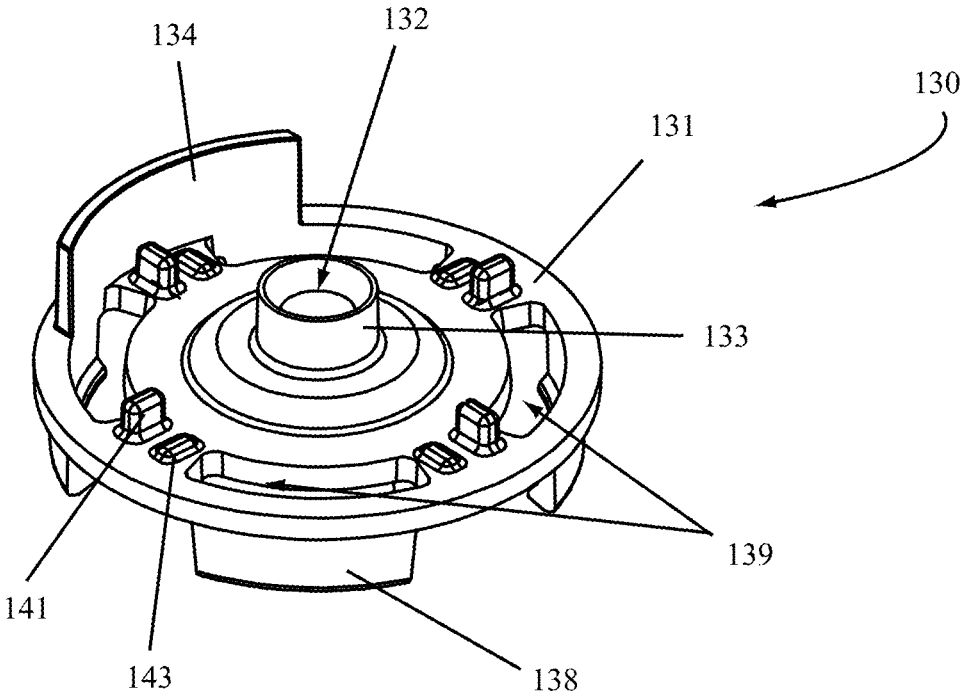
FIG. 5 illustrates a top-perspective view of a locking ring according to various embodiments of the invention.

A top-perspective view of a locking ring 130 according to certain embodiments of the invention is illustrated in FIG. 5. As illustrated, a locking ring 130 may include a base 131, a manifold opening 132, a manifold guide 133, and a lock projection 134.

As illustrated in FIG. 5, a base 131 may include a disc or disc-shaped structure having an upper surface and a lower surface. A manifold opening 132 may extend through the base 131 from an upper surface thereof to the lower surface thereof. In other embodiments of the invention, a manifold opening 132 may extend through the base 131 and through an interior portion of a manifold guide 133. For example, as illustrated, a manifold guide 133 may extend from the upper surface of the base 131; the manifold guide 133 being a cylindrical projection having an opening or hole through the center of the manifold guide 133. While the illustrated manifold guide 133 is a cylindrical projection rising from the upper surface of the base 131, it is understood that the walls of the manifold guide 133 may slope or be configured in a different shape as desired. As illustrated, the upper surface of the base 131 may slope up to the walls of the manifold guide 133. In other embodiments, the upper surface of the base 131 may not slope at all, but may terminate or contact a sloping or projecting manifold guide 133.

Figure 6:
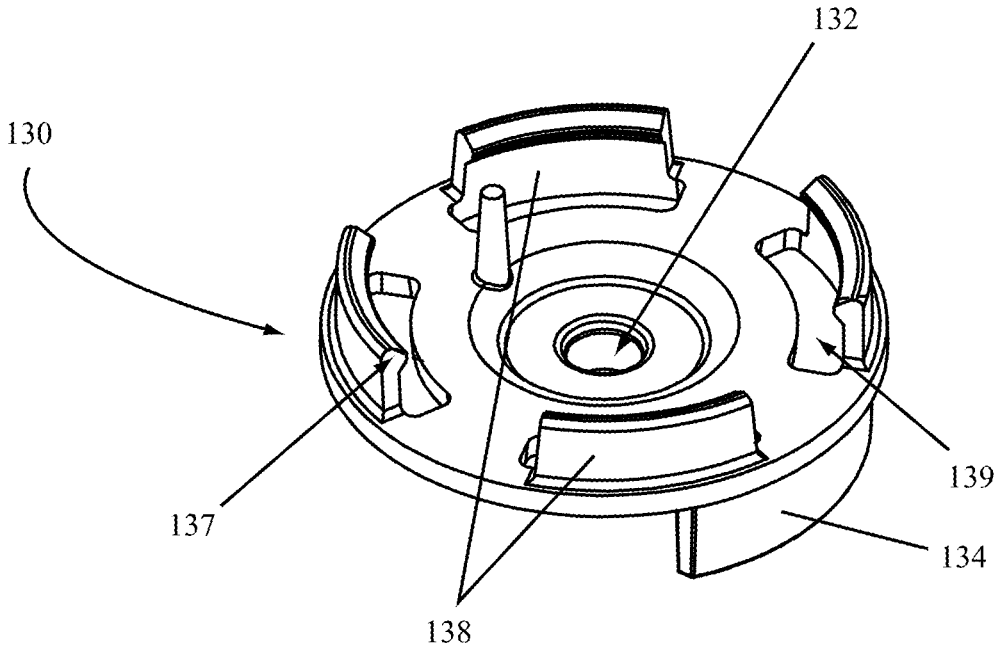
FIG. 6 illustrates a bottom-perspective view of a locking ring according to various embodiments of the invention.

A bottom-perspective view of the locking ring 130 illustrated in FIG. 5 is illustrated in FIG. 6. Two or more base snap structures 138 may extend outwardly from the base 131. For example, in certain embodiments of the invention, four base snap structures 138 may extend from the lower surface of the base 131 as illustrated in FIGS. 5 and 6. The base snap structures 138 may be substantially rigid but capable of flexing to facilitate assembly of a locking ring 130 onto a container 900. While four base snap structures 138 are illustrated in FIGS. 5 and 6, it is understood that a fewer number or a greater number of such features could be incorporated with various embodiments of the invention as needed to retain a locking ring 130 to a container 900.

According to some embodiments of the invention, a base snap structure 138 may also include one or more lips 137 as illustrated in FIG. 6. The one or more lips 137 may project inward from a base snap structure 138 towards a center of the locking ring 130. The one or more lips 137 may be positioned anywhere along the base snap structure 138 but in many embodiments of the invention will be located at an end of the base snap structure 138 opposite the base 131 as illustrated in FIG. 6. The one or more lips 137 may assist with retention of a locking ring 130 to a container 900 once assembled on the container 900. For example, in certain embodiments of the invention, a locking ring 130 may be assembled to a container 900 such that the one or more base snap structures 138 flex and snap about a chime of the container 900. The one or more lips 137 on the base snap structures 138 may wrap around the chime to assist with the retention of the locking ring 130 on the container 900.

A locking ring 130 may also include one or more openings 139 through portions of the base 131 wherein the one or more openings 139 extend from an upper surface of the base 131 to a lower surface thereof. For example, openings 139 illustrated in FIGS. 5 and 6 pass through the base 131 and are located near or adjacent to the base snap structures 138. Inclusion of openings 139 in the base 131 can reduce the weight of the locking ring 130 or the amount of material used to make the locking ring 130. The reduction in weight or material may improve or decrease the cost associated with the part. Further, in some embodiments of the invention, openings 139 may be included to facilitate more efficient molding processes, allowing a locking ring 130 to be molded in an easier manner, with less sophisticated molds, with shorter cycle times, or with all of these advantages.

Figure 7:
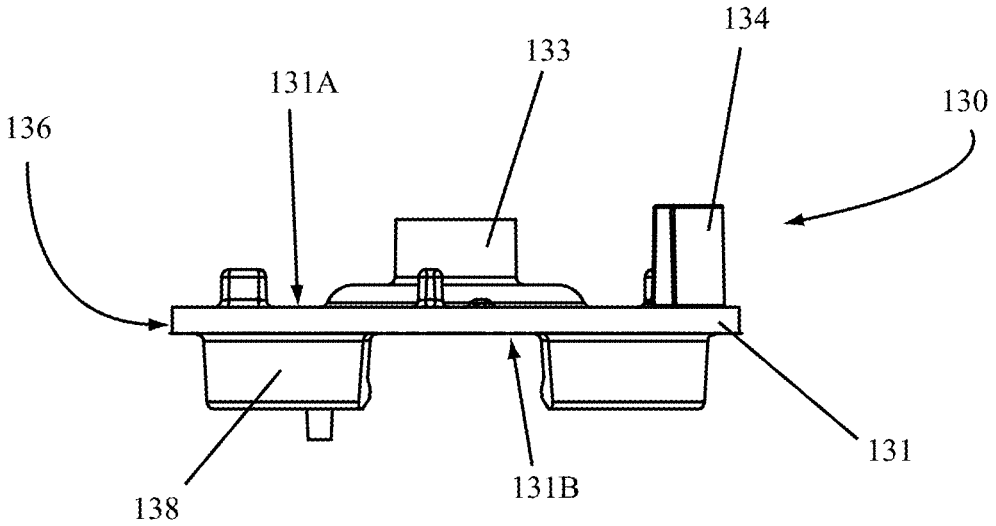
FIG. 7 illustrates a side view of a locking ring according to various embodiments of the invention.
Figure 8:
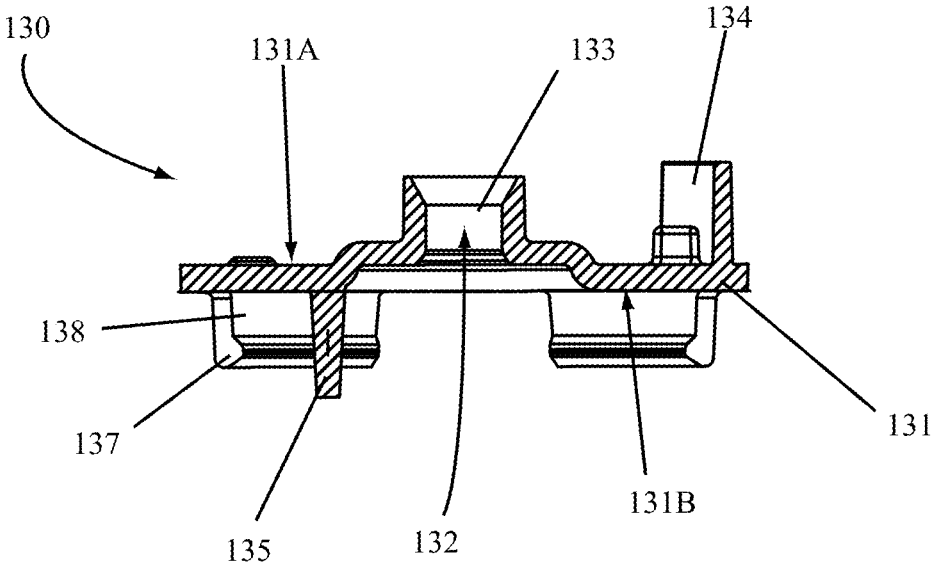
FIG. 8 illustrates a cross-sectional side view of a locking ring according to various embodiments of the invention.

A side view of a locking ring 130 according to various embodiments of the invention is illustrated in FIG. 7. A cross-sectional view of the locking ring 130 illustrated in FIG. 7 is illustrated in FIG. 8. As illustrated, a locking ring 130 according to various embodiments of the invention may include a base 131 having an upper surface 131A and a lower surface 131B. The locking ring 130 base 131 may be disc-shaped having a consistent thickness or a varying thickness. As illustrated in FIGS. 7 and 8, a base 131 may have a substantially consistent thickness. In some embodiments of the invention, an outer edge of the base 131 may be spaced from features projecting off of the base 131 such that a rim 136 exists, the rim 136 capable of being retained, snap-fit into, or otherwise in communication with a cap 110 or other component of an aerosol actuator 100. In addition, the base 131 may include a raised portion. For example, as illustrated in FIGS. 5 through 8, a base 131 is disc-shaped having an outer circumference. Moving interior of the outer circumference, a raised portion extends upward from the upper surface 131A and joins the manifold guide 133. The raised portion in the base 131 creates a space in the lower surface 131B of the base 131 about the manifold opening 132. In some embodiments of the invention, this space created by the raised portion of the base 131 may assist in or help facilitate assembly of the aerosol actuator 100 onto a container 900 to form an aerosol dispenser 10. For instance, the space may help guide a valve stem of a container 900 into contact with, or mating seat with, a portion of a manifold 150 positioned in the manifold opening 132.

According to some embodiments of the invention, an upper portion of the manifold guide 133 may be tapered such that the taper may help guide a portion of a manifold 150 into the manifold opening 132 for seating therein. For example, as illustrated in FIG. 8, a manifold guide 133 may include a tapered upper edge. The tapered upper edge allows a larger target for insertion of a portion of a manifold 150 during assembly of an aerosol actuator 100.

A locking ring 130 may also include one or more stops 141 located on a surface of the locking ring 130. The one or more stops 141 may interact with projections or other features of a cap 110 to prevent rotational movement of the cap 110 about the locking ring 130.

A locking ring 130 according to various embodiments of the invention may also include one or more click ridges 143 on a surface thereof and configured to interact with one or more projections or features of a cap 110 to create an audible noise or "click." For example, the locking ring 130 illustrated in FIG. 5 includes four click ridges 143 which may interact with a cap 110 as a cap 110 is rotated relative to the locking ring 130. Features on the cap 110 may interact with the click ridges 143 to create an audible "click" or noise when the cap 110 is rotated into or out of a locked or unlocked position relative to the locking ring 130.

A cap 110 of an aerosol actuator 100 according to certain embodiments of the invention is illustrated in FIGS. 9 through 15. While the various figures illustrate a cap 110 having a particular aesthetic, it is understood that a cap 110 according to various embodiments of the invention may include other aesthetics. In addition, while certain features of a cap 110 are illustrated and described, it is understood that a cap 110 having fewer or additional features or structures may also be used with various embodiments of the invention.

Figure 10:
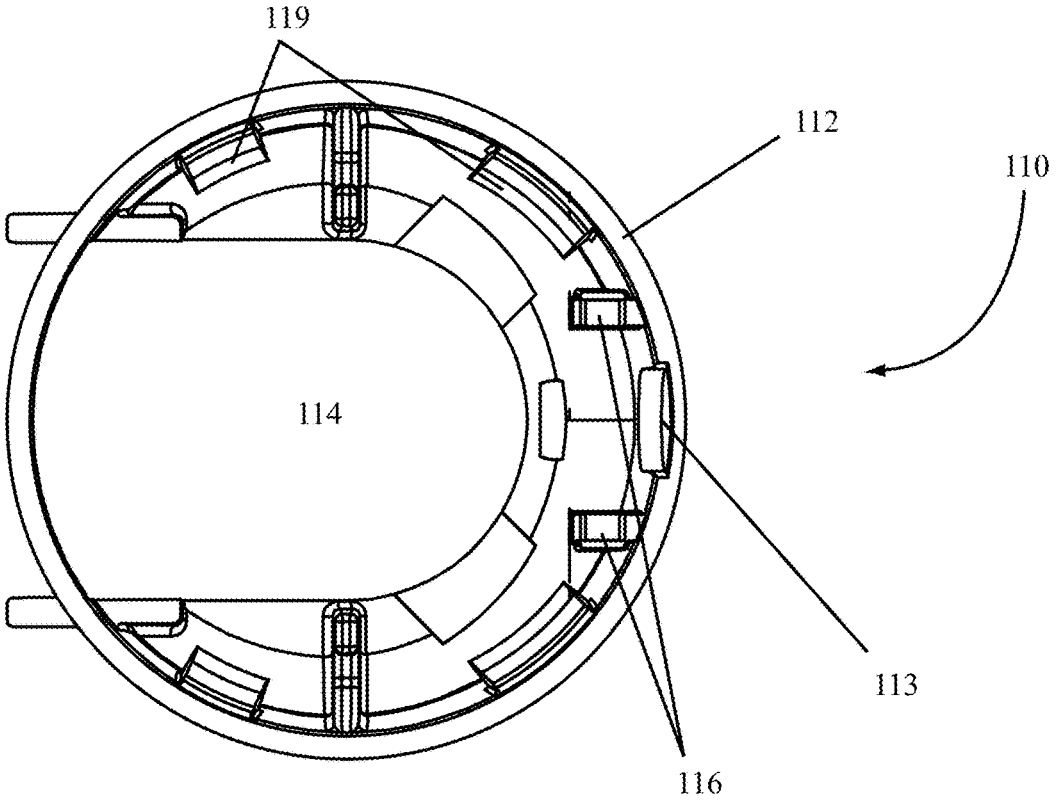
FIG. 10 illustrates a bottom view of a cap according to various embodiments of the invention.
Figure 11:
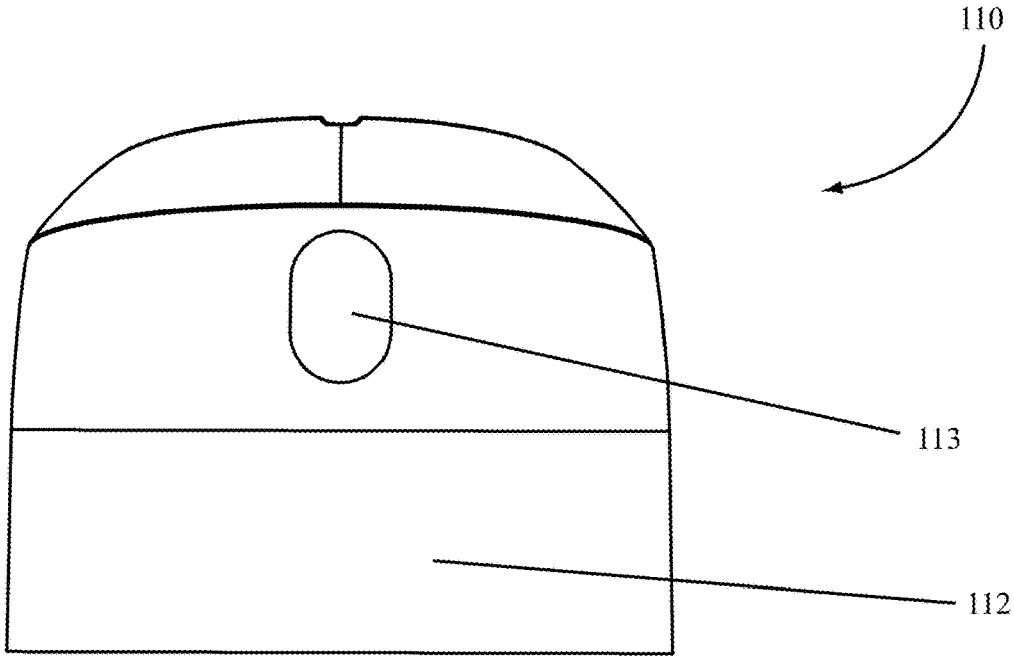
FIG. 11 illustrates a front view of a cap according to various embodiments of the invention.
Figure 12:
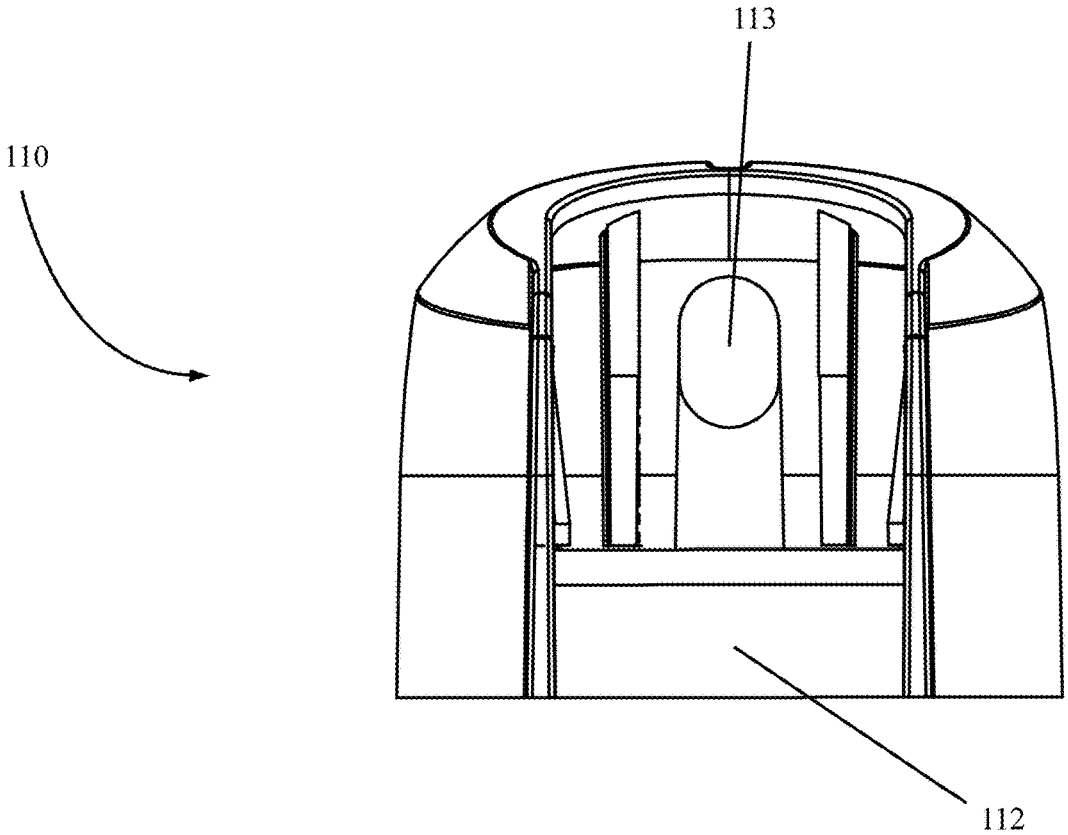
FIG. 12 illustrates a rear view of a cap according to various embodiments of the invention.
Figure 13:
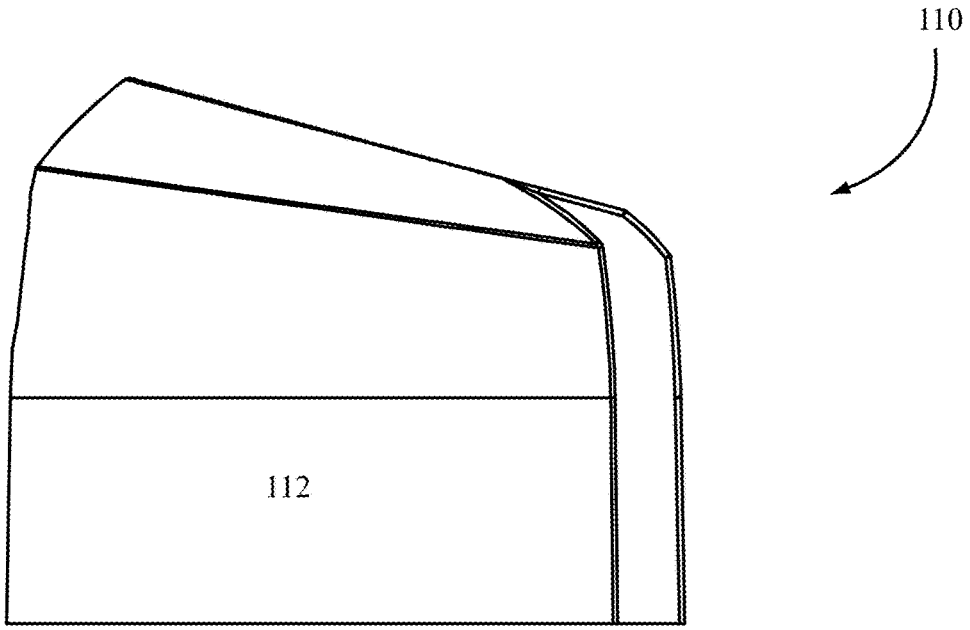
FIG. 13 illustrates a side view of a cap according to various embodiments of the invention.

A cap 110 according to certain embodiments of the invention may include a structure defining an interior space, the structure having one or more openings through the structure. For example, the cap 110 illustrated in FIGS. 9 through 15 includes a generally cylindrical shape having a cap base opening 111 and a wall 112 extending up from the cap base opening 111. A wall 112 may include a circumferential wall sloping slightly inward as it moves away from the cap base opening 111. The wall 112 may be continuous such that the wall 112 defines an interior space open to and in communication with the cap base opening 111. The wall 112 may also include one or more openings therein. Openings in the wall 112 define openings in the cap 110. For instance, a spray opening 113 may be positioned in a front portion of the wall 112 of the cap 110 as illustrated in FIG. 11. A trigger opening 114 may be positioned in a rear portion and top portion of the wall 112 of the cap 110. For example, portions of the inside surface of the cap 110 may be viewed through the trigger opening 114 as illustrated in FIG. 12.

Figure 9:
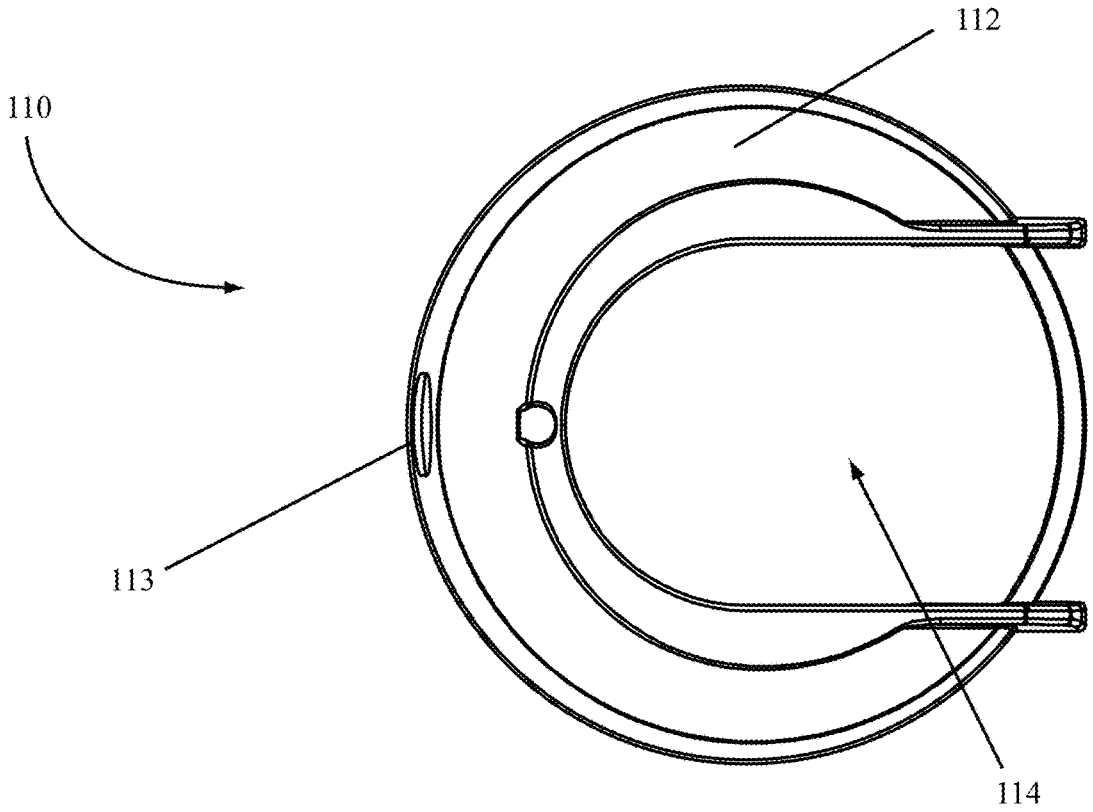
FIG. 9 illustrates a top view of a cap according to various embodiments of the invention.

FIG. 9 illustrates a top-down view of a cap 110 according to certain embodiments of the invention. FIG. 10 illustrates a bottom-up view of a cap 110. As illustrated, a trigger opening 114 in a back and top portion of the cap 110 provides access to the interior of the cap 110. On interior surfaces of the cap 110 are various features. For example, trigger mount grooves 116 on the trigger supports 115 can be seen in FIG. 10. Tapered locking ring support surfaces 119 on the locking ring supports 117 are also illustrated.

Figure 14:
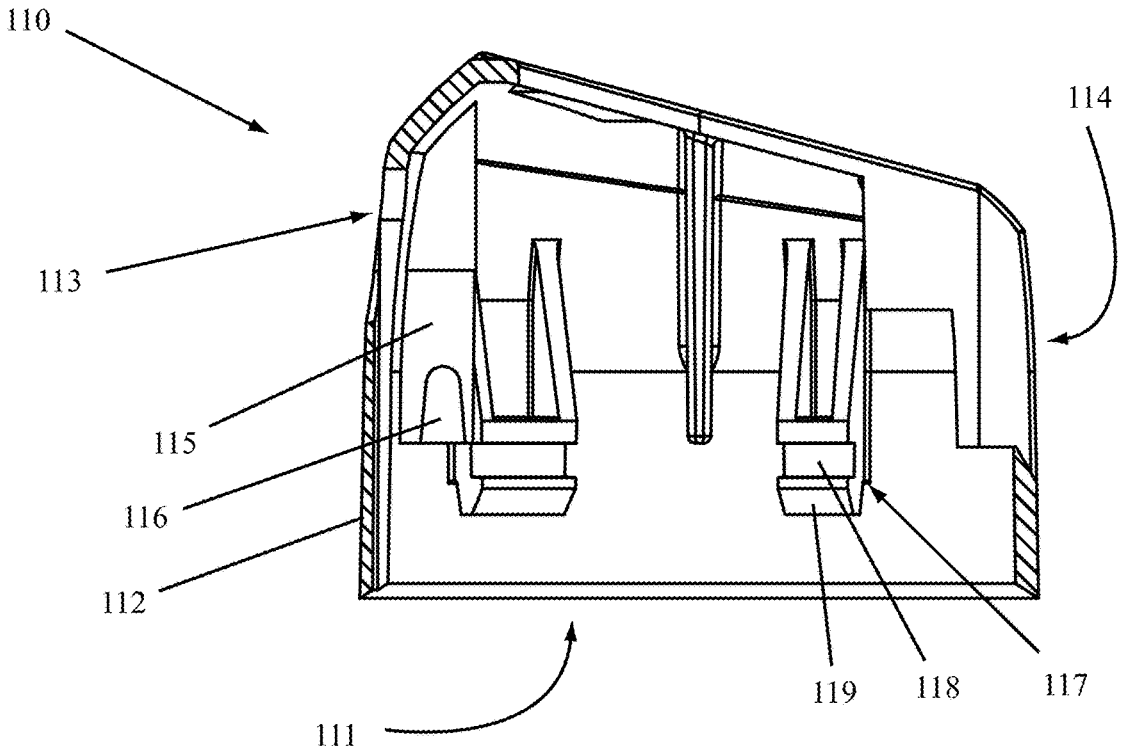
FIG. 14 illustrates a side cross-sectional view of the cap illustrated in FIG. 13.
Figure 15:
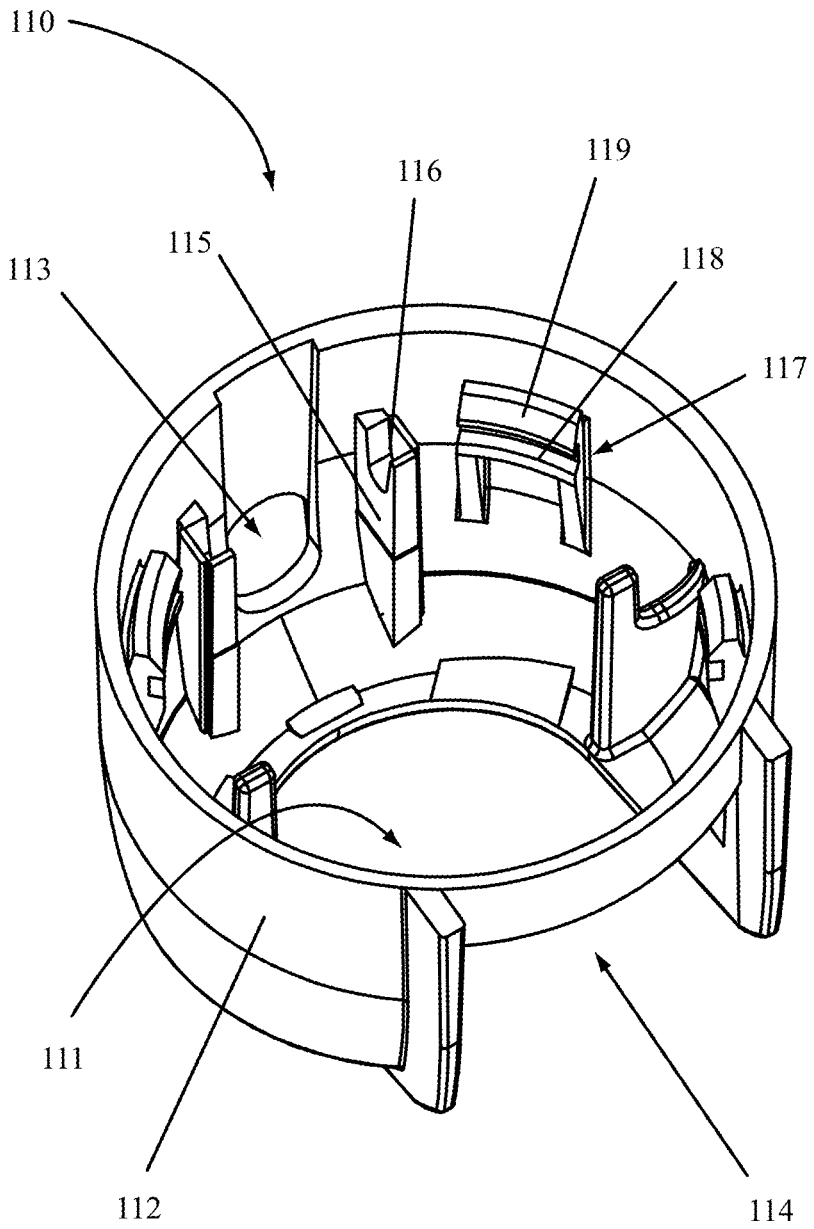
FIG. 15 illustrates a bottom-perspective view of a cap according to various embodiments of the invention.

According to various embodiments of the invention, one or more trigger supports 115 may be molded with the cap 110 on an interior thereof. The one or more trigger supports 115 may include or support one or more trigger mount grooves 116. For example, as illustrated in FIGS. 14 and 15, various embodiments of the invention may include two trigger supports 115 on an interior portion of the cap 110. Each of the trigger supports 115 may include a trigger mount groove 116. The trigger mount grooves 116 may include notches, holes, openings, or other features in the trigger supports 115 wherein the trigger mount grooves 116 are configured to receive a post, projection, or other feature of a trigger 170 to connect a trigger 170 to the cap 110 or hold a trigger 170 in a position relative to the cap 110.

A cap 110 may also include one or more locking ring supports 117 as illustrated in FIGS. 14 and 15. A locking ring support 117 may be molded with the cap 110 and may include a locking ring opening 118 and a tapered locking ring assembly surface 119. The tapered locking ring assembly surface 119 may be adjacent an end of the locking ring support 117 which may not be connected to the cap 110 such that the portion of the locking ring support 117 adjacent the tapered locking ring assembly surface 119 may flex to allow a rim 136 of a locking ring 130 to snap into the locking ring opening 118. The tapered locking ring surface 119 may also create a lip or overhang such that once a rim 136 of a locking ring 130 is assembled past the tapered locking ring surface 119 it cannot be easily removed from the locking ring opening 118. For example, as illustrated in FIG. 15, the lower portions of the locking ring supports 117—the portions nearest the cap base opening—include a locking ring opening 118 configured as a notch or groove in the locking ring supports 117. The notch or groove provides a secure attachment of a locking ring 130 to the cap 110 upon assembly. In addition, the open space behind the tapered locking ring assembly surface 119—the space between the tapered locking ring assembly surface 119 and the cap 110 wall 112—allows the portion of the locking ring support 117 adjacent the tapered locking ring assembly surface 119 to flex such that a locking ring 130 may be assembled and snap-fit to the cap 110.

A manifold 150 according to various embodiments of the invention is illustrated in FIGS. 16 through 21. According to certain embodiments of the invention, a manifold 150 may include in inlet 152 and an outlet 154 defined by a body with a flow path 151 between the inlet 152 and outlet 154. At an inlet 152, a valve seat 158 may be defined. The valve seat 158 may be configured to mate with or accept a valve attached to a container 900, such as a conventional aerosol valve. At an outlet 154, an orifice cup seat 159 may be defined. The orifice cup seat 159 may be adjacent an orifice post 155. An orifice cup may be inserted into the orifice cup seat 159 to produce a desired spray pattern.

Figure 16:
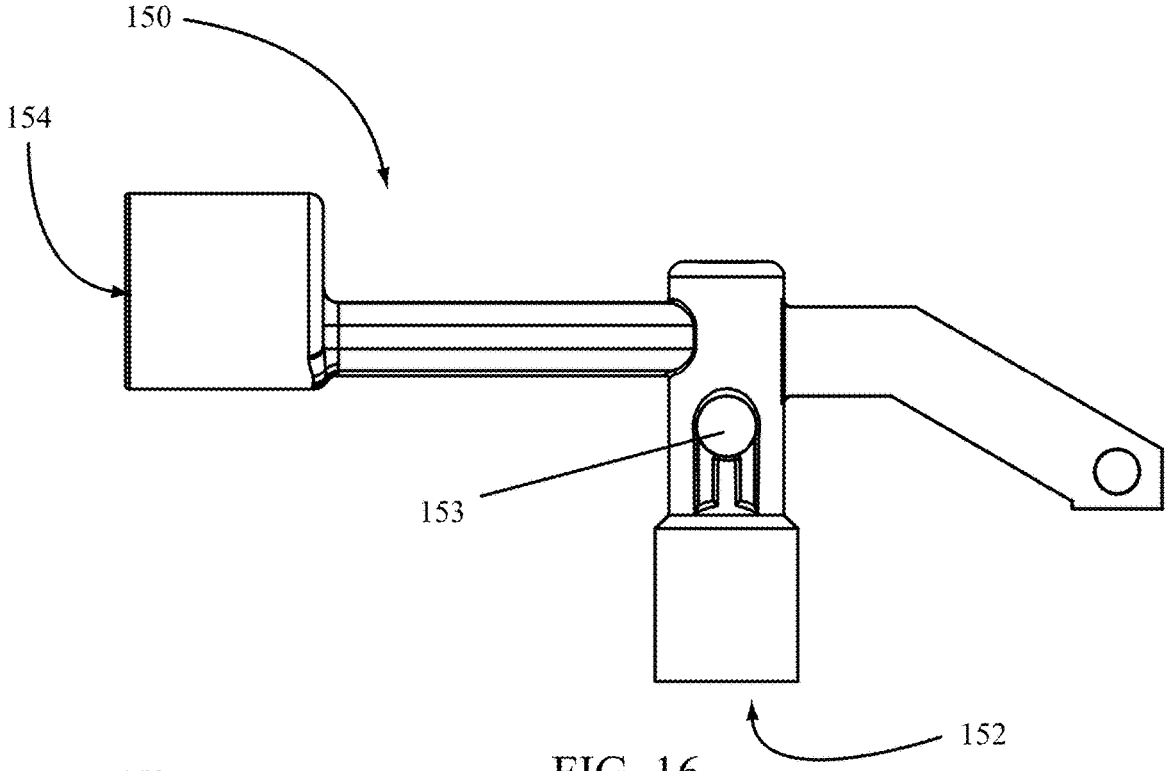
FIG. 16 illustrates a side view of a manifold according to various embodiments of the invention.
Figure 20:
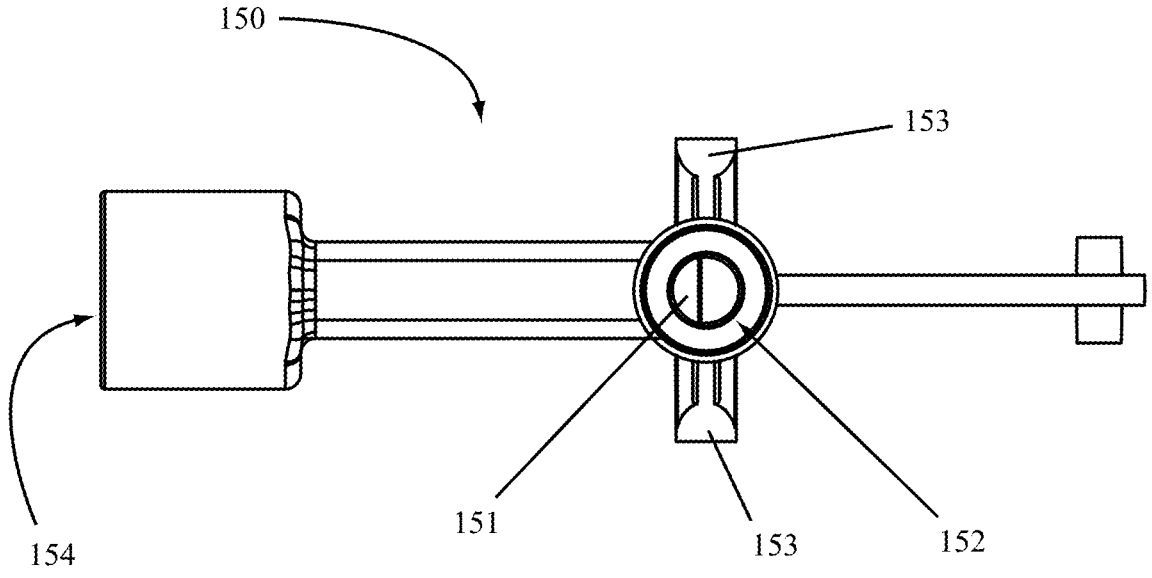
FIG. 20 illustrates a bottom-up view of a manifold according to various embodiments of the invention.
Figure 21:
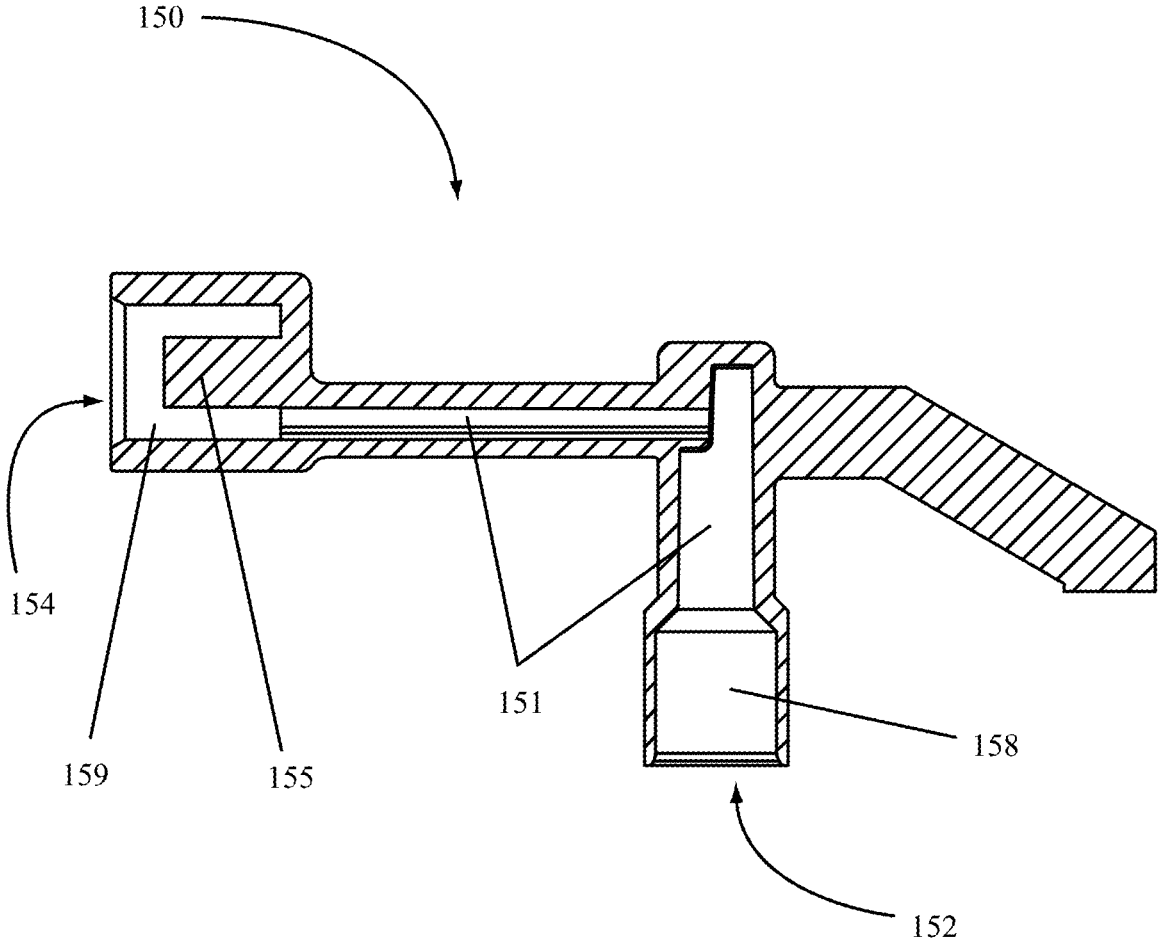
FIG. 21 illustrates a cross-sectional view of a manifold according to various embodiments of the invention.

A side view of a manifold 150 according to various embodiments of the invention is illustrated in FIG. 16. As illustrated, a manifold 150 may include an inlet 152 and an outlet 154. The inlet 152 may be any shape and may be configured to mate with or communicate with a valve on a container 900, such as a conventional aerosol valve. As illustrated in FIGS. 16, 20, and 21, the inlet 152 may include a circular opening having a diameter selected to allow fitment of a valve therein. The inlet 152 may open into a valve seat 158 which may or may not be tapered. The valve seat 158 may be configured to mate with or accept a valve therein. In some embodiments, the valve seat 158 may be shaped or configured to snuggly mate with a valve such that no leakage will occur when the valve and manifold 150 are mated together. In further embodiments, the valve, manifold 150 or both valve and manifold 150 may include ridges, detents, or other features to improve a seal between a valve and the valve seat 158 of the manifold 150.

A flow path 151 is in communication with the valve seat 158 and is configured to direct or carry a product released by a valve seated in the valve seat 158 to the outlet 154 of the manifold 150. While an exemplary flow path 151 is illustrated in FIG. 21, it is understood that the geometries, shape, and path of the flow path 151 may vary or be designed as needed for specific applications. For example, in FIG. 21, the flow path 151 narrows from the valve seat 158 into a vertical passageway. A narrower horizontal passageway in communication with the vertical passageway extends the flow path 151 towards an orifice cup seat 159 and the outlet 154. Product flowing through the manifold 150 would exit a valve seated in the valve seat 158, follow the flow path 151 through the manifold 150 to the orifice cup seat 159 and out the outlet 154 of the manifold 150.

Figure 17:
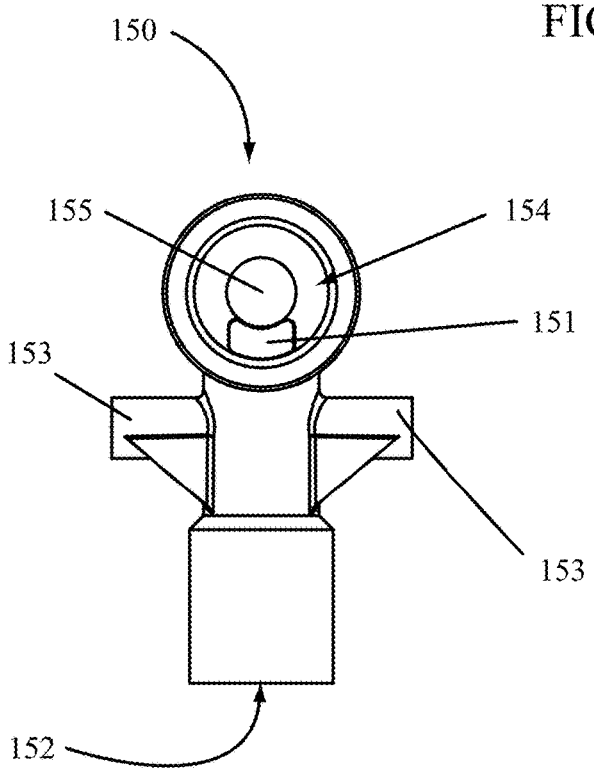
FIG. 17 illustrates a front view of a manifold according to various embodiments of the invention.
Figure 18:
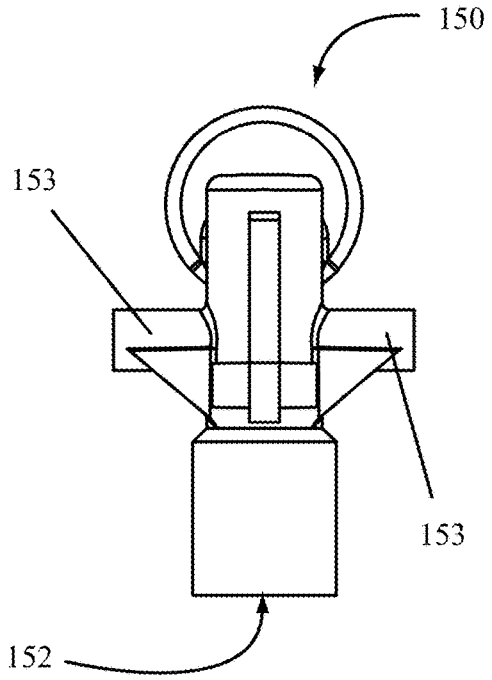
FIG. 18 illustrates a rear view of a manifold according to various embodiments of the invention.
Figure 19:
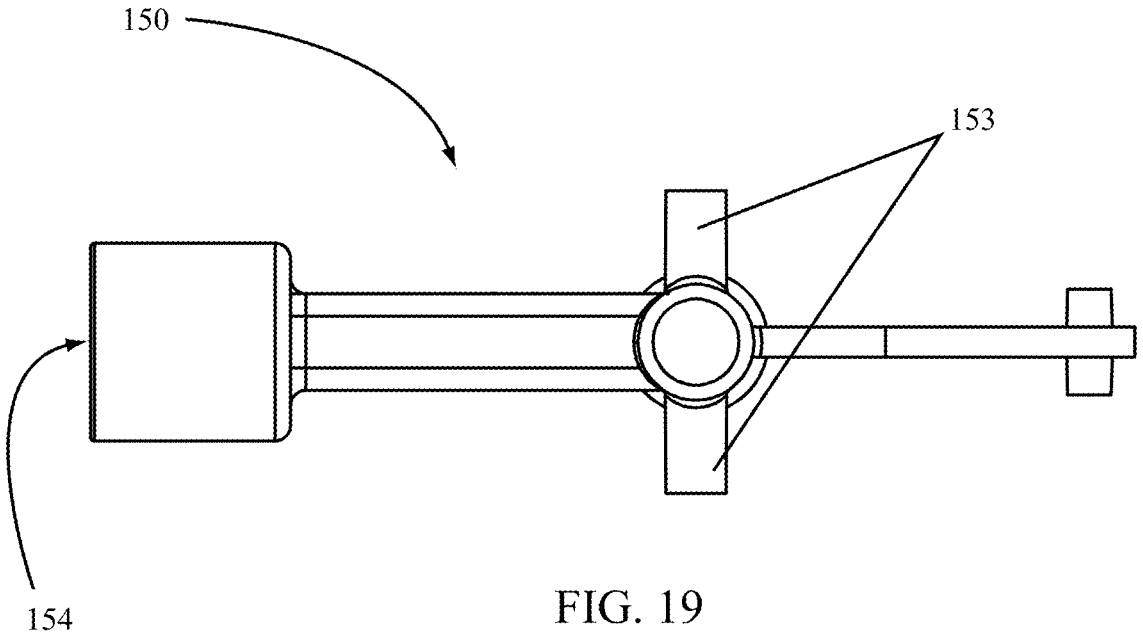
FIG. 19 illustrates a top-down view of a manifold according to various embodiments of the invention.

According to various embodiments of the invention, the manifold 150 may include an orifice cup seat 159 configured to retain conventional orifice cups. An orifice post 155 may be centered or otherwise positioned in a portion of the orifice cup seat 159 and may be configured to work with an orifice cup to provide spray characteristics to a product passing through the manifold 150. For example, in various embodiments of the invention, an orifice post 155 may be molded with the manifold 150 and positioned in the center of the orifice cup seat 159 as illustrated in FIGS. 17 and 21. The orifice post 155 may interact with an orifice cup 168 inserted in the orifice cup seat 159. For example, an orifice cup 168 may be inserted into the orifice cup seat 159 of the manifold 150 during assembly of an aerosol actuator 100. The shape, size, and configuration of the orifice post 155 may be designed to interact with an orifice cup 168 to provide a desired set of spray characteristics to a product passing through the manifold 150. The shape, size, and configuration of an orifice cup 168 may also be changed to match—or work with—the orifice post 155 to provide desired spin mechanics to a fluid or product being propelled through the manifold 150.

A manifold 150 according to certain embodiments of the invention may also include one or more actuator posts 153 as illustrated in FIGS. 16 through 20. In certain embodiments, a manifold 150 may include two actuator posts 153 extending off of and away from a body portion of the manifold 150. For example, two actuator posts 153 may be on opposite sides of that portion of a manifold 150 body defining the vertical portion of the flow path 151 as illustrated. Each of the actuator posts 153 may extend away from the manifold 150 body. The actuator posts 153 may be molded with the manifold 150 and may be configured to bear a certain amount of force. In some embodiments, the actuator posts 153 may include additional support structures or features to ensure that repetitive application of force to the top portion or side portions of the actuator posts 153 does not deflect or otherwise alter the positioning of the actuator posts 153 relative to the manifold 150 body.

A manifold 150 according to various embodiments of the invention may also include an extension away from the body of the manifold 150 in a direction opposite the outlet 154 side of the manifold 150. For example, as illustrated, the extension off of the manifold 150 in the direction opposite the inlet 154 may be used a gate portion of the manifold 150 to facilitate the molding of the manifold 150.

A trigger 170 according to various embodiments of the invention is illustrated in FIGS. 22 through 27 and may include a button actuator 172, a lever actuator 174 extending off of or from the button actuator 172, one or more pivot supports 177, one or more actuator wings 173, one or more retention posts 175, and a trigger actuation lock 179. A trigger 170 may also include one or more trigger ribs 171 providing support to the lever actuator 174.

Figure 22:
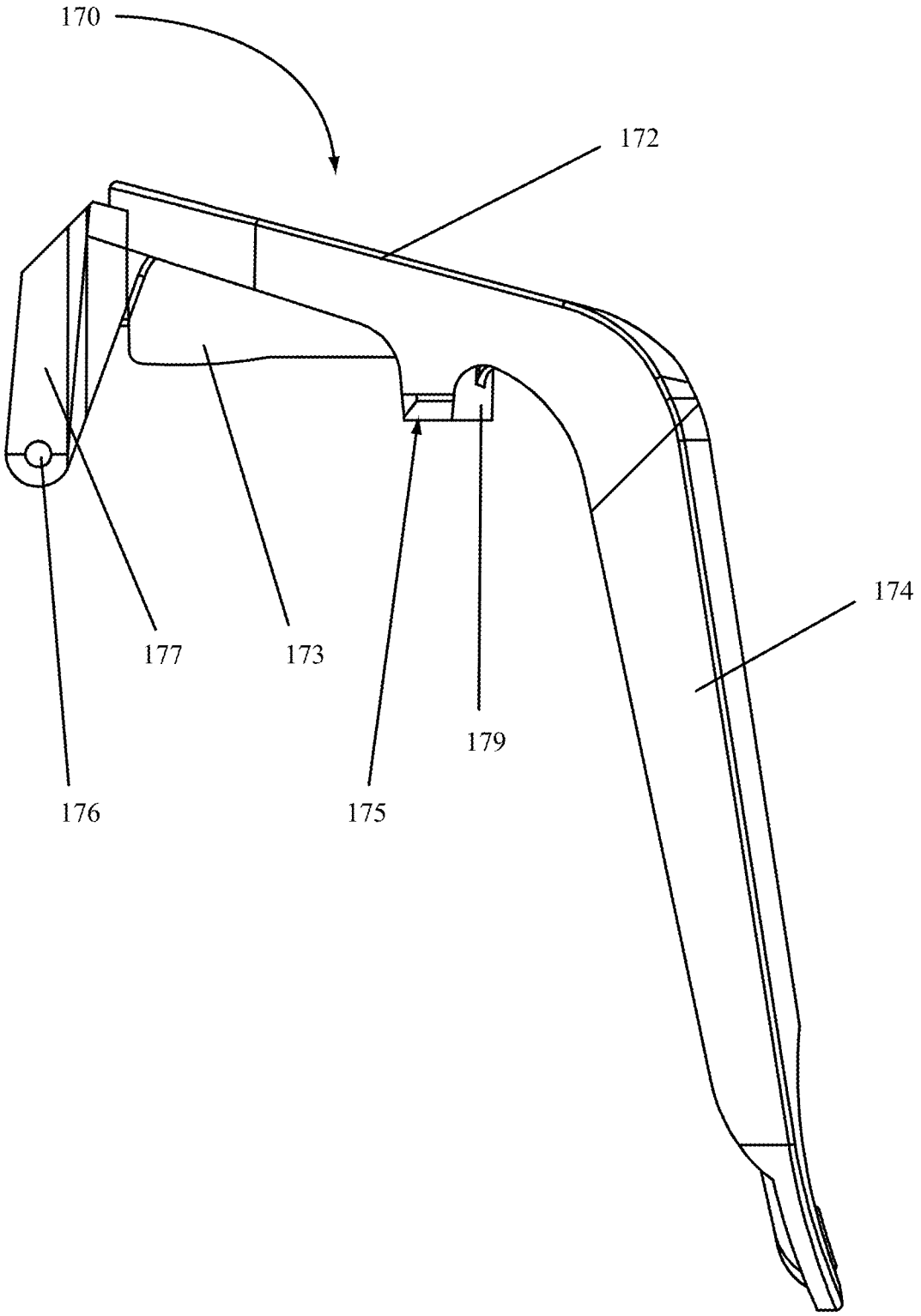
FIG. 22 illustrates a side view of a trigger according to various embodiments of the invention.
Figure 23:
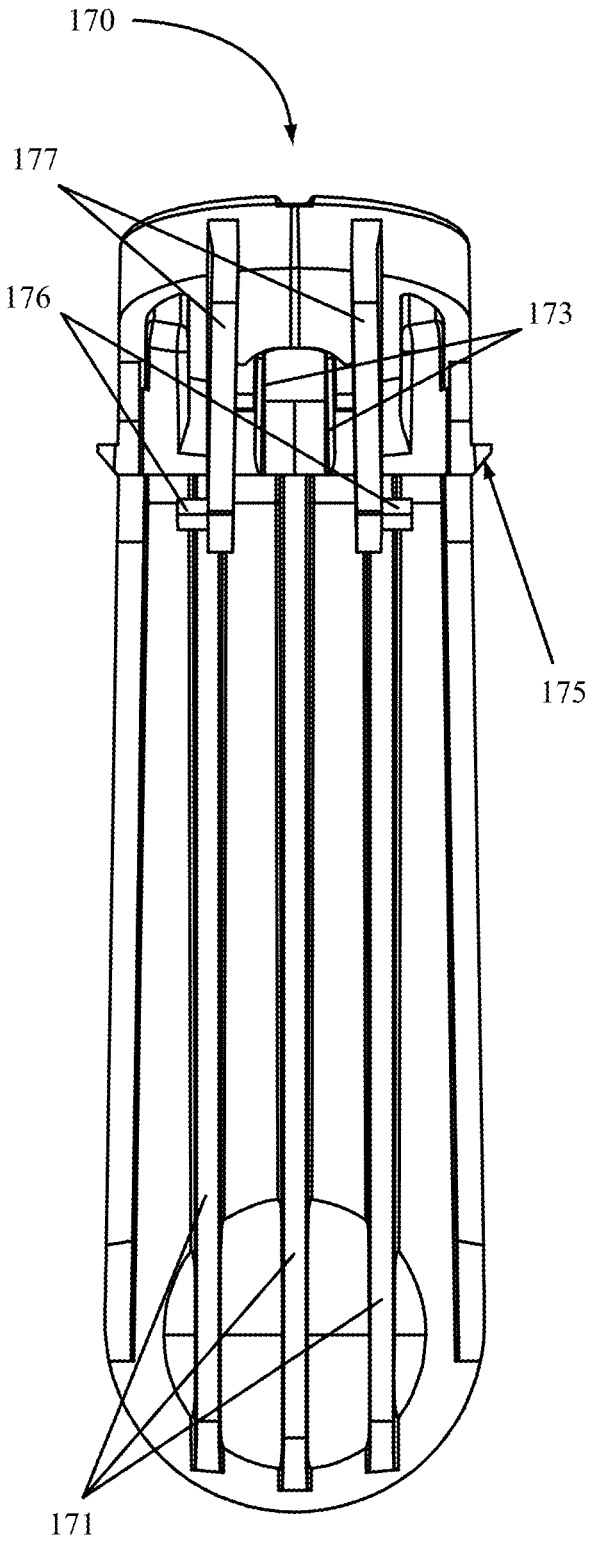
FIG. 23 illustrates a front view of a trigger according to various embodiments of the invention.
Figure 24:
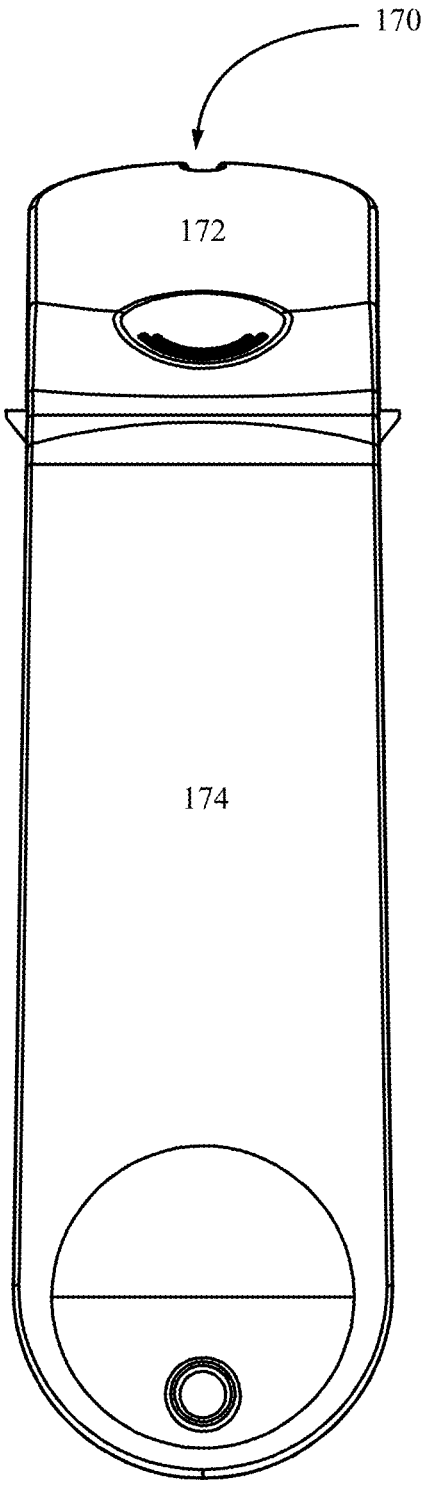
FIG. 24 illustrates a rear view of a trigger according to various embodiments of the invention.
Figure 25:
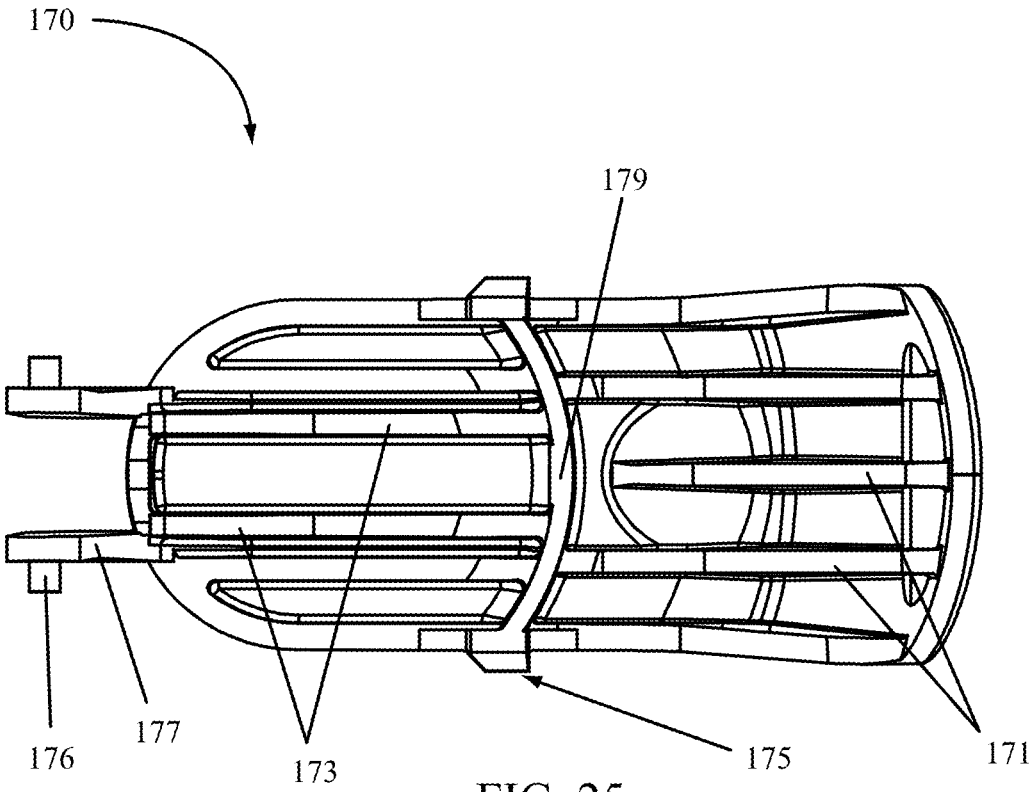
FIG. 25 illustrates a bottom view of a trigger according to various embodiments of the invention.
Figure 26:
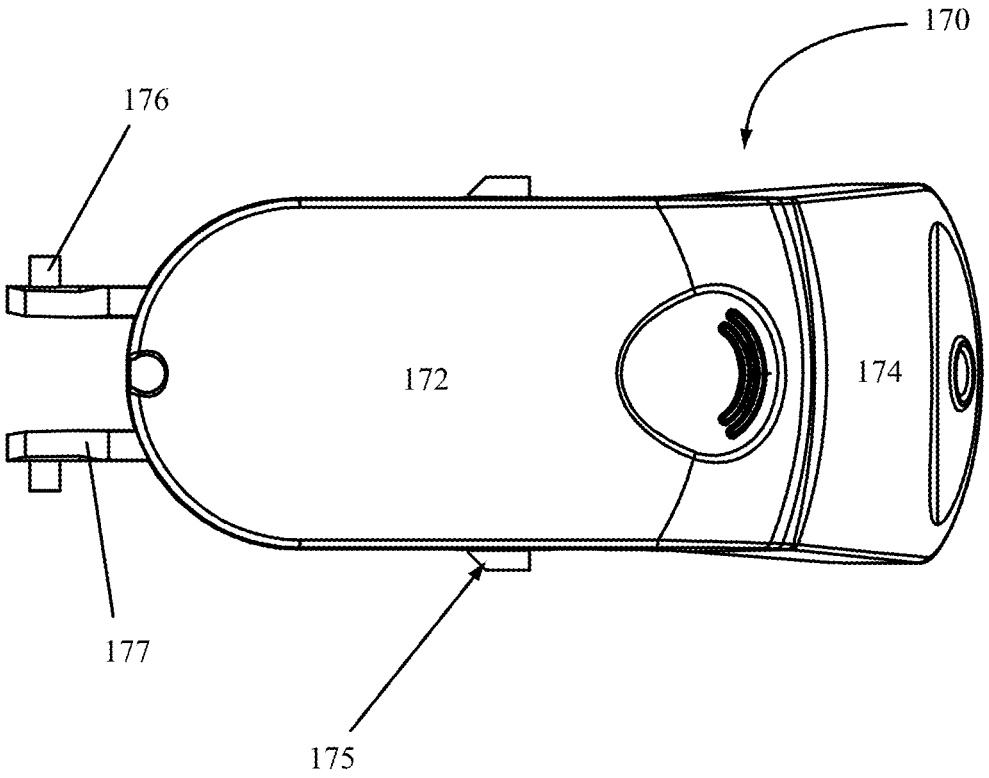
FIG. 26 illustrates a top view of a trigger according to various embodiments of the invention.
Figure 27:
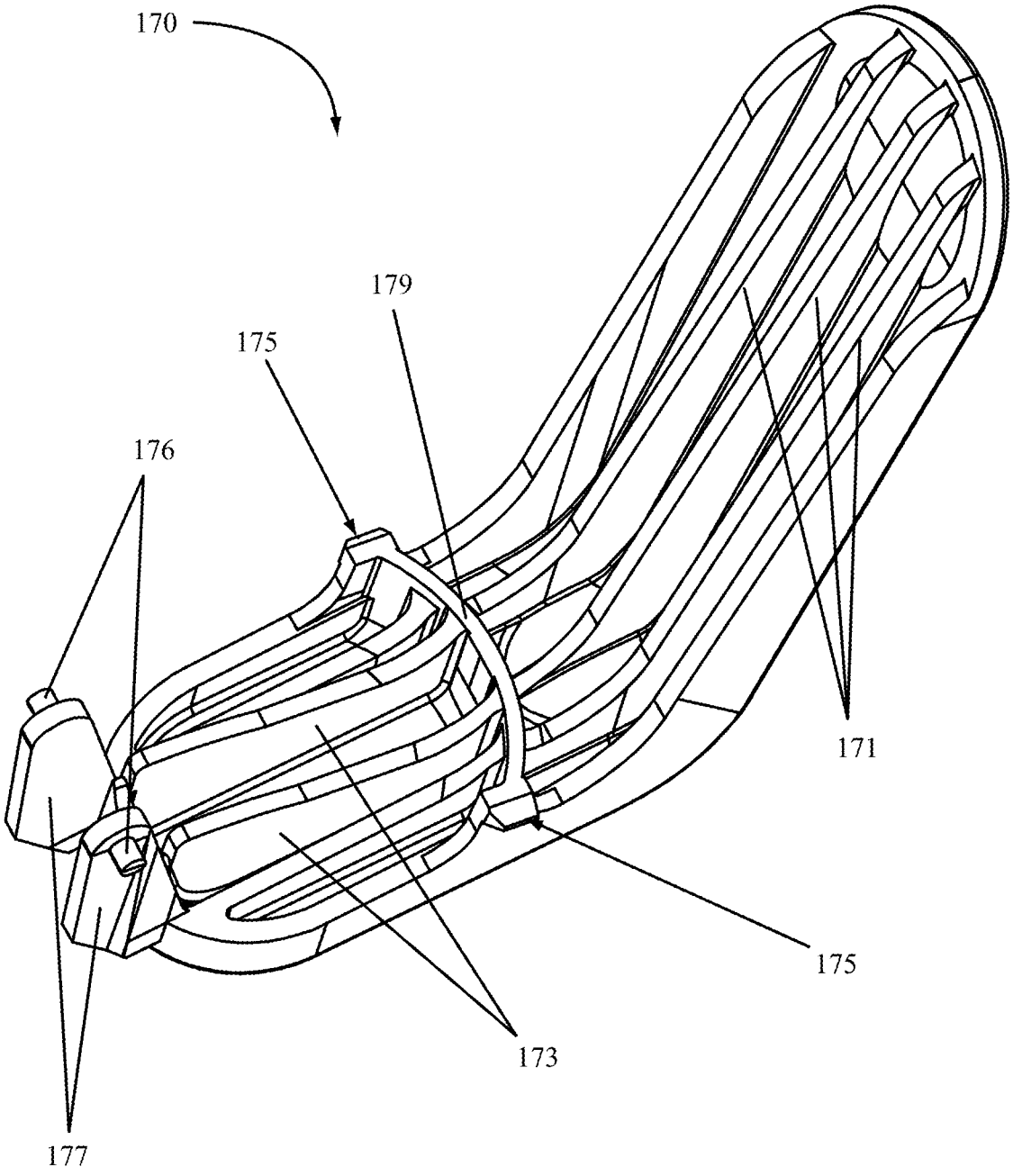
FIG. 27 illustrates a bottom-perspective view of a trigger according to various embodiments of the invention.

A trigger 170 according to various embodiments of the invention is illustrated in FIG. 22. A trigger 170 may include a top button actuator 172 having a horizontal or sloping surface sloping towards a lever actuator 174. As illustrated in FIG. 22, the top surface of the trigger 170 is the button actuator 172 which slopes to a hard angle where it joins the lever actuator 174 which has a greater downward slope than the button actuator 172. In some embodiments, the length of the button actuator 172 may be shorter than the length of the lever actuator 174 as illustrated in FIG. 22.

One or more pivot supports 177 may extend off of the trigger 170. A pivot support 177 may include one or more features for mating with another part or component of an aerosol actuator 100. For instance, as illustrated in FIGS. 22, 23, and 25 through 27, each pivot support 177 may include a trigger post 176 extending outwards from the pivot support 177. The one or more trigger posts 176 may be configured or shaped to fit with or mate with one or more trigger mount grooves 116 of a cap 110. When positioned in the one or more trigger mount grooves 116 as illustrated in FIG. 4, the trigger 170 may pivot about the one or more trigger posts 176 relative to the cap 110.

While various embodiments of the invention include one or more trigger posts 176 configured to mate or fit in one or more trigger mount grooves 116 of a cap 110 as illustrated, it is understood that a cap 110 may include posts and the trigger 170 include grooves to accomplish the same purpose of rotatably fixing a trigger 170 to a cap 110.

Triggers 170 according to various embodiments of the invention may also include one or more actuator wings 173 as illustrated in FIGS. 22, 23, 25, and 27. The one or more actuator wings 173 may extend downwards from an underside of the trigger 170 and may be configured to engage or interact with one or more actuator posts 153 of a manifold 150. For example, the trigger 170 illustrated in FIGS. 22, 23, 25, and 27 includes two actuator wings 173 extending downward from an underside of the trigger 170. Each actuator wing 173 extends from a front portion of the trigger 170 back to the trigger actuation lock 179. According to various embodiments of the invention, each of the actuator wings 173 may have a wave-like shape configured to apply an actuating force to a manifold 150 when either the button actuator 172 or lever actuator 174 are actuated.

In some embodiments of the invention, a trigger 170 may also include one or more retention posts 175. For example, as illustrated in FIGS. 22, 23, 25, and 27, a trigger 170 may include two retention posts 175 extending downward from an underside of the trigger 170. In the illustrated embodiments, each retention post 175 is positioned next to or as a part of the outer edges of the trigger actuation lock 179. It is understood, however, that retention posts 175 may be located anywhere on the underside of the trigger 170 as desired. Each retention post 175 may include a sloping or tapered surface and projection away from the trigger 170. When assembled as part of an aerosol actuator 100, each retention post 175 may snap into or past a surface on a cap 110 during the assembly process. Once assembled with a cap 110, the retention posts 175 may prevent the trigger 170 from being easily disassembled from the aerosol actuator 100.

A trigger actuation lock 179 according to certain embodiments of the invention may include a projection off of an underside of a trigger 170. The trigger actuation lock 179 may be configured such that it may interact with, contact, or otherwise engage a lock projection 134 on a locking ring 130. When engaged, a lock projection 134 and trigger actuation lock 179 may prevent the trigger 170 from being actuated or prevent the trigger 170 from rotating about the one or more trigger posts 176. While the particular trigger actuation lock 179 illustrated in FIGS. 22, 23, 25, and 27 spans the width of the trigger 170, it is understood that a trigger actuation lock 179 may be shaped or configured as desired.

Figure 28:
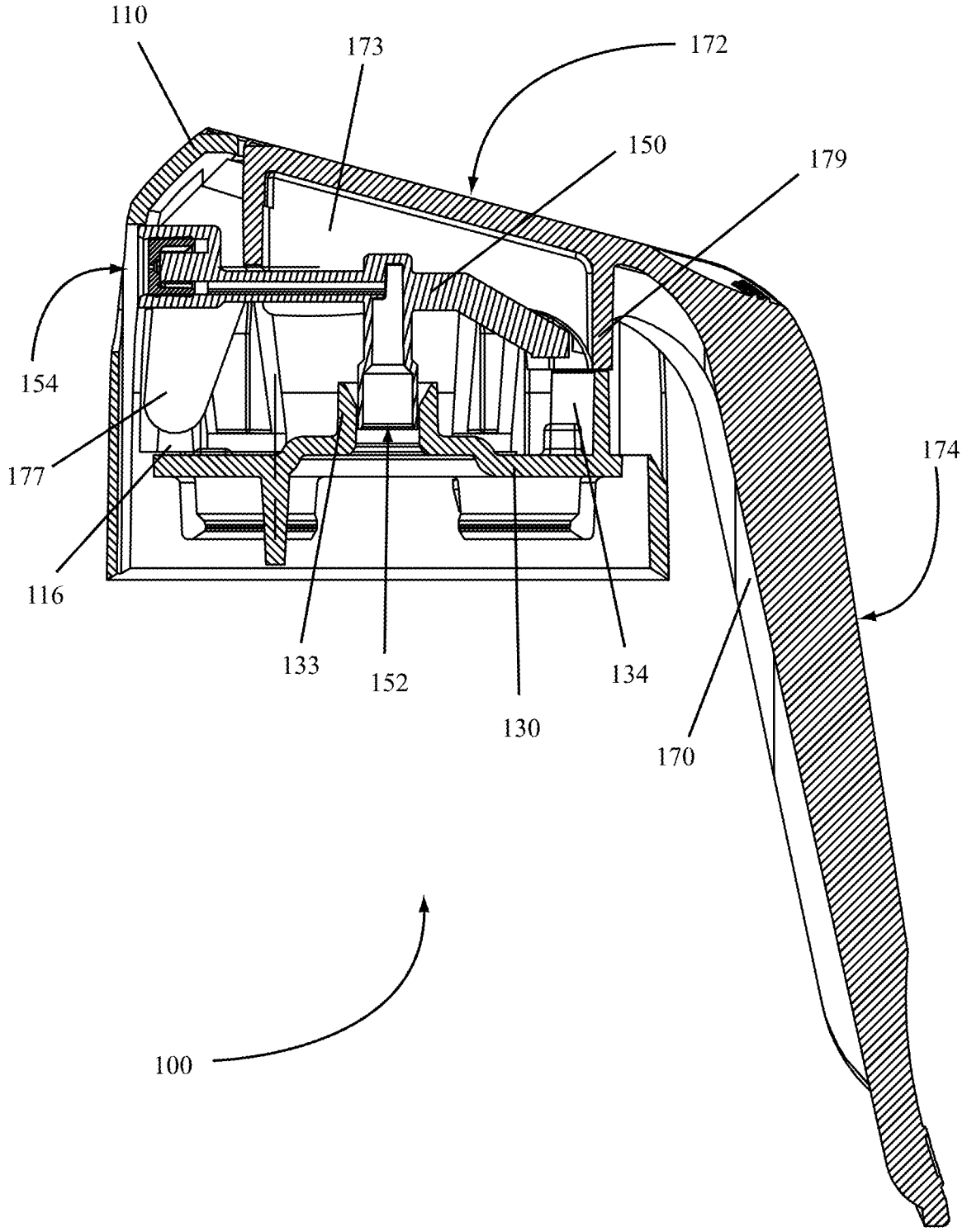
FIG. 28 illustrates a cross-sectional, side view of an aerosol actuator according to various embodiments of the invention.
Figure 29:
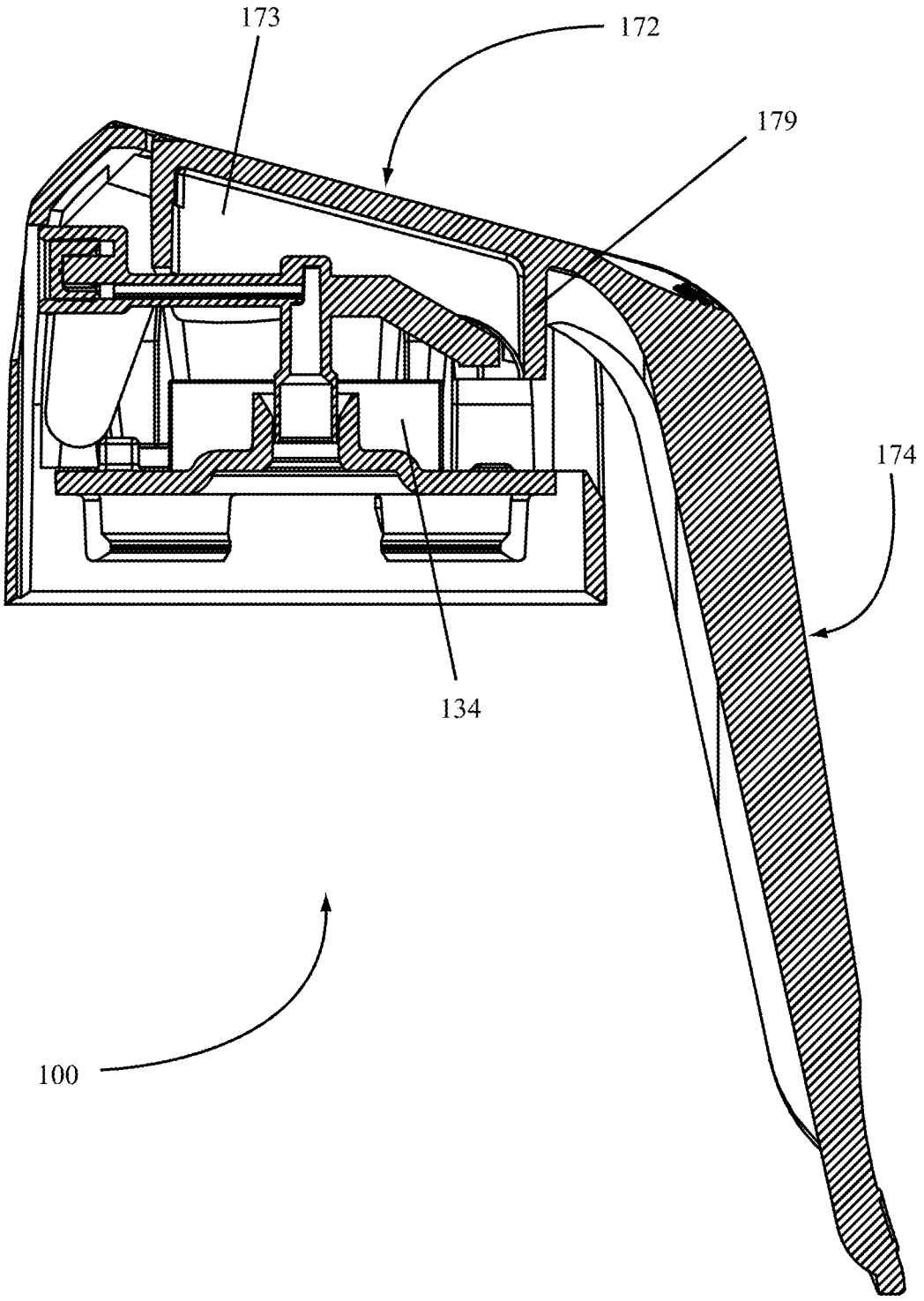
FIG. 29 illustrates a cross-sectional, side view of an aerosol actuator according to various embodiments of the invention.
Figure 30:
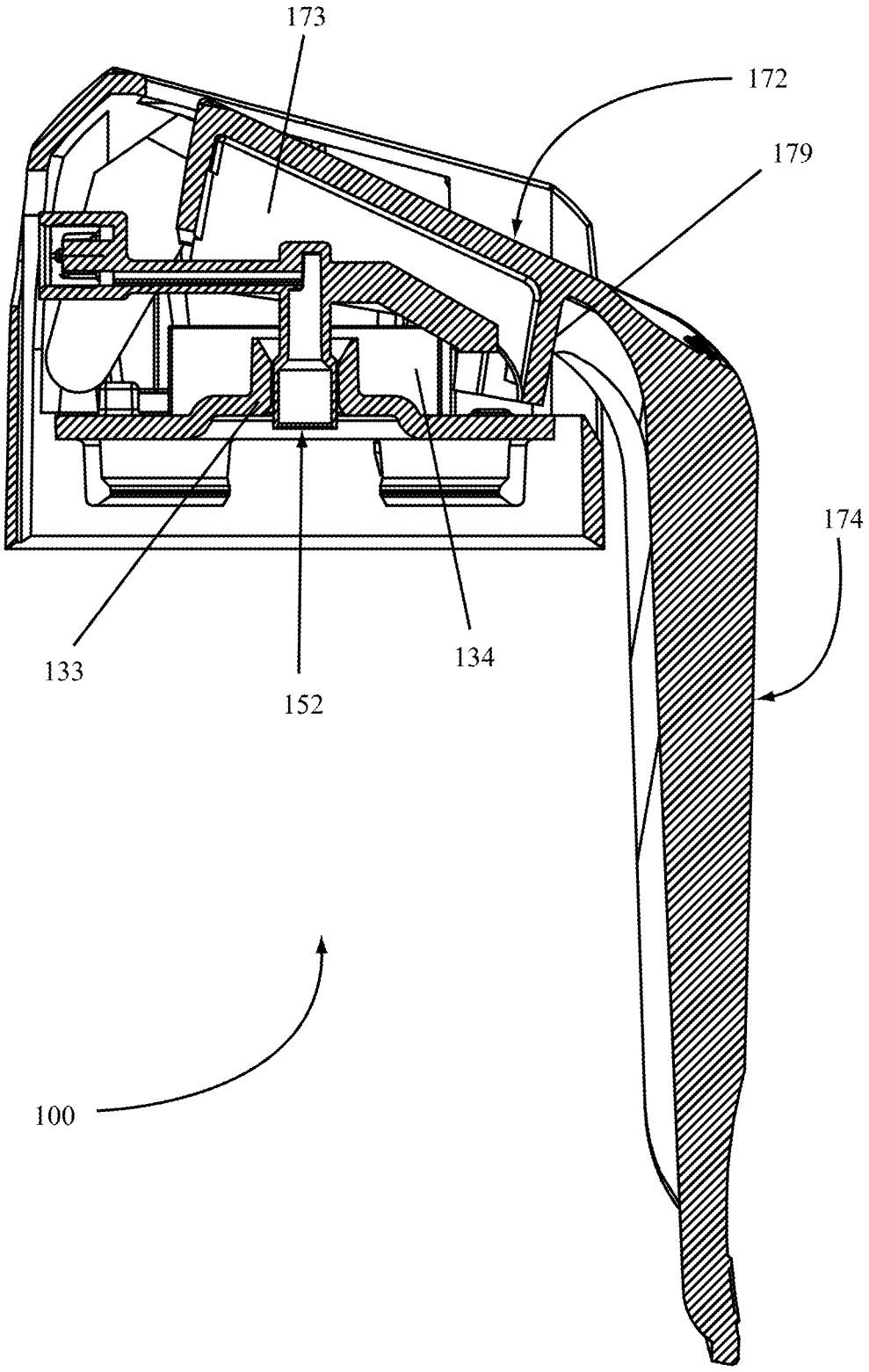
FIG. 30 illustrates a cross-sectional, side view of an aerosol actuator according to various embodiments of the invention.

Components of an aerosol actuator 100 according to various embodiments of the invention are illustrated in FIG. 3 and views of an assembled aerosol actuator 100 according to various embodiments of the invention are illustrated in FIGS. 28-30.

A cross-sectional view of an aerosol actuator 100 in a locked position according to various embodiments of the invention is illustrated in FIG. 28. As illustrated, a locking ring 130 is assembled with a cap 110 such that a rim 136 of the base 131 of the locking ring 130 is snap-fit into one or more locking ring openings 118 of the locking ring supports 117 of the cap 110. During assembly, a locking ring 130 may be pushed onto or into a cap 130 such that the rim 136 of the locking ring 130 snaps into the locking ring supports 117. For example, a locking ring 130 may be pushed onto a cap 110 such that the rim 136 of the locking ring 130 applies force to the locking ring supports 117, causing them to flex until the rim 136 snaps into one or more locking ring openings 118, securing the locking ring 130 to the cap 110.

A manifold 150 may be seated in an interior portion of the cap 110 defined by the cap 110 and locking ring 130. The inlet 152 portion of the manifold 150 may seat in the manifold guide 133 of the locking ring 130. A trigger 170 may be inserted into an interior portion of the cap 130 such that the outlet 154 of the manifold 150 is supported between the pivot supports 177 of the trigger and the one or more trigger posts 176 are positioned in the trigger mount grooves 116. The trigger 170 is configured such that it can rotate about the one or more trigger posts 176. In addition, the actuator wings 173 of the trigger 170 may rest on the manifold posts 153 of the manifold 150 when assembled therewith. The trigger actuation lock 179 may contact the lock projection 134 of the locking ring 130 as illustrated in FIG. 28. When the trigger actuation lock 179 and lock projection 134 are in contact, the trigger 170 may be prevented from rotating or moving when a force is applied to the button actuator 172 or lever actuator 174. Thus, actuation of the aerosol actuator 100 may be prevented.

A cross-sectional view of an aerosol actuator 100 in an unlocked position is illustrated in FIG. 29. As illustrated, the cap 110, trigger 170 and manifold 150 may be rotated ninety degrees relative to the locking ring 130 such that the trigger actuation lock 179 is not in contact with the lock projection 134. In the unlocked position, the trigger 170 is free to rotate about the one or more trigger posts 176 or move such that the trigger 170 may apply a force upon the manifold 150. Application of a force against the button actuator 172 or the lever actuator 174 may rotate or move the trigger 170, causing the actuator wings 173 to act on the manifold posts 153, pushing the manifold 150 downward. For example, actuation of the trigger 170 illustrated in FIG. 29 may result in an actuated position of the aerosol actuator 100 as illustrated in FIG. 30.

As illustrated in FIG. 30, actuation of the aerosol actuator 100 involves the application of a force to button actuator 172, lever actuator 174, or both. Movement of the trigger 170 moves the positioning of the actuator wings 173 relative to the manifold posts 153 of the manifold 150. The change in positioning applies a force on the manifold 150 pushing it downwards in the manifold guide 133 to actuate a valve attached to a container 900 to which the aerosol actuator 100 is attached. According to various embodiments of the invention, the shape of the actuator wings 173 may be varied by application such that the movement of the manifold 150 may be controlled. For example, in some embodiments of the invention, the manifold 150 movement may need to be greater than in other embodiments in order to engage and open an aerosol valve. The shape of the actuator wings 173 may be changed accordingly to accommodate different actuation lengths or distances needed to open different sized and positioned valves. Further, the shape of the actuator wings 173 may be customized to control the force applied to the manifold 150, for example, the actuator wings 173 may be curved such that the initial movement of the trigger 170 sufficiently engages the trigger 170 with the manifold 150 to open the valve and begin product flow while the continued movement of the trigger 170 through the actuation movement only maintains the manifold 150 in the actuated position without moving the manifold 150 further.

Upon release of a force against a button actuator 172, lever actuator 174, or both, the valve may move the manifold 150 back into a non-actuated position, stopping flow of product through the valve and the manifold 150. Such movement may also move the trigger 170 back into a non-actuated position. For example, the spring force or return force of a valve may be sufficient to return a manifold 150 attached thereto or mated therewith to a non-actuated position upon cessation of a force being applied to the manifold 150. Movement of the manifold 150 to a non-actuated position may move a trigger 170 to a non-actuated position as well.

According to various embodiments of the invention, the locking ring 130 of an assembled aerosol actuator 100 may be snap-fit or otherwise connected to a container 900. In various embodiments, one or more base snap structures 138 of a locking ring 130 may include one or more lips 137 which may be forced over the chime of an aerosol container 900. The one or more base snap structures 138 may flex to allow fitment of the aerosol actuator 100 onto a container 900 and the one or more lips 137 and base snap structures 138 may help retain the aerosol actuator 100 on a container 900 such that it cannot be easily removed from the container 900. Upon such connection, a valve associated with the container 900 may be seated adjacent to the manifold opening 132 of the locking ring 130. Upon actuation of the trigger 170, the manifold 150 may be moved downward such that the valve seat 158 of the manifold interacts with the valve, allowing product to flow through the valve and into the flow path 151 of the manifold 150. In some embodiments, the manifold 150 may interact with the valve and the valve seat 158 may seal with the valve once the aerosol actuator 100 is assembled to a container 900 having a valve.

An assembled aerosol dispenser 10 including an aerosol actuator 100 and container 900 is illustrated in FIGS. 1A and 1B. As illustrated, the aerosol actuator 100 may be shaped such that upon connection with the container 900 it is flush with the container 900 wall. In other embodiments, an aerosol actuator 100 may not be flush with the container 900 wall or may include other shapes.

An aerosol dispenser 10 as illustrated in FIG. 1B may be actuated by applying a force to the trigger 170. A force may be applied to the button actuator 172, the lever actuator 174 or both. Upon application of such force, a product may flow from within the container 900 and out the manifold 150 outlet 154. For example, a user may grasp an aerosol dispenser 10 in their hand and use a finger to apply a force to the button actuator 172 sufficient to move the manifold 150 and open a valve connected thereto. Once the valve is opened, product may be dispensed from the aerosol actuator 100.

In some embodiments of the invention, actuation of the aerosol actuator 100 occurs by the application of force to the lever actuator 174. As the lever actuator 174 is moved towards the container 900 or pushed downward, the trigger 170 may apply a force to the manifold 150 to open the valve and begin flow of a product from the aerosol actuator 100. The use of the lever actuator 174 is beneficial in those instances where it is difficult to use or angle the aerosol dispenser 10 to apply a product to a desired area. For example, when utilizing traditional aerosol applicators to apply a sunscreen product to a person's body, a user may reach over their shoulder to apply the product to their back. In such instances, it is difficult to obtain the necessary reach to cover the back when only a traditional button or actuator is present. Utilizing the lever actuator 174 of embodiments of the present invention, a user may extend their reach to cover more of their back or improve the coverage across their back. In addition, the lever actuator 174 offers improved ergonomics for the application of a product from the aerosol dispenser 10. In addition, the lever actuator 174 may be used to apply a product directly towards a user. Utilizing the aerosol dispenser 10, a user may point the outlet 154 of the manifold 150 toward themselves, gripping the aerosol dispenser 10 such that they may use a finger—such as their index finger—or fingers to pull on the lever actuator 174 and dispense a product toward themself.

Use of the lever actuator 174 with various embodiments of the invention also allows a user to vary the way in which they actuate the aerosol dispenser 10. The ability to use different positions, to use their fingers or thumb, or to use the palm of a hand to press on either the button actuator 172 or lever actuator 174 allows a user to use different positions during the dispensing of a product. The existence of the multitude of different options for actuation may help reduce fatigue associated with the actuation of the aerosol dispenser 10. For example, utilizing a traditional button-actuated aerosol dispenser, a user is confined to pressing on the button with a single finger. If continued actuation is desired, the constant pushing with a single finger can cause fatigue and even soreness in the finger being utilized to actuate the dispenser. Utilizing an aerosol actuator 100 according to various embodiments of the invention, a user may alter positions of their hand during actuation, thus relieving the stress on any one finger. For instance, a user may begin dispensing an aerosol actuator 100 by pressing on the button actuator 172 in a traditional manner. As fatigue sets in, the user may grip the container 900 with the lever actuator 174 between the user's palm and container 900 such that squeezing the container 900 towards the user's palm applies force to the lever actuator 174 sufficient to continue actuation. The user may then adjust positions such that their thumb may apply a force to the lever actuator 174 for actuation.

Utilizing aerosol actuators 100 according to various embodiments of the invention, a user may have more options to actuate an aerosol dispenser 10.

Figure 31:
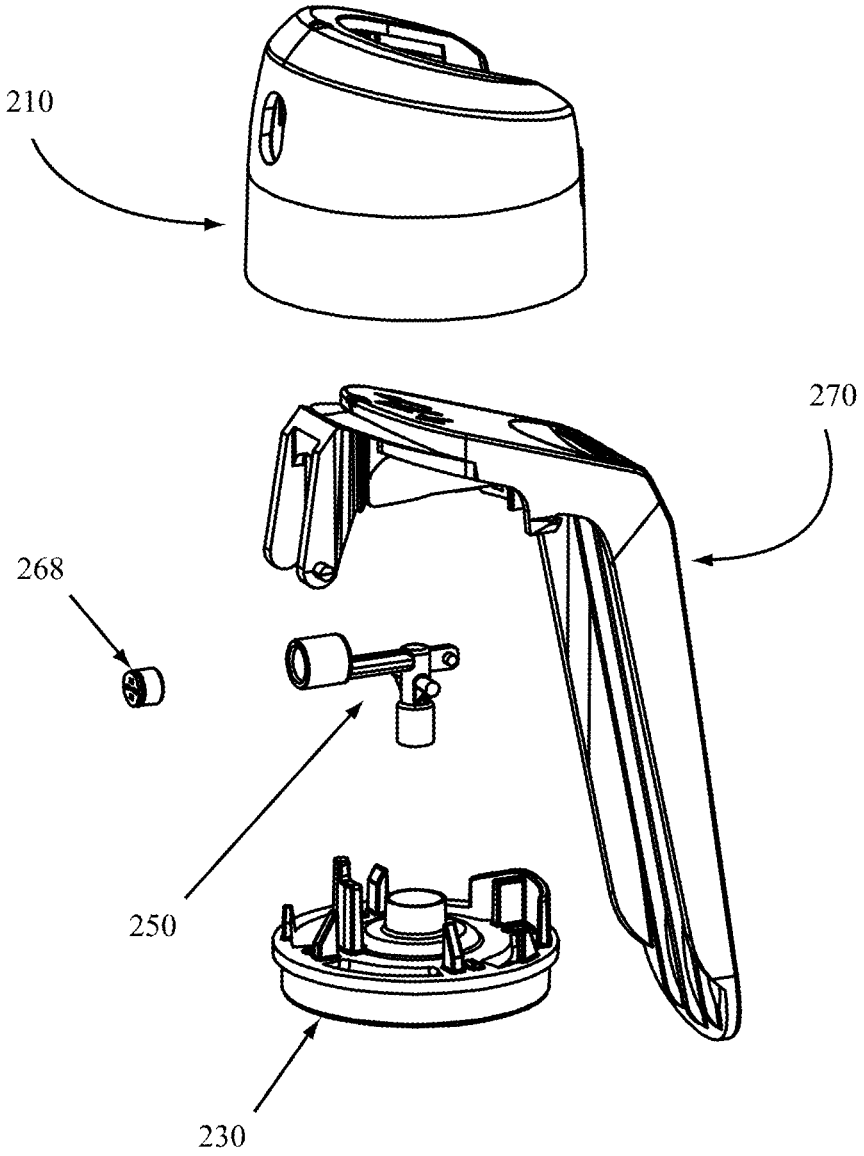
FIG. 31 illustrates an exploded view of an aerosol actuator according to various embodiments of the invention.

An aerosol actuator 100 according to other embodiments of the invention is illustrated in FIGS. 31 through 59. As illustrated in FIG. 31, an aerosol actuator 100 may include a locking ring 230, a manifold 250, a trigger 270, and a cap 210. An orifice cup 268 may be inserted into the manifold 250 as desired with various embodiments of the invention.

Figure 32:
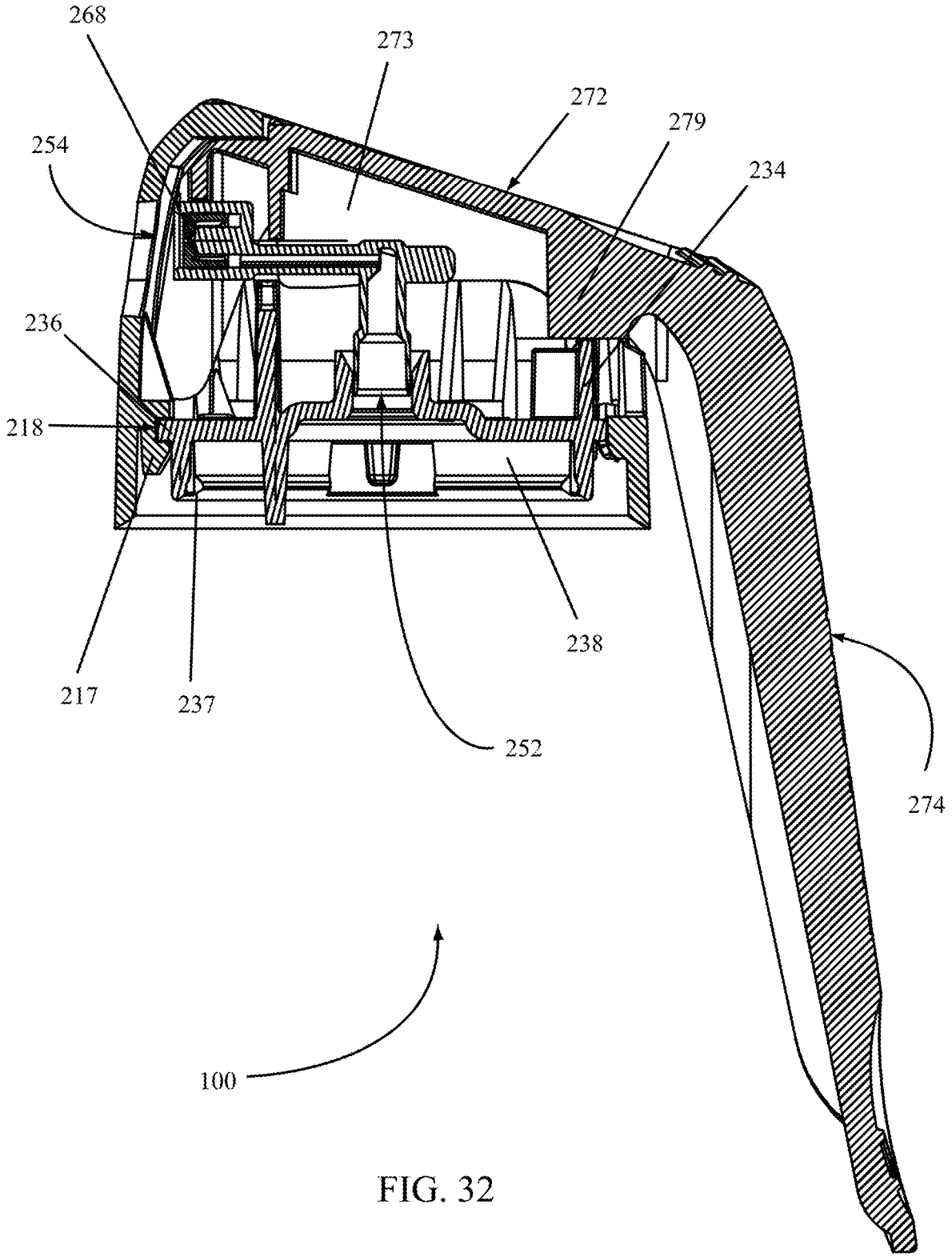
FIG. 32 illustrates a cross-sectional, side view of an aerosol actuator according to various embodiments of the invention.
Figure 33:
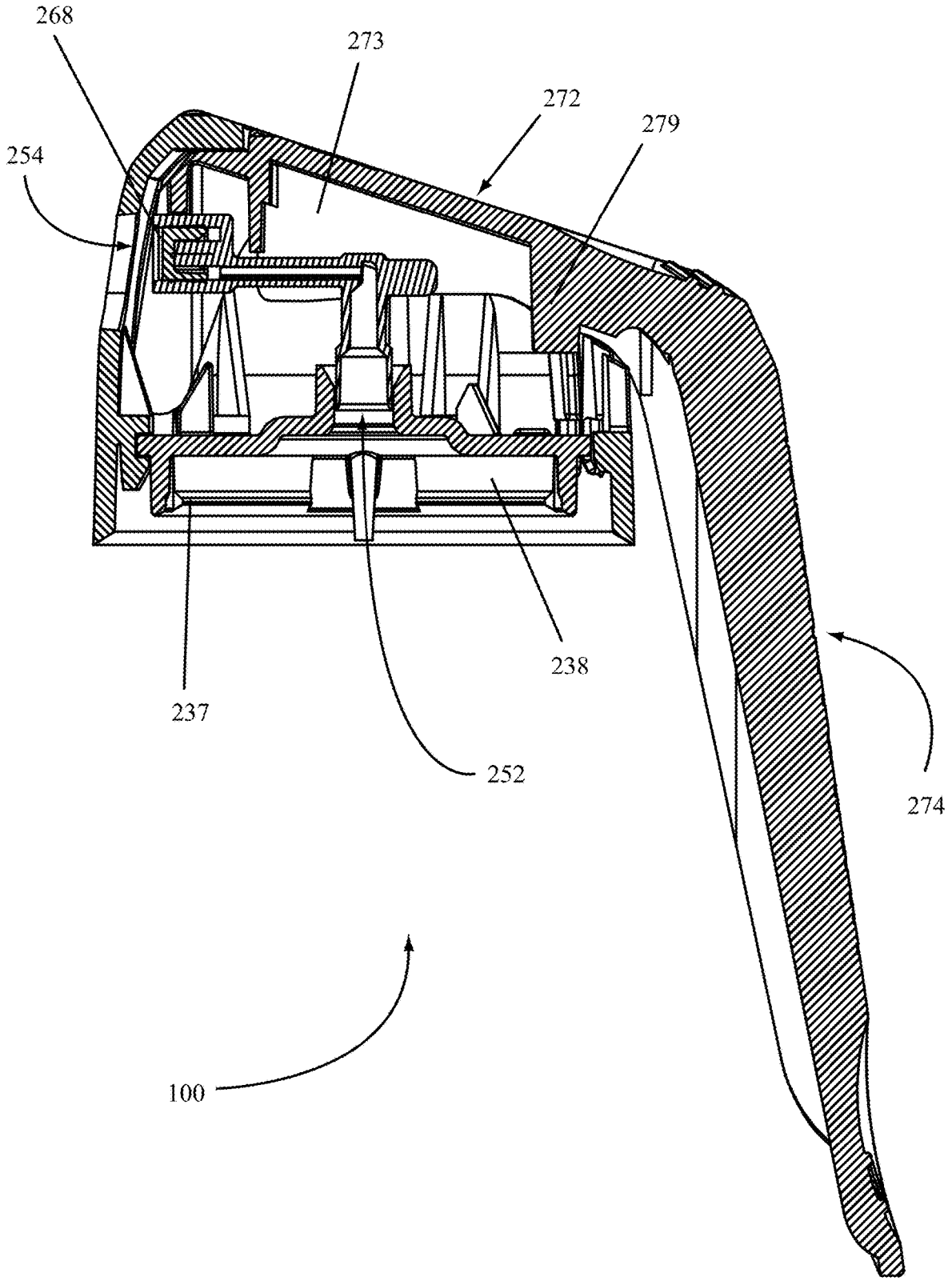
FIG. 33 illustrates a cross-sectional, side view of an aerosol actuator according to various embodiments of the invention.
Figure 34:
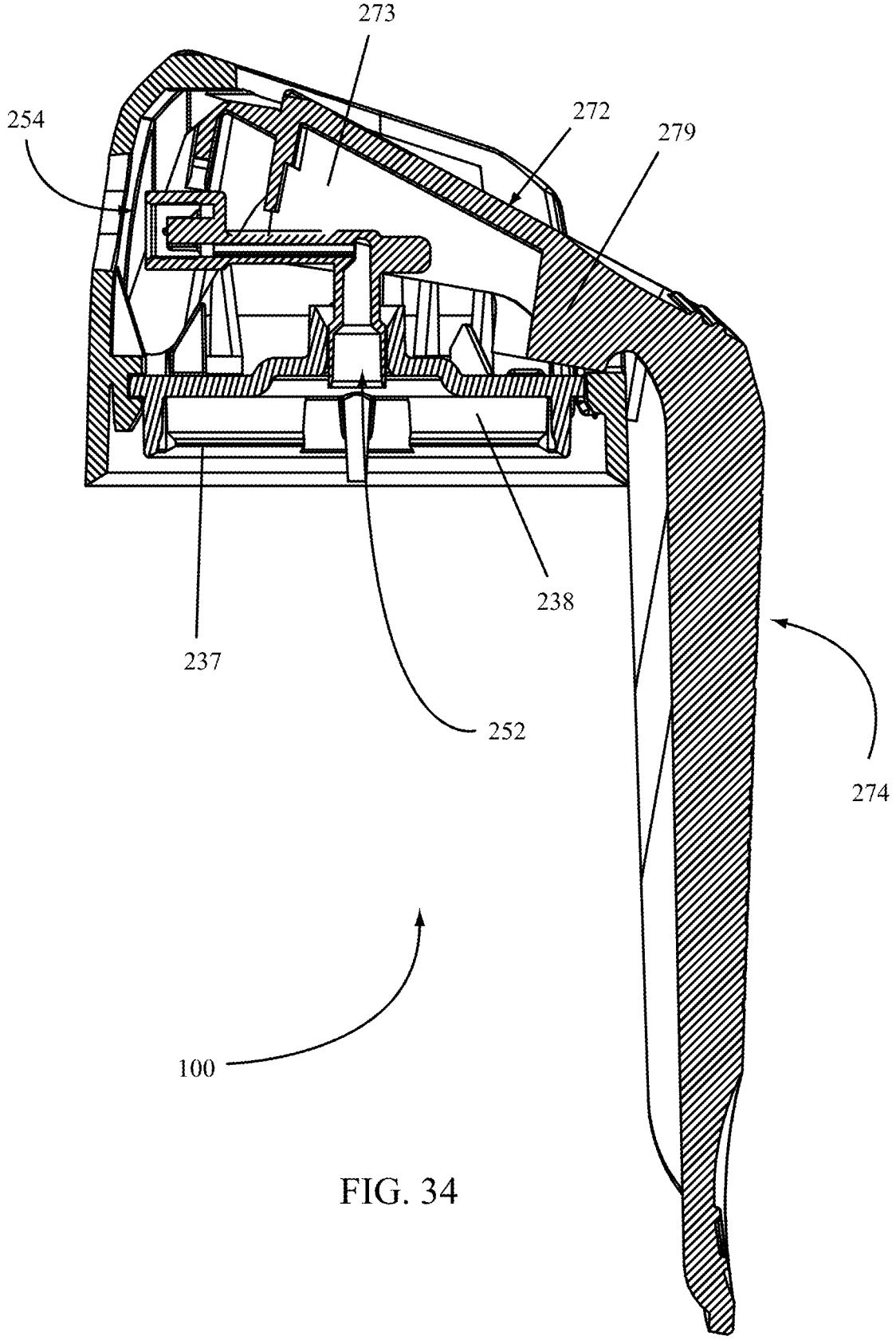
FIG. 34 illustrates a cross-sectional, side view of an aerosol actuator according to various embodiments of the invention.

Cross-sectional views of an aerosol actuator 100 according to various embodiments of the invention are illustrated in FIGS. 32 through 34. In FIG. 32, the aerosol actuator 100 is illustrated in a locked state. In FIG. 33, the aerosol actuator 100 is illustrated in an unlocked state. In FIG. 34, the aerosol actuator 100 is illustrated in an actuated state.

As illustrated in FIG. 32, an assembled aerosol actuator 100 includes a locking ring 230 snap-fit into a cap 210. A rim 236 of the locking ring 230 is snapped into one or more locking ring openings 218 in one or more locking ring supports 217. A trigger 270 is pivotably mounted with the cap 210 and a manifold 250 is positioned on an interior of the cap 210 between the locking ring 230 and the trigger 270 as illustrated. An inlet 252 portion of the manifold 250 may be seated in or through the manifold opening 232 and may be in contact with the walls of a manifold guide 233 of the locking ring 230. An outlet 154 portion of the manifold 254 may be aligned with a spray opening 213 in the cap 210. An orifice cup 268 may be seated in the manifold 250. The trigger 270 may be mounted to the cap 210 with one or more retention posts 275 snap-fitting to the cap 210 and one or more trigger posts 276 seated in one or more trigger mount grooves 216. A trigger actuation lock 279 on an underside of the trigger 270 may be in contact with a lock projection 234 on an upper surface of the locking ring 230. Interaction of the trigger actuation lock 279 with the lock projection 234 may prevent the actuation of the trigger 270 or movement thereof.

When assembled with a container 900, an aerosol actuator 100 such as that illustrated in FIG. 32 may be connected to the container 900 by one or more base snap structures 238 on the locking ring 230. One or more lips 237 on the base snap structures 238 may be fixed to a chime of an aerosol container 900 to retain the aerosol actuator 100 on the container 900. When connected to or assembled on a container 900, the cap 210, manifold 250 and trigger 270 of the aerosol actuator 100 may be rotated relative to the locking ring 230 such that the lock projection 234 and the trigger actuation lock 279 are no longer aligned or in contact. In such position, the aerosol actuator 100 is in an unlocked state.

An aerosol actuator 100 in an unlocked state according to various embodiments of the invention is illustrated in FIG. 33. As illustrated, the trigger 270 is not restricted from pivoting or moving by an interaction between the lock projection 234 and trigger actuation lock 279. Instead, it is free to move.

An example of an actuated aerosol actuator 100 according to various embodiments of the invention is illustrated in FIG. 34. During actuation, trigger 270 pivots or moves about one or more trigger posts 276 positioned in one or more trigger mount grooves 216 of the cap 210. Movement of the trigger 270 changes the position of the actuator wings 273 of the trigger 270, imparting a force on one or more actuator posts 253 of the manifold 250. The force imparted on the manifold 250 moves the manifold 250 downward such that valve seated in the valve seat 258 of the manifold is opened or actuated, allowing product to flow through the manifold 250 and out the outlet 254.

For example, the actuated aerosol actuator 100 illustrated in FIG. 34 may have been actuated by the application of a force against the button actuator 272. In other embodiments, application of a force against the lever actuator 274 may have been used to actuate the aerosol actuator 100. In still other embodiments of the invention, application of a force against both the button actuator 272 and the lever actuator 274 may be used to actuate an aerosol actuator 100 as illustrated.

Components of an aerosol actuator 100 according to various embodiments of the invention are illustrated in FIGS. 35 through 59.

Figure 35:
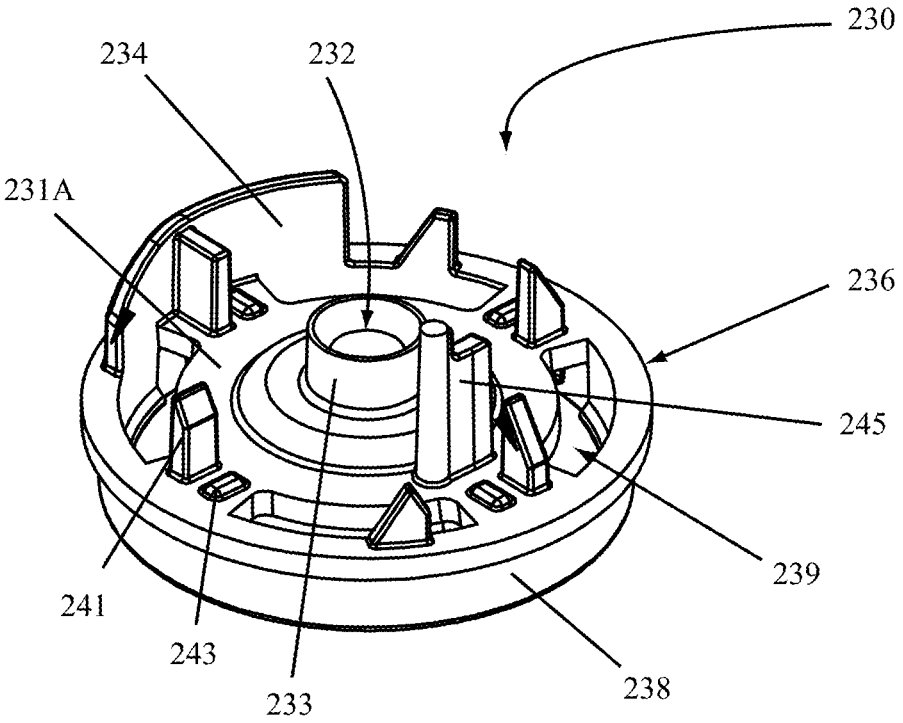
FIG. 35 illustrates a top-perspective view of a locking ring according to various embodiments of the invention.

According to certain embodiments of the invention, a locking ring 230 may be configured, or may include, one or more elements illustrated in FIGS. 35 through 38. For example, FIG. 35 illustrates a perspective view of a locking ring 230 according to some embodiments of the invention. The locking ring 230 may include a base 231 shaped like a disc having multiple projections extending therefrom or holes passing therethrough. For instance, a manifold guide 233 having a cylindrical shape may extend upward from a center of the locking ring 230. The manifold guide 233 may define a manifold opening 232 into which a portion of a manifold 250 may reside when assembled as an aerosol actuator 100. A lock projection 234 may also extend upwards and away from the base 231 of the locking ring 230. As illustrated in FIG. 35, a lock projection 234 may be configured as a wall or curved wall extending a fixed distance above the upper surface 231A of the locking ring 230.

One or more openings 239 may be located through the locking ring 230. In some embodiments the openings 239 may be included to reduce the weight of the locking ring 230. In still other embodiments, the openings 239 may be used as assembly guides, positioning guides, or for molding purposes. For example, the openings 239 illustrated in FIGS. 35 and 36 may allow the formation of one or more lips 237 on the base snap structures 238 during molding, which, in some cases, may simplify the molding process and reduce the overall cost to make the locking ring 230.

A rim 236 may be formed on an outer periphery of the locking ring 230 as illustrated in FIGS. 35 through 38. The rim 236 may be configured to mate with a cap 210 of an aerosol actuator 100 as desired.

Figure 36:
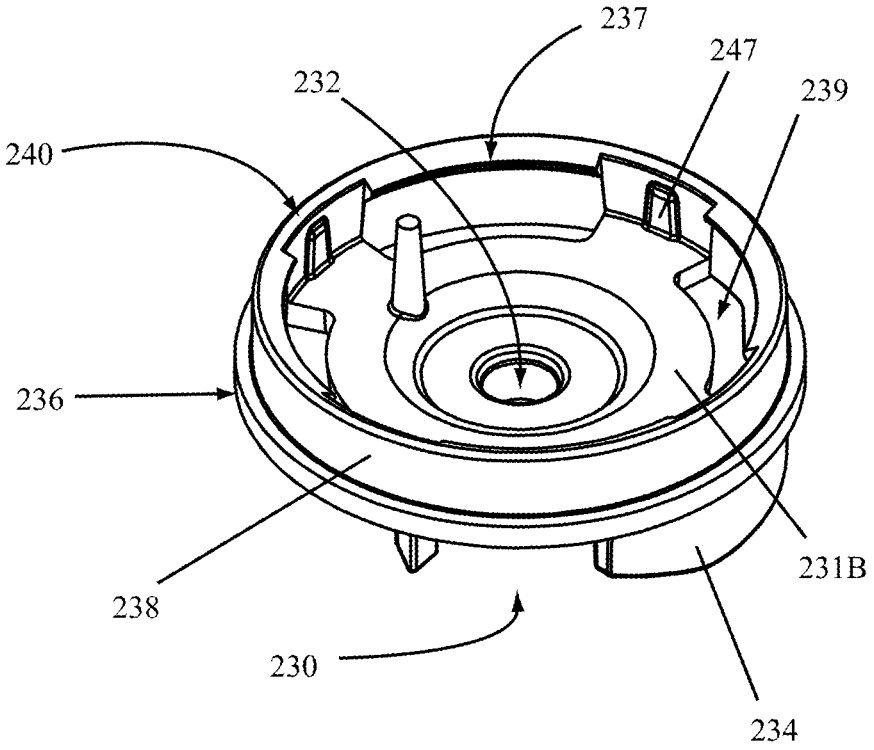
FIG. 36 illustrates a bottom-perspective view of a locking ring according to various embodiments of the invention.
Figure 37:
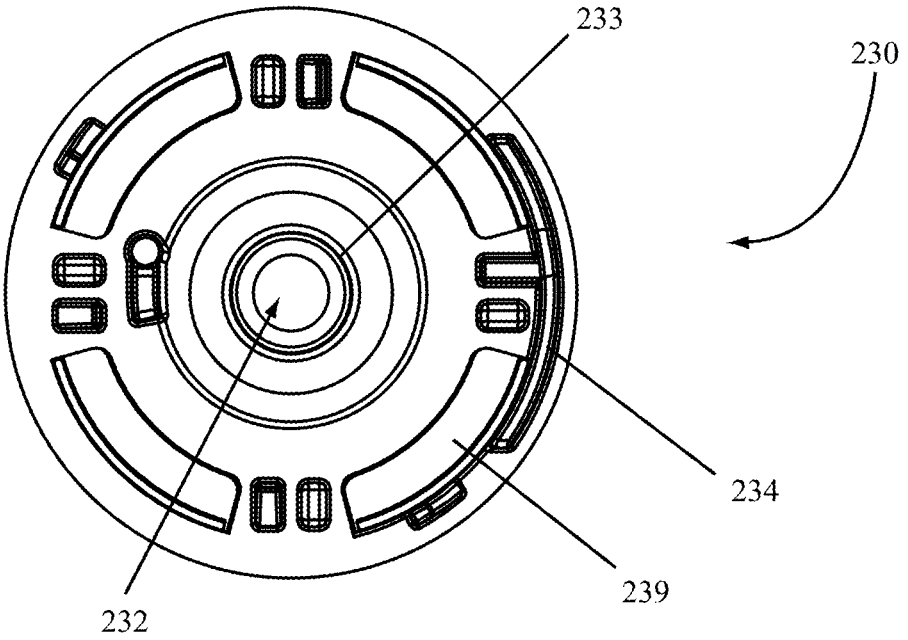
FIG. 37 illustrates a top view of a locking ring according to various embodiments of the invention.
Figure 38:
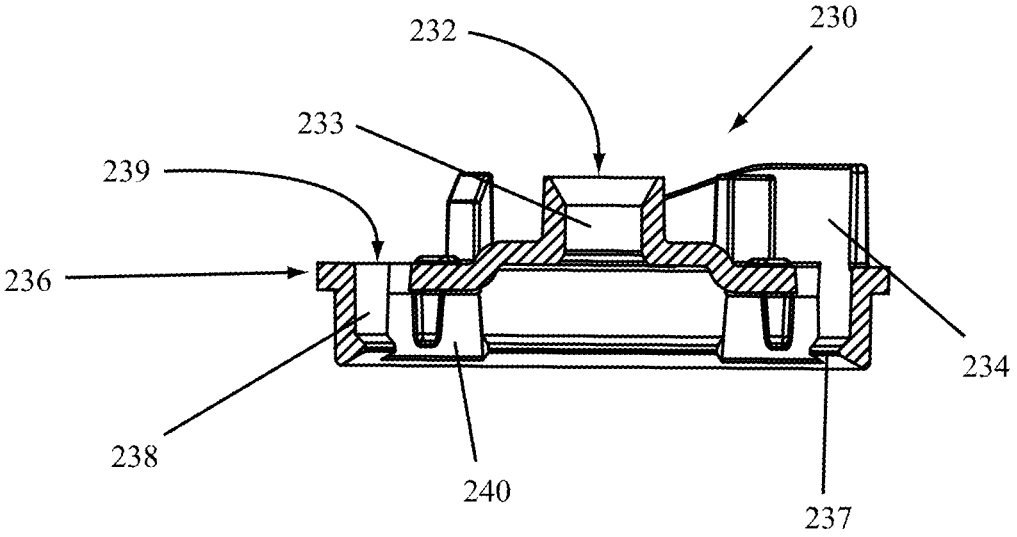
FIG. 38 illustrates a cross-sectional side view of a locking ring according to various embodiments of the invention.
Figure 39:
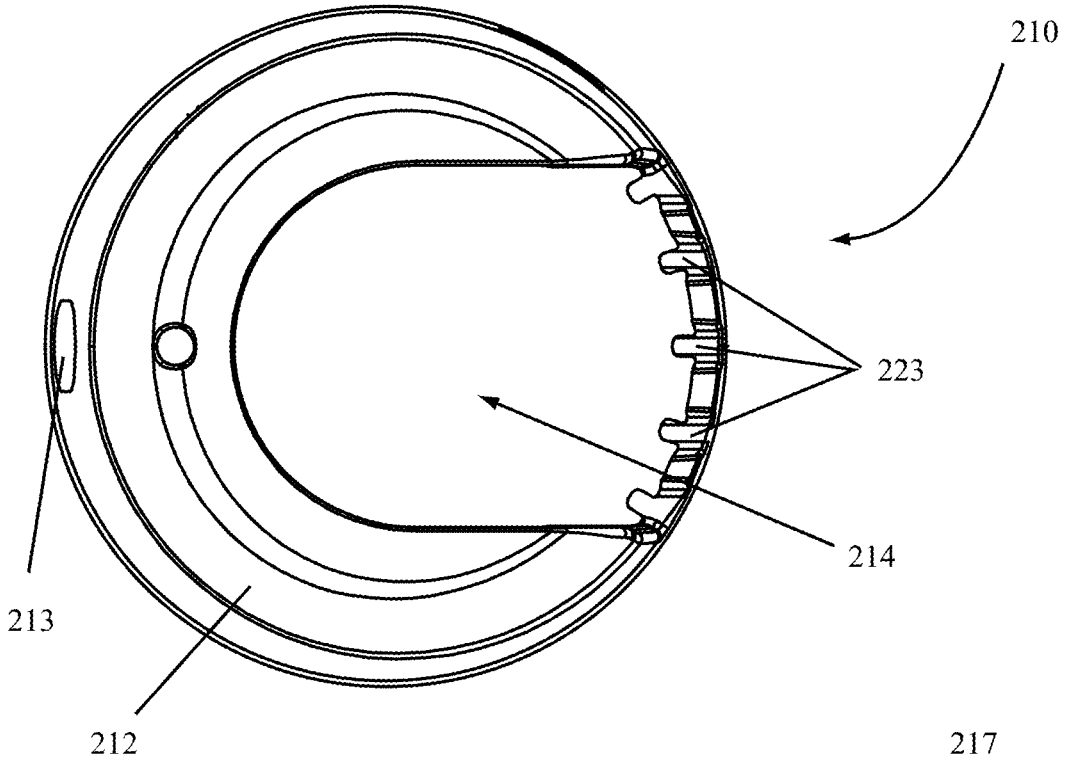
FIG. 39 illustrates a top view of a cap according to various embodiments of the invention.
Figure 40:
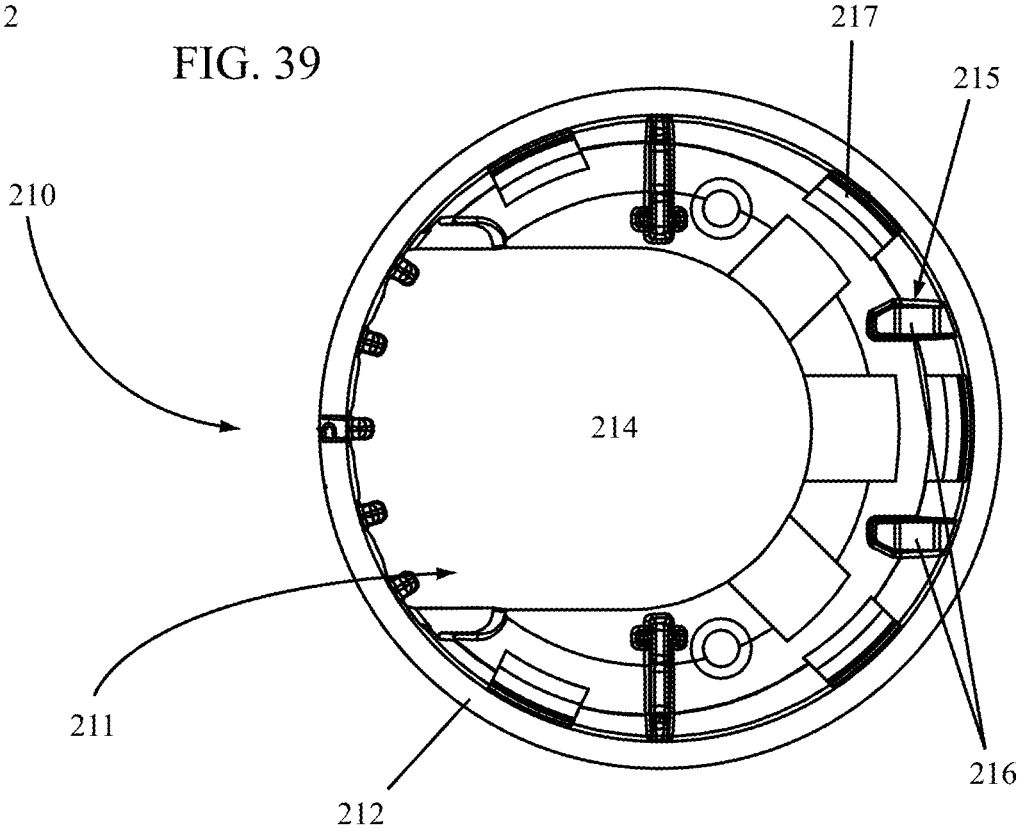
FIG. 40 illustrates a bottom view of a cap according to various embodiments of the invention.
Figure 41:
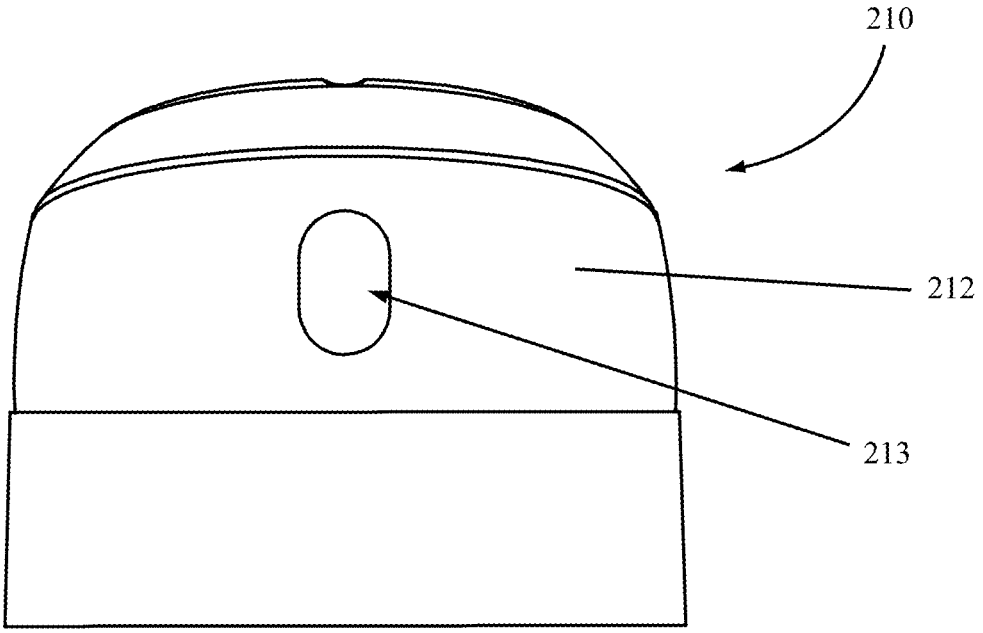
FIG. 41 illustrates a front view of a cap according to various embodiments of the invention.

One or more base snap structures 238 may extend off a lower surface 231B of the locking ring 230. As illustrated in FIG. 36, a base snap structure 238 may include a cylindrical shape extending away from the lower surface 231B of the locking ring 230. The base snap structure 238 may be continuous—or have a continuous outer wall—as illustrated in FIGS. 35 and 36, or may include gaps or spaces between multiple base snap structures 238. One or more lips 237 may project off of a portion of the base snap structures 238. A lip 237 may include one or more sloping surfaces. For example, as illustrated, a lip 237 may project from a terminal end of the base snap structure 238 towards a center of the locking ring 230. The lip 237 may be configured or shaped to include a sloping surface, such as a sloping surface towards the center of the locking ring 230 to the edge of the lip 237 and then toward an inner surface of the base snap structure 238 as illustrated in FIG. 38. The lips 237 may be configured to hold a locking ring 230 onto a chime of a container 900 or other feature integrated with a container 900 to allow an aerosol actuator 100 to be assembled to a container 900.

According to various embodiments of the invention, the one or more base snap structures 238 may include one or more thin portions or gaps 240 positioned therein. For example, as illustrated in FIG. 36, the base snap structure 238 includes four gaps 240 positioned about a perimeter of the base snap structure 238. At the location of each gap 240, the lip 237 is reduced in some embodiments or non-existent in others. The inclusion of the one or more gaps 240 allows the base snap structure 238 to flex during assembly of an aerosol actuator 100 to a container 900. The thin portions or gaps 240 also allow for the use of a continuous base snap structure 238 which may improve the hoop strength of the locking ring 230.

According to certain embodiments of the invention, gaps 240 may also include features, such as protrusions or guides, to assist with the assembly of an aerosol actuator 100 to a container 900 or to assist in the retention of an aerosol actuator 100 on a container 900. For example, as illustrated in FIG. 36, a torque rib 247 may be positioned on an interior surface of the base snap structure 238 in the gap 240 area. Torque ribs 247 may be configured or sized to achieve a desired grip or retention force for an aerosol actuator 100 on a container 900.

According to various embodiments of the invention, a locking ring 230 may also include one or more projections or stop 241 features that extend or project from an upper surface 231A or lower surface 231B of the locking ring 230. The one or more projections or stop 241 features may be configured to interact with parts of a cap 210 to limit the rotation of a cap 210 about the locking ring 230 to a defined or desired arc or range of motion. For instance, while it may be desirable to rotate a cap 210 about a locking ring 230 to put the aerosol actuator 100 in an unlocked state, it may not be desirable to allow such rotation to be greater than forty-five degrees or some other angle. In order to control the range of motion or rotation, a locking ring 230 may include a projection or stop 241 that interacts with a corresponding projection or stop on a cap 210 to restrict the range of motion or rotation of the cap 210 about the locking ring 230.

A locking ring 230 according to various embodiments of the invention may also include one or more click ridges 243 on a surface thereof and configured to interact with one or more projections or features of a cap 210 to create an audible noise or "click." For example, the locking ring 230 illustrated in FIG. 35 includes four click ridges 243 which may interact with a cap 210 as a cap 210 is rotated relative to the locking ring 230. Features on the cap 210 may interact with the click ridges 243 to create an audible "click" or noise when the cap 210 is rotated into or out of a locked or unlocked position relative to the locking ring 230.

According to various embodiments of the invention, a locking ring 230 may also include one or more manifold supports 245 projecting from a surface of the locking ring 230. As illustrated in FIG. 35, the manifold support 245 includes a cone-shaped portion which formed at a gate during molding and a rectangular manifold support upon which the manifold 250 may rest during assembly and use of the aerosol actuator 100. While a particularly shaped manifold support 245 is illustrated in FIG. 35, it is understood that any shape may be used as desired.

A cap 210 according to various embodiments of the invention is illustrated in FIGS. 39 through 46. While a cap 210 having a particular aesthetic is illustrated, it is understood that caps 210 having other aesthetics may be utilized with the various embodiments of the invention.

As illustrated, a cap 210 may include a structure defining an interior space, the structure having one or more openings therethrough. For example, as illustrated in FIGS. 39 through 45, a cap 210 may include a generally cylindrical shaped wall 212 rising from a cap base having a cap base opening 211 to an upper or top surface as illustrated. The wall 212 may be continuous such that the wall 212 defines an interior space open to and in communication with the cap base opening 211. One or more additional openings may be included in the wall 212. For example, a spray opening 213 through the wall 212 may be positioned in a front portion of the cap 210. A trigger opening 214 may be positioned in the wall 212 to accommodate a trigger 270 according to various embodiments of the invention.

A cap 210 may include one or more trigger supports 215 as illustrated in FIGS. 40, 42, and 44 through 46. According to various embodiments of the invention, one or more trigger supports 215 may extend from an interior surface of a cap 210 into an interior space within the cap 210. The one or more trigger supports 215 may include one or more trigger mount grooves 216 configured to accept or mate with a trigger post 276 of a trigger 270. Fitment of one or more trigger posts 276 into the one or more trigger mount grooves 216 may allow rotation or pivoting of the trigger 270 about an axis defined by the one or more trigger posts 276. For instance, a cap 210 may include two trigger supports 215 as illustrated in FIGS. 40, 42, and 44 through 46. Each of the trigger supports 215 may extend from an interior portion of the wall 212 into an interior of the cap 210. At a bottom portion of the trigger supports 215—or that portion nearest the cap base opening 211, each trigger support 215 includes a trigger mount groove 216 configured to accept a trigger post 276. While the trigger mount grooves 216 of the cap 210 extend completely through the trigger supports 215 forming a general "U" shape—the trigger mount grooves 216 may also be formed only partially through the trigger supports 215 or configured in another manner to support, mate with, or retain trigger posts 276 of a trigger 270. In addition, while the illustrated trigger mount grooves 216 have an opening nearest the cap base opening 211, the grooves could be reversed to accept a trigger post 276 from the other direction.

Figure 46:
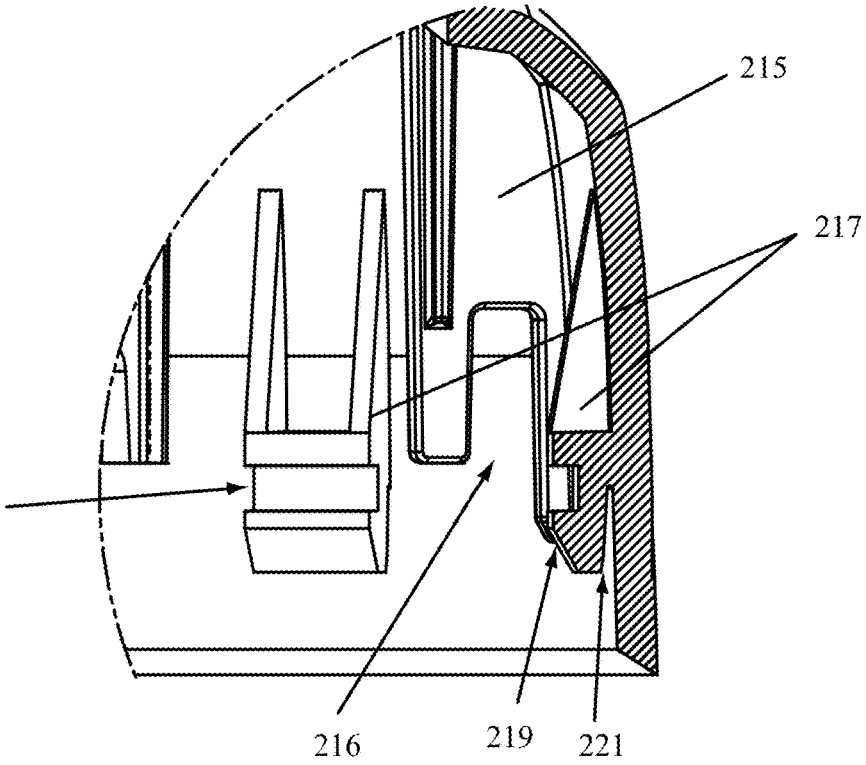
FIG. 46 illustrates a cross-sectional, blown-up view of a locking ring support of a cap according to various embodiments of the invention.

A cap 210 may also include one or more locking ring supports 217 as illustrated in FIGS. 40 and 44 through 46. As illustrated, a locking ring support 217 may extend from an interior surface of the cap 210. A locking ring support 217 may be molded with the cap 210 and may include a locking ring opening 218 and a tapered locking ring assembly surface 219. The tapered locking ring assembly surface 219 may be adjacent an end of the locking ring support 217. A space or gap 221 may be positioned behind the tapered locking ring assembly surface 219 and locking ring opening 218 portions of the locking ring support 217 as illustrated in FIG. 46. The positioning and size of the gap 221, including the location of the gap 221, may be designed or selected to provide a desired flex to the locking ring support 217. The presence of the gap 221 allows that portion of the locking ring support 217 around the gap 221 to flex as the cap 210 is assembled to a locking ring 230. For example, as the rim 236 of a locking ring 230 is pushed onto or into a cap 210, the rim 236 engages with the tapered locking ring assembly surfaces 219, applying a force on those surfaces. The force applied causes a portion of the locking ring support 217 to flex to allow the rim 236 to pass into or snap into the locking ring opening 218. The flexing portion of the locking ring support 217 may then return to its original position and the rim 236 of the locking ring 230 will be seated in the locking ring opening 218 such that the cap 210 is assembled with the locking ring 230.

A cap 210 according to certain embodiments of the invention may also include one or more spacers 223 in the wall 212 as illustrated in FIGS. 39, 42, 44, and 45. The spacers 223 in the wall 212 of the illustrated cap 210 may be configured or shaped as desired. In this particular embodiment, the spacers 223 are configured to allow support ribs on the underside of a trigger 270 to pass into the gaps between the spacers 223 during actuation of the aerosol actuator 100. The presence of the spacers 223 helps fill up the space between the cap 210 and the trigger 270 where the trigger 270 is required to move. By filling up the space between a lower surface of the trigger 270 and the cap 210 in a non-actuated state, it may be more aesthetically pleasing to a consumer or user.

Figure 42:
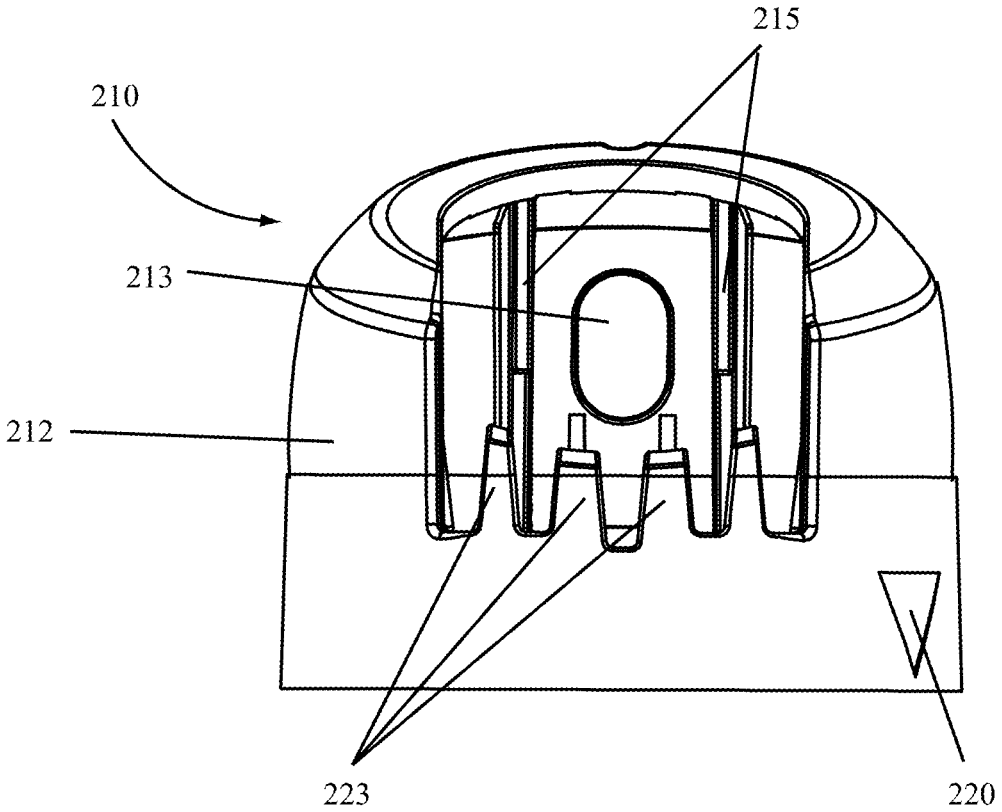
FIG. 42 illustrates a rear view of a cap according to various embodiments of the invention.
Figure 43:
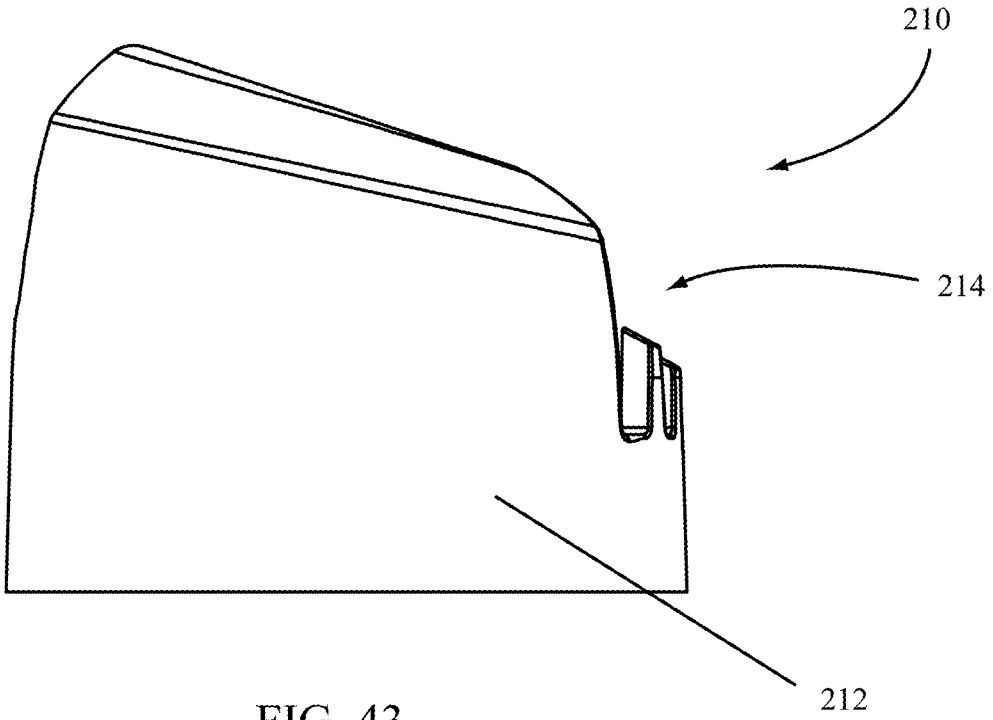
FIG. 43 illustrates a side view of a cap according to various embodiments of the invention.
Figure 44:
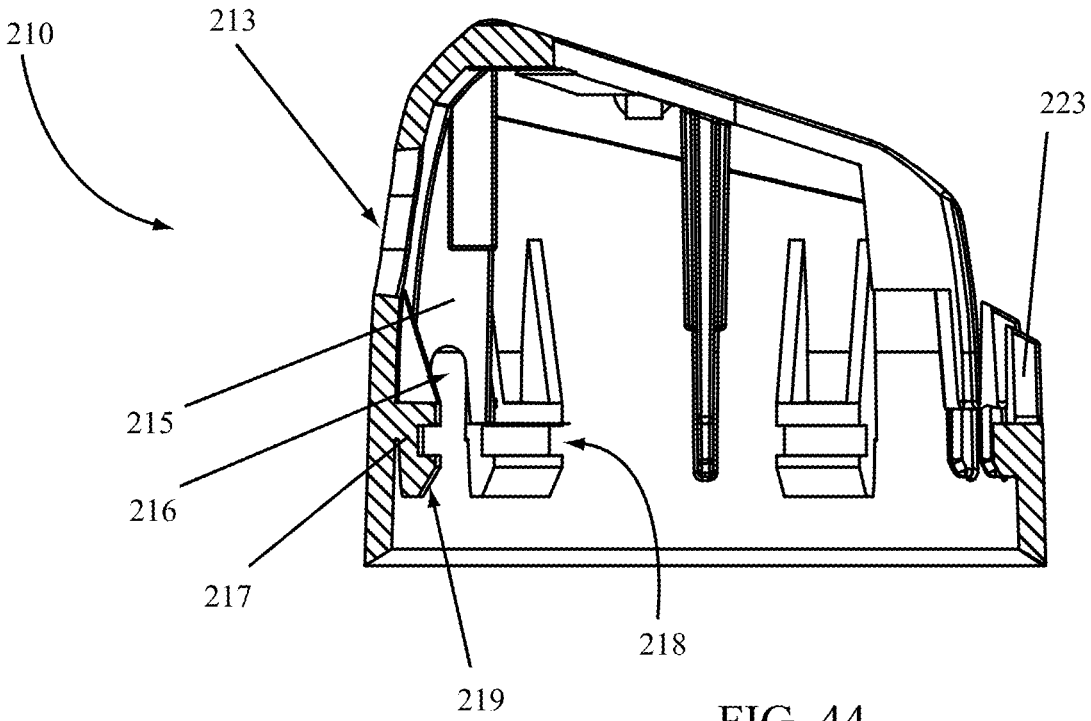
FIG. 44 illustrates a cross-sectional side view of a cap according to various embodiments of the invention.
Figure 45:
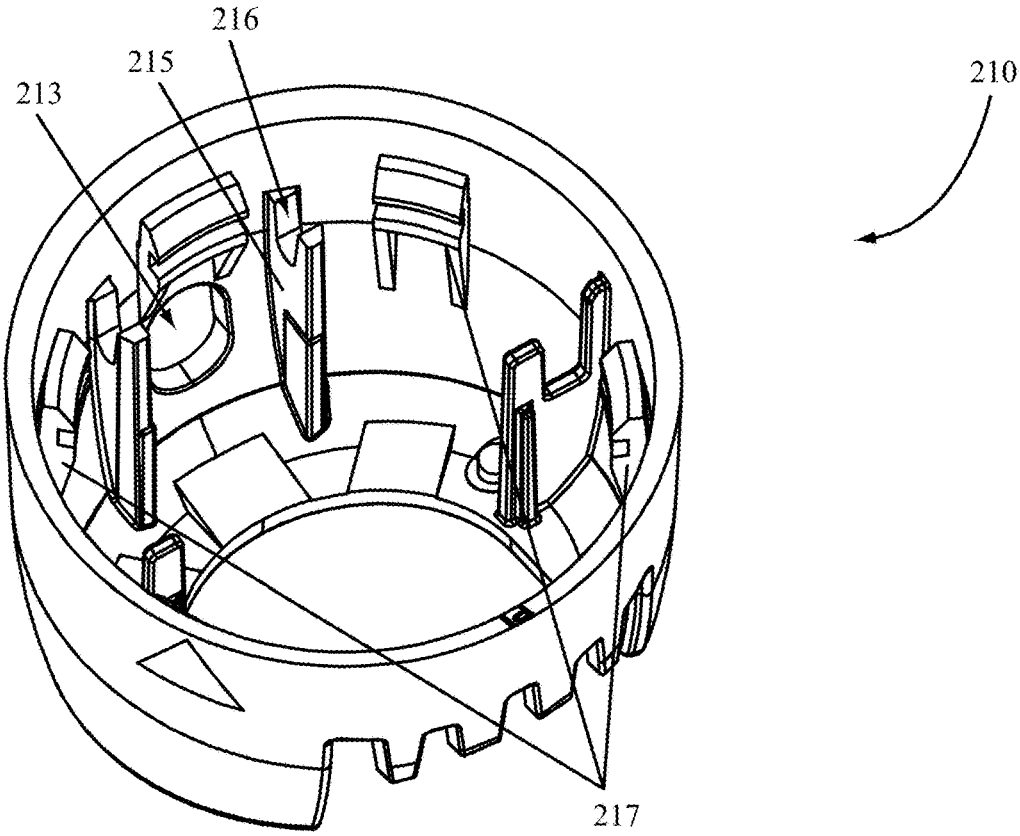
FIG. 45 illustrates a bottom, perspective view of a cap according to various embodiments of the invention.

According to various embodiments of the invention, a cap 210 may include one or more identifying indicia 220. For example, as illustrated in FIG. 42, a cap 210 may have an arrowhead shape recessed or protruding from an exterior surface of the cap 210 wall 212. The arrowhead indicia 220 may correspond to other indicia on a container 900 to facilitate an understanding of the state of an aerosol actuator 100. For instance, a container 900 may include two indicia—a picture of a locked lock and a picture of an unlocked lock. The indicia 220 on the cap 210 may point to the locked lock when the aerosol actuator 100 is in a locked state and may point to the unlocked lock when the aerosol actuator 100 is in an unlocked state. While particular indicia 220 are illustrated, it is understood that other indicia 220 or multiple indicia 220 may be included on a cap 210 and container 900 to demonstrate operation, a state of the aerosol actuator 100, or to help a user interact with the aerosol actuator 100.

A manifold 250 according to various embodiments of the invention is illustrated in FIGS. 47 through 53. As illustrated, a manifold 250 may include an inlet 252 and an outlet 254 having a flow path 251 therebetween. The flow path 251 may provide a pathway for a product to pass from the inlet 252 to the outlet 254 and out of the manifold 250. A manifold 250 may be a single molded part with the flow path 251 defined by an interior passageway through the part.

At an inlet 252, a valve seat 158 may be defined. The valve seat 258 may be configured to mate with or accept a valve attached to a container 900. For instance, the valve seat 258 may connect to or mate with a valve or valve stem of a conventional aerosol container 900. At an outlet 254, an orifice cup seat 259 may be defined. The orifice cup seat 259 may be adjacent an orifice post 255. An orifice cup 268 may be inserted into the orifice cup seat 259 to produce a desired spray pattern.

Figure 47:
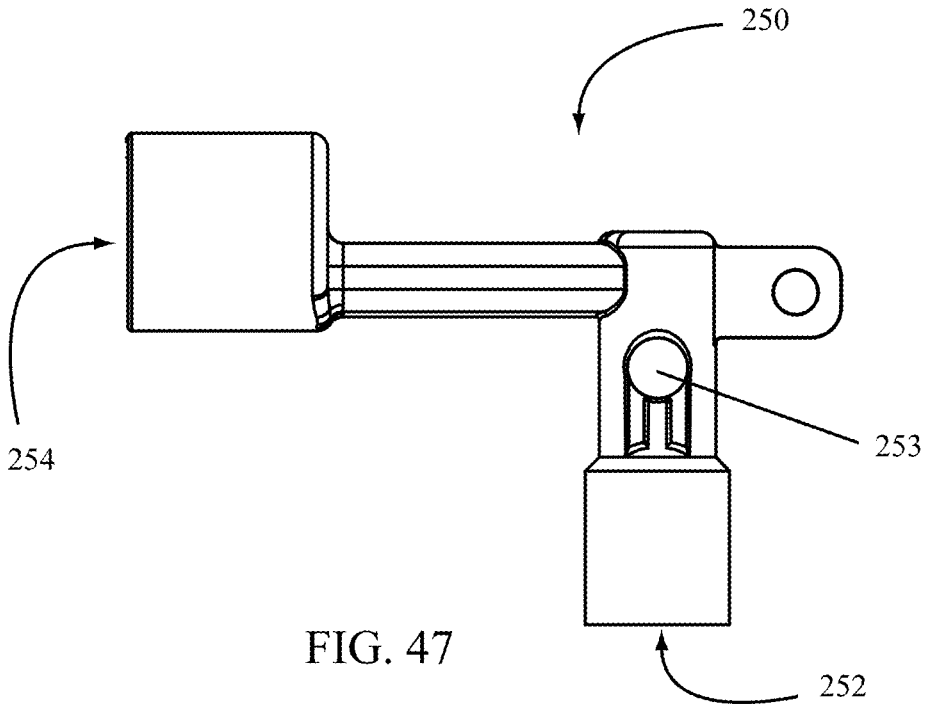
FIG. 47 illustrates a side view of a manifold according to various embodiments of the invention.

A side view of a manifold 250 according to various embodiments of the invention is illustrated in FIG. 47. As illustrated, a manifold 250 may include an inlet 252 and an outlet 254. The inlet 252 may be any shape and may be configured to mate with or communicate with a valve on a container 900, such as a conventional aerosol valve. As illustrated, the inlet 252 may include a circular opening having a diameter selected to allow fitment of a valve therein. The inlet 252 may open into a valve seat 258 which may or may not be tapered. The valve seat 258 may be configured to mate with or accept a valve therein. In some embodiments, the valve seat 258 may be shaped or configured to snuggly mate with a valve such that no leakage will occur when the valve and manifold 250 are mated together. In further embodiments, the valve, manifold 250 or both valve and manifold 250 may include ridges, detents, or other features to improve a seal between a valve and the valve seat 258 of the manifold 250.

Figure 52:
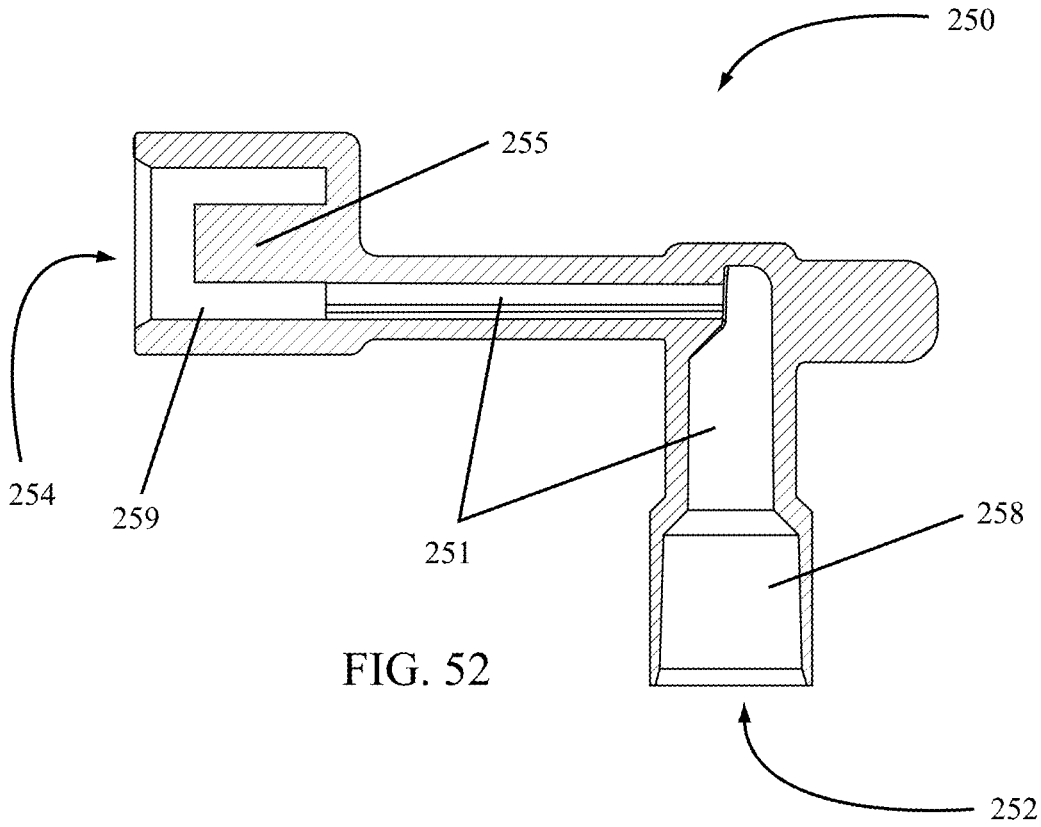
FIG. 52 illustrates a cross-sectional side view of a manifold according to various embodiments of the invention.

A flow path 251 is in communication with the valve seat 258 and is configured to direct or carry a product released by a valve seated in the valve seat 258 to the outlet 254 of the manifold 250. While an exemplary flow path 251 is illustrated in FIG. 52, it is understood that the geometries, shape, and path of the flow path 251 may vary or be designed as needed for specific applications. For example, in FIG. 52, the flow path 251 narrows from the valve seat 258 into a vertical passageway. A narrower horizontal passageway in communication with the vertical passageway extends the flow path 251 towards an orifice cup seat 259 and the outlet 254. Product flowing through the manifold 250 would exit a valve seated in the valve seat 258, follow the flow path 251 through the manifold 250 to the orifice cup seat 259 and out the outlet 254 of the manifold 250.

Figure 48:
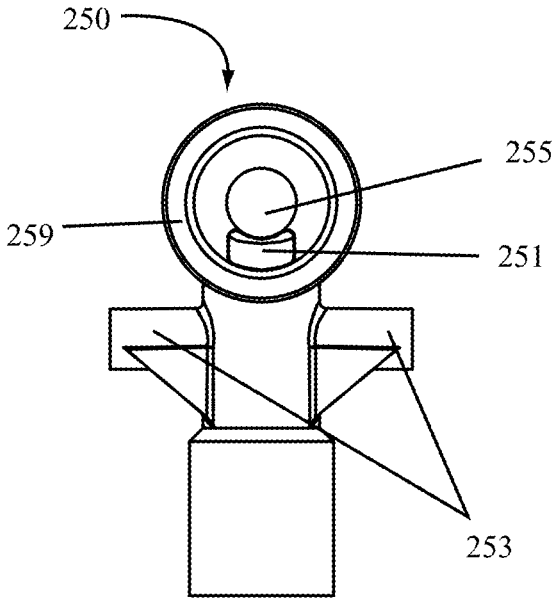
FIG. 48 illustrates a front view of a manifold according to various embodiments of the invention.
Figure 49:
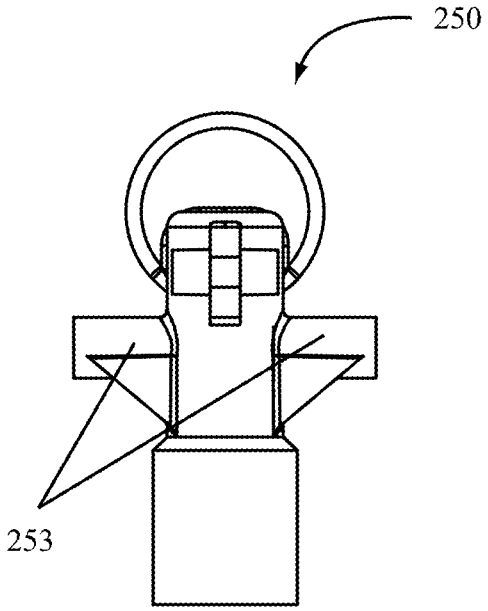
FIG. 49 illustrates a rear view of a manifold according to various embodiments of the invention.
Figure 50:
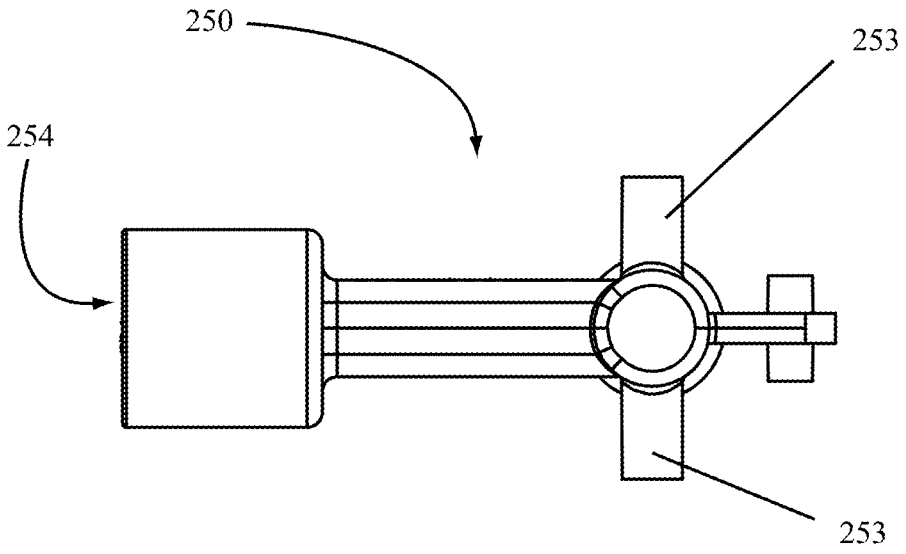
FIG. 50 illustrates a top view of a manifold according to various embodiments of the invention.
Figure 51:
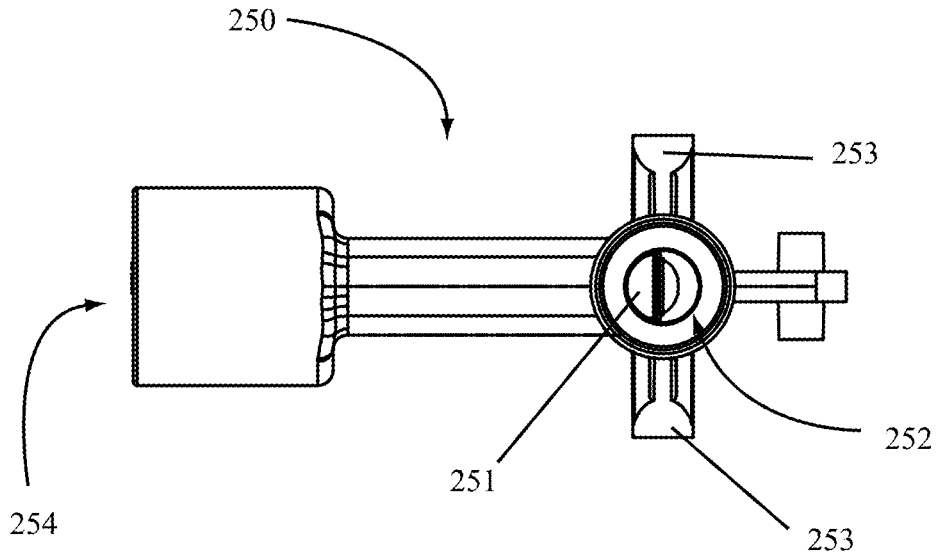
FIG. 51 illustrates a bottom view of a manifold according to various embodiments of the invention.
Figure 53:
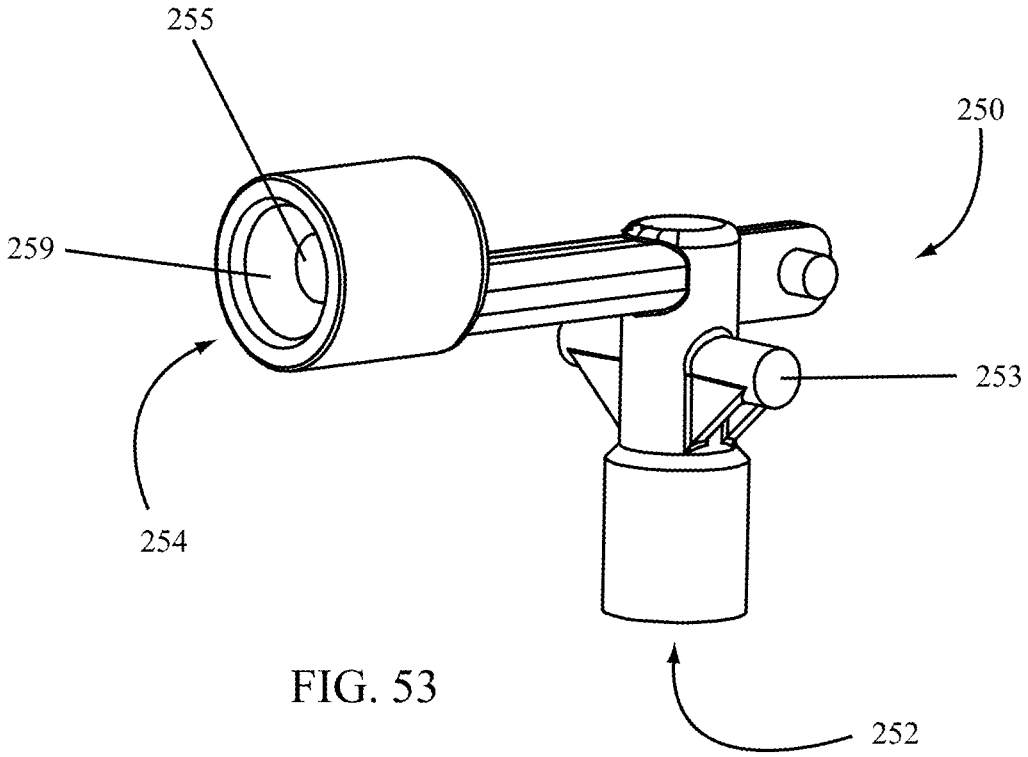
FIG. 53 illustrates a front, perspective view of a manifold according to various embodiments of the invention.

According to various embodiments of the invention, the manifold 250 may include an orifice cup seat 259 configured to retain conventional orifice cups. An orifice post 255 may be centered or otherwise positioned in a portion of the orifice cup seat 259 and may be configured to work with an orifice cup to provide spray characteristics to a product passing through the manifold 250. For example, in various embodiments of the invention, an orifice post 255 may be molded with the manifold 250 and positioned in the center of the orifice cup seat 259 as illustrated in FIGS. 48 and 53. The orifice post 255 may interact with an orifice cup 268 inserted in the orifice cup seat 259. For example, an orifice cup 268 may be inserted into the orifice cup seat 259 of the manifold 250 during assembly of an aerosol actuator 100. The shape, size, and configuration of the orifice post 255 may be designed to interact with an orifice cup 268 to provide a desired set of spray characteristics to a product passing through the manifold 250. The shape, size, and configuration of an orifice cup 268 may also be changed to match—or work with—the orifice post 255 to provide desired spin mechanics to a fluid or product being propelled through the manifold 250.

A manifold 250 according to certain embodiments of the invention may also include one or more actuator posts 253 as illustrated. In certain embodiments, a manifold 250 may include two actuator posts 253 extending off of and away from a body portion of the manifold 250. For example, two actuator posts 253 may be on opposite sides of that portion of a manifold 250 body defining the vertical portion of the flow path 251 as illustrated. Each of the actuator posts 253 may extend away from the manifold 250 body. The actuator posts 253 may be molded with the manifold 250 and may be configured to bear a certain amount of force. In some embodiments, the actuator posts 253 may include additional support structures or features to ensure that repetitive application of force to the top portion or side portions of the actuator posts 253 does not deflect or otherwise alter the positioning of the actuator posts 253 relative to the manifold 250 body.

A trigger 270 according to various embodiments of the invention is illustrated in FIGS. 54 through 59 and may include a button actuator 272, a lever actuator 274 extending off of or from the button actuator 272, one or more pivot supports 277, one or more actuator wings 273, one or more retention posts 275, and a trigger actuation lock 279. A trigger 270 may also include one or more trigger ribs 271 providing support to the lever actuator 274.

Figure 54:
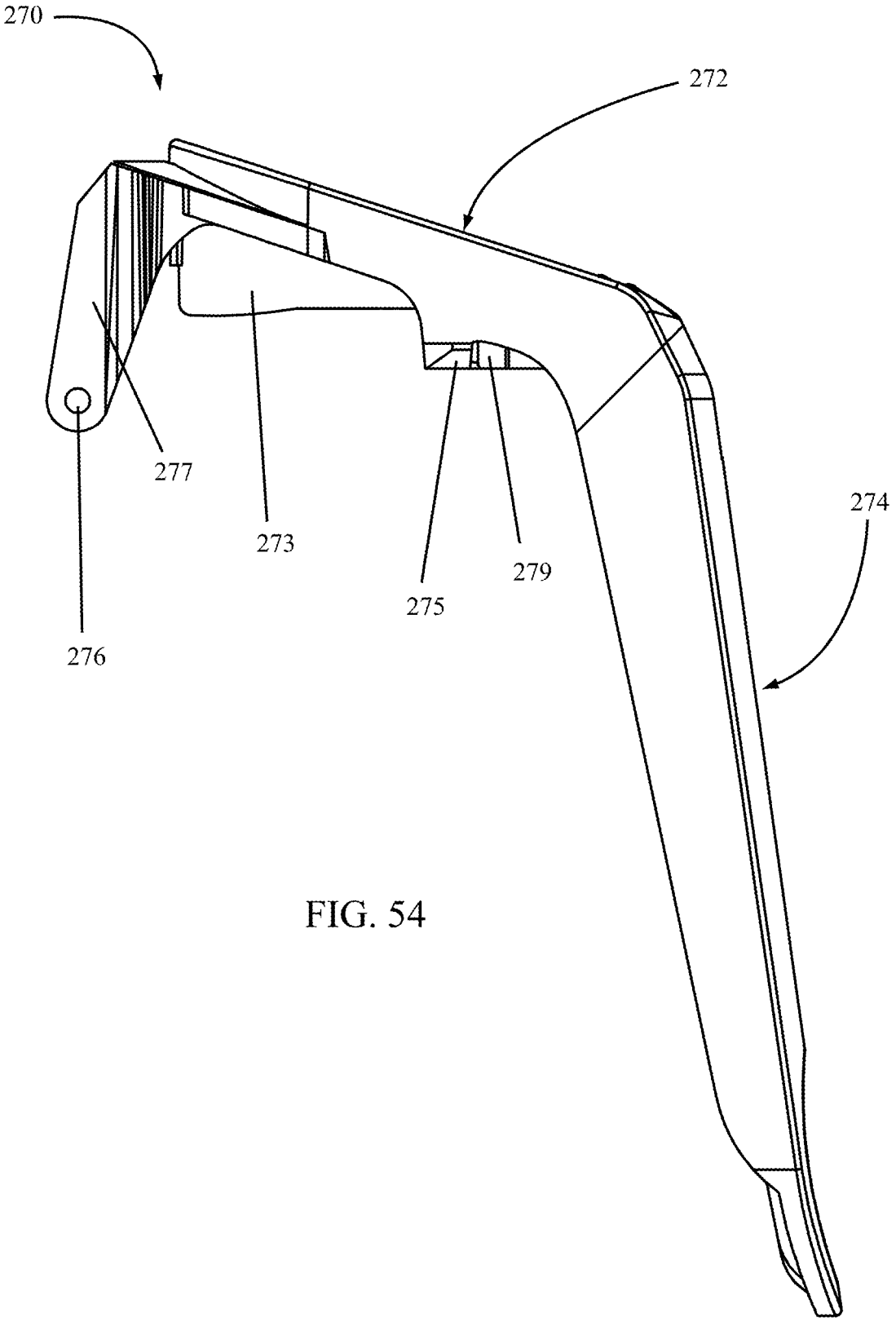
FIG. 54 illustrates a side view of a trigger according to various embodiments of the invention.
Figure 55:
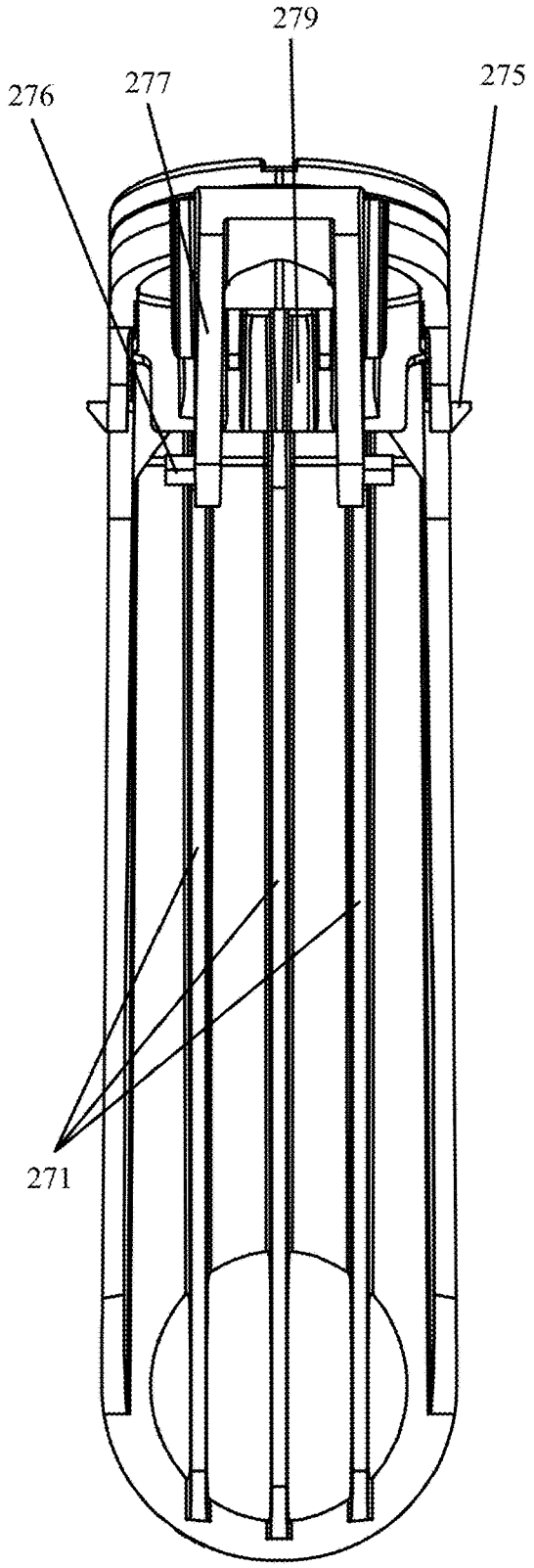
FIG. 55 illustrates a front view of a trigger according to various embodiments of the invention.

A trigger 270 according to various embodiments of the invention is illustrated in FIG. 54. A trigger 270 may include a top button actuator 272 having a horizontal or sloping surface sloping towards a lever actuator 274. As illustrated in FIG. 54, the top surface of the trigger 270 is a button actuator 272 which slopes to a hard angle where it joins the lever actuator 274 which has a greater downward slope than the button actuator 272. In some embodiments, the length of the button actuator 272 may be shorter than the length of the lever actuator 274 as illustrated in FIG. 54.

One or more pivot supports 277 may extend off of the trigger 270. A pivot support 277 may include one or more features for mating with another part or component of an aerosol actuator 100. For instance, each pivot support 277 may include a trigger post 276 extending outwards from the pivot support 277. The one or more trigger posts 276 may be configured or shaped to fit with or mate with one or more trigger mount grooves 216 of a cap 210. When positioned in the one or more trigger mount grooves 216, the trigger 270 may pivot about the one or more trigger posts 276 relative to the cap 210.

While various embodiments of the invention include one or more trigger posts 276 configured to mate or fit in one or more trigger mount grooves 216 of a cap 210 as illustrated, it is understood that a cap 210 may include posts and the trigger 270 include grooves to moveably secure a trigger 270 to a cap 210 such that the trigger 270 may rotate or pivot about the trigger posts 276.

Triggers 270 according to various embodiments of the invention may also include one or more actuator wings 273. The one or more actuator wings 273 may extend downwards from an underside of the trigger 270 and may be configured to engage or interact with one or more actuator posts 253 of a manifold 250. For example, the trigger 270 illustrated in FIGS. 55, 57, and 58 includes two actuator wings 273 extending downward from an underside of the trigger 270. Each actuator wing 273 extends from a front portion of the trigger 270 back to the trigger actuation lock 279. According to various embodiments of the invention, each of the actuator wings 273 may have a wave-like shape configured to apply an actuating force to a manifold 250 when either the button actuator 272 or lever actuator 274 are actuated.

In some embodiments of the invention, a trigger 270 may also include one or more retention posts 275. For example, a trigger 270 may include two retention posts 275 extending downward from an underside of the trigger 270. In the illustrated embodiments, each retention post 275 is positioned next to or as a part of the outer edges of the trigger actuation lock 279. It is understood, however, that retention posts 275 may be located anywhere on the underside of the trigger 270 as desired. Each retention post 275 may include a sloping or tapered surface and projection away from the trigger 270. When assembled as part of an aerosol actuator 100, each retention post 275 may snap into or past a surface on a cap 210 during the assembly process. Once assembled with a cap 210, the retention posts 275 may prevent the trigger 270 from being easily disassembled from the aerosol actuator 100.

A trigger actuation lock 279 according to certain embodiments of the invention may include a projection off of an underside of a trigger 270. The trigger actuation lock 279 may be configured such that it may interact with, contact, or otherwise engage a lock projection 234 on a locking ring 230. When engaged, a lock projection 234 and trigger actuation lock 279 may prevent the trigger 270 from being actuated or prevent the trigger 270 from rotating about the one or more trigger posts 276. While the particular trigger actuation lock 279 illustrated spans the width of the trigger 270, it is understood that a trigger actuation lock 279 may be shaped or configured as desired.

Figure 56:
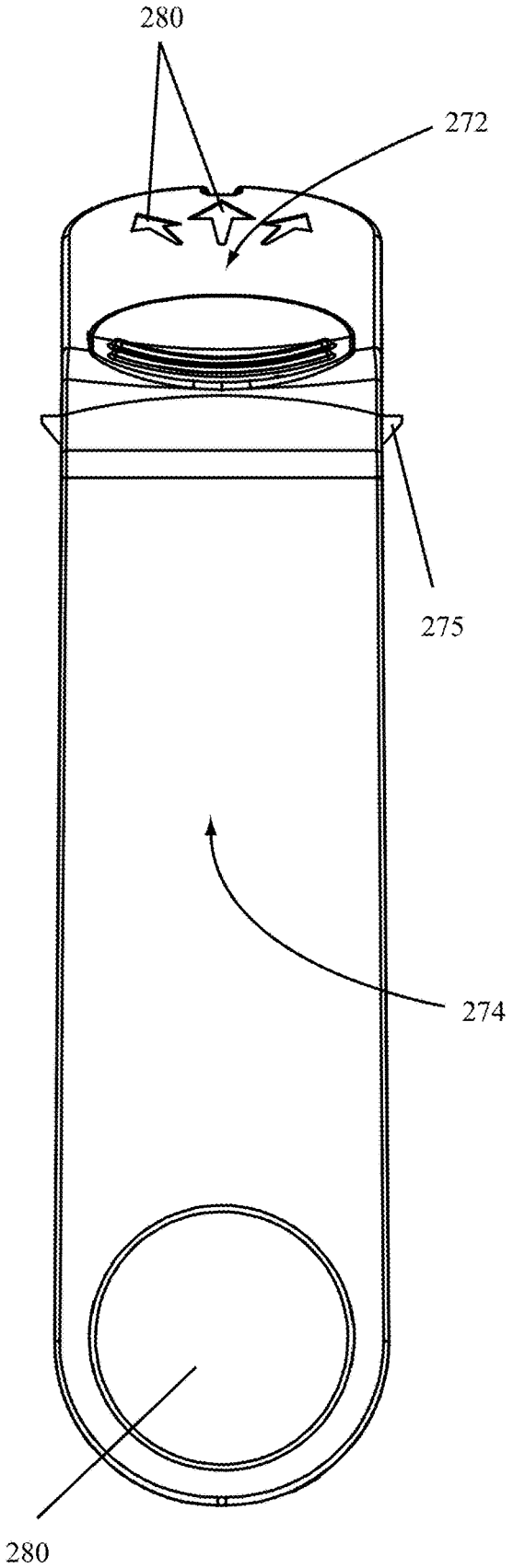
FIG. 56 illustrates a rear view of a trigger according to various embodiments of the invention.
Figure 57:
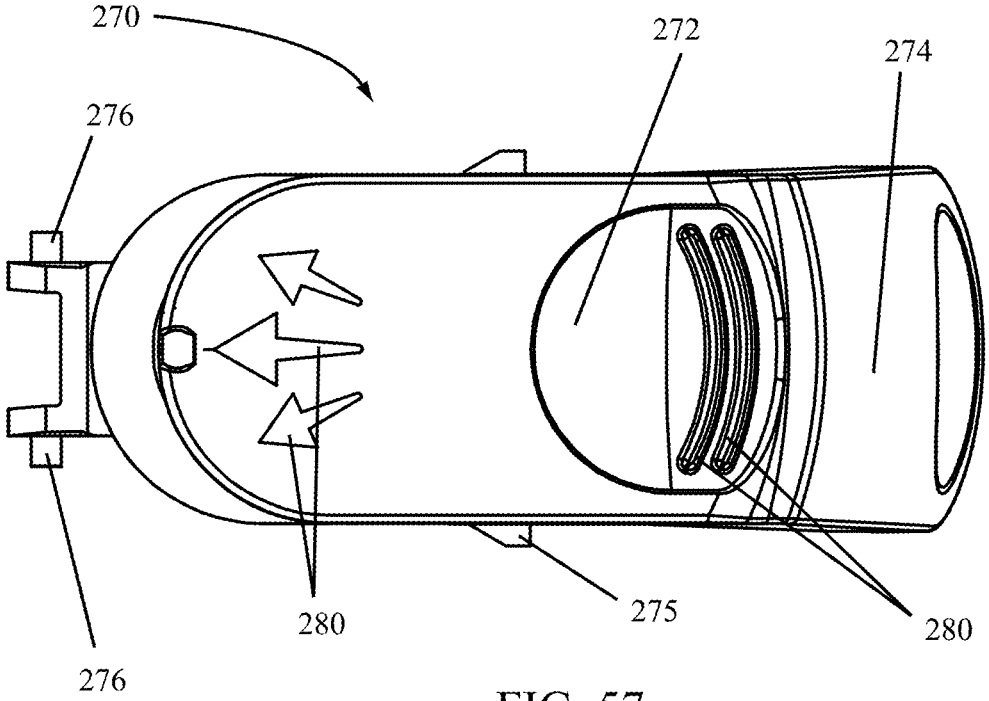
FIG. 57 illustrates a top view of a trigger according to various embodiments of the invention.
Figure 58:
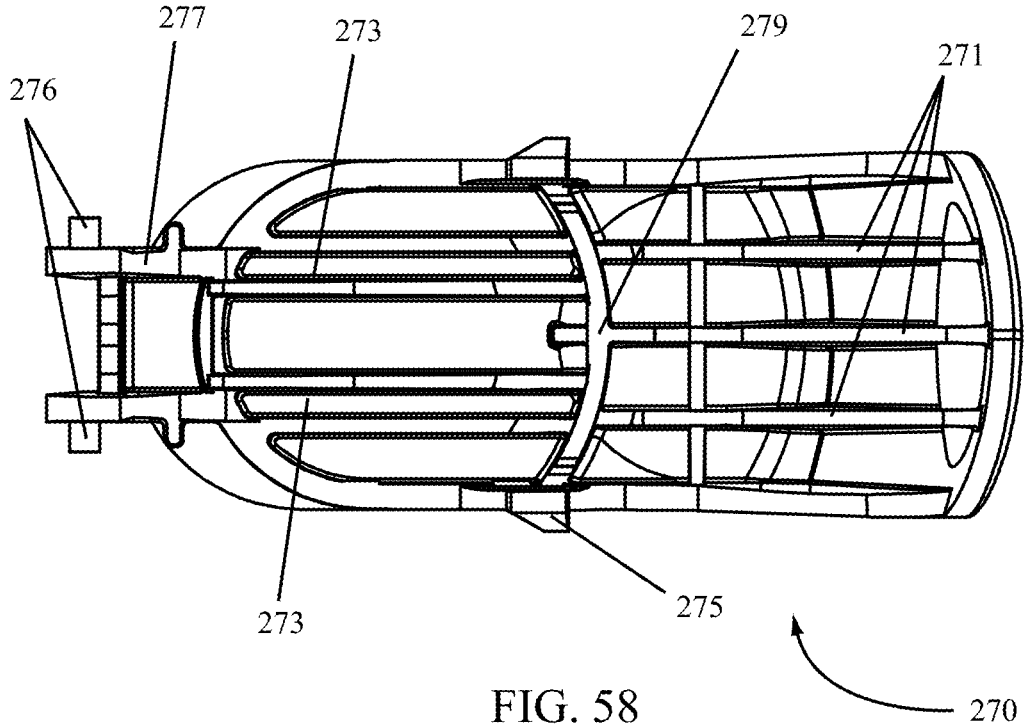
FIG. 58 illustrates a bottom view of a trigger according to various embodiments of the invention.
Figure 59:
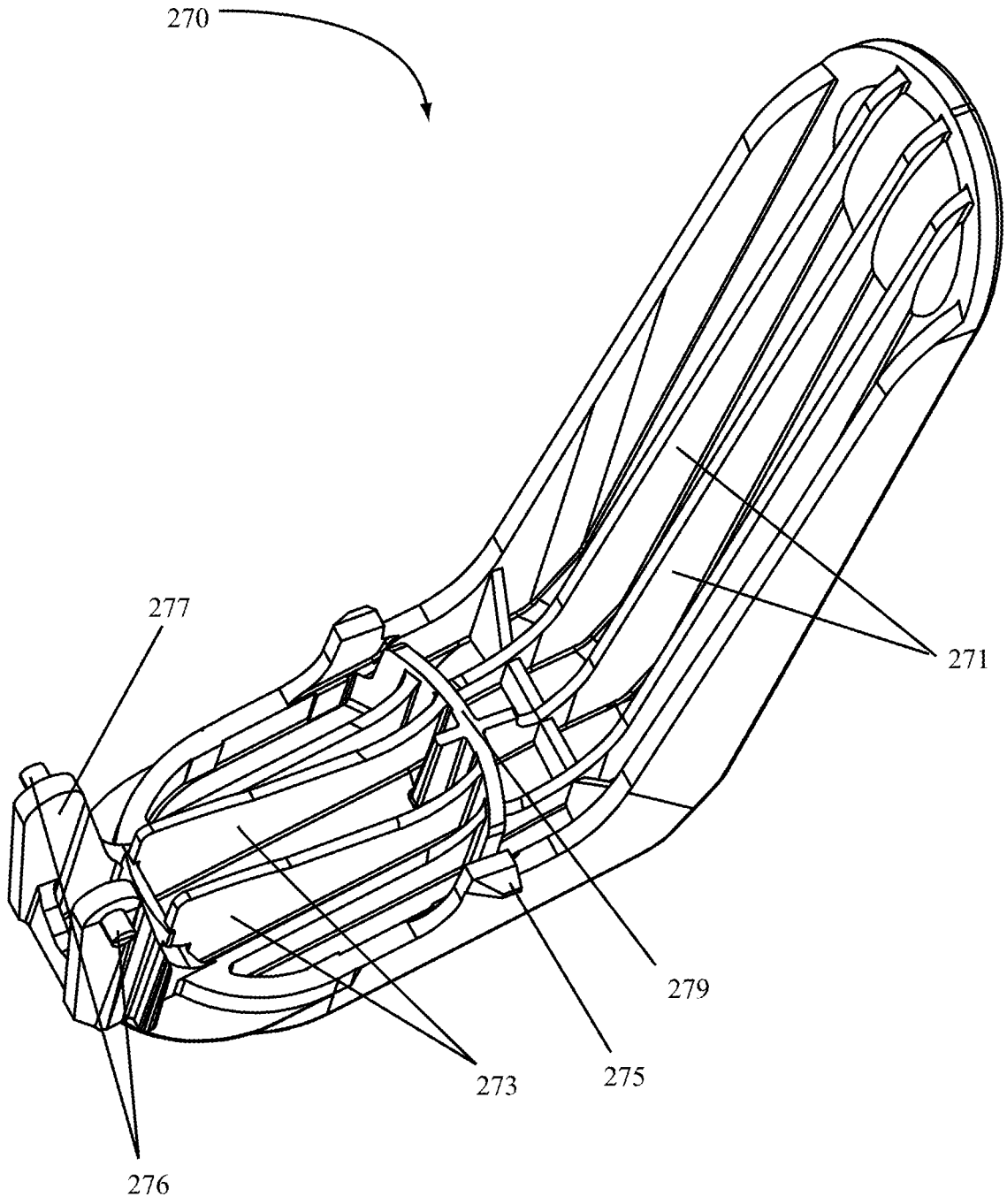
FIG. 59 illustrates a bottom, perspective view of a trigger according to various embodiments of the invention.

According to some embodiments of the invention, one or more indicia 280 may be added to the surface of a trigger 270 to cue a user about the proper use of the trigger 270 or an aerosol actuator. For example, as illustrated in FIG. 56, an indented button shape may be included along the bottom edge of the lever actuator 274 to encourage a user to use that portion of the lever actuator 274 to actuate the trigger 270 or aerosol actuator 100. Similarly, indicia 280 on the button actuator 272 may be included to indicate where a spray will dispense or to indicate where a user should push on the button actuator 272 to actuate the aerosol actuator 100.

An aerosol actuator 100 according to various embodiments of the invention may be assembled in any desirable manner. However, in some embodiments, two sub-assemblies may be constructed and then assembled together. For example, a manifold-locking ring sub-assembly may be assembled by inserting an orifice cup 268 into a manifold 250 and then orienting the manifold 250 relevant to the locking ring 230 and inserting the manifold 250 onto the locking ring 230 such that the inlet 251 portion of the manifold 250 is inserted in the manifold guide 233 of the locking ring 230 and the manifold 250 body rests on a manifold support 245. A trigger-cap sub-assembly may be assembled by inserting a trigger 270 into the cap 210 and connecting it thereto for pivoting or movement relative to the cap 210. The manifold-locking ring sub-assembly may then be snapped into the trigger-cap sub-assembly. In alternative embodiments, the trigger-cap sub-assembly may be snapped into the manifold-locking ring sub-assembly.

While various embodiments of the invention are described and illustrated with a lever actuator on a side of the aerosol actuator 100 opposite the position at which a product is dispensed, it is understood that embodiments of the invention also include aerosol actuators 100 having lever actuators in other locations. For example, an aerosol actuator 100 may include a lever actuator on the dispensing side of the aerosol actuator 100 such that when a user points the dispensing opening toward themself, a product may be dispensed by using their thumb to actuate a lever actuator extending below the dispensing opening. In other embodiments, a lever actuator may be positioned on a side of the container 900. Other positions for the lever actuator may be selected for the intended use of the aerosol dispenser 10.

According to various embodiments of the invention, an aerosol actuator 100 may include one or more marking indicia on one or more surfaces of a trigger to indicate an actuation point on the trigger. For example, as illustrated in various Figures, a trigger may include one or more marking indicia 280 used to mark a top or button-like actuation point and a lever actuation point.

Any variety of products may be dispersed by an aerosol actuator 100 according to various embodiments of the invention. For example, an aerosol actuator 100 according to the embodiments of the invention may be attached to a container 900 containing any one or more of the following formulations: sunscreen formulation, hairspray formulation, insect control formulation, paint formulation, air-care formulation, cleaning formulation, wax formulation, beauty-care formulation, and food formulation. Other formulations or products capable of being dispensed as an aerosol product may also be dispensed using aerosol actuators 100 according to various embodiments of the invention.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. An aerosol actuator, comprising:

a locking ring, comprising:
- a base;
- a rim about an outer circumference of the base;
- a lock projection extending upwardly from the base;
- a manifold opening in the base; and
- at least one base snap structure extending outwardly from the base;

a manifold, comprising:
- an inlet having a first substantially vertical central axis extending therethrough;
- a valve seat adjacent to the inlet;
- an outlet having a second substantially horizontal central axis extending therethrough;
- a flow path between the inlet and the outlet; and
- at least one actuator post;

a cap, comprising:
- a wall defining a cap base opening, a trigger opening, and a spray opening;
- at least one locking ring support extending off an interior surface of the wall; and at least one trigger support;

a trigger, comprising:

a button actuator;

a lever actuator extending off of the button actuator;

at least one pivot support extending off of the trigger;

an actuation lock configured to engage the lock projection in a first configuration to prevent the trigger from pivoting relative to the locking ring, at least one trigger retention post extending off of the trigger and configured to prevent the trigger from being disassembled from the cap; and at least one actuator wing extending away from an underside of the trigger;

wherein the rim of the locking ring is snapped into the at least one locking ring support of the cap defining an interior space between an upper surface of the base of the locking ring and the interior surface of the wall of the cap, the manifold is seated in the interior space, the at least one pivot support is mounted on the at least one trigger support, and the at least one actuator wing is configured to interact with the at least one actuator post of the manifold, and wherein the button actuator extends above and over the manifold.

2. The aerosol actuator of claim 1, wherein the wall of the cap is cylindrically shaped.

3. The aerosol actuator of claim 1, wherein the wall of the cap slopes inward from the cap base opening to the top of the cap.

4. The aerosol actuator of claim 1, wherein the button actuator comprises a sloping surface sloping from a front portion thereof to the lever actuator.

5. The aerosol actuator of claim 1, wherein the button actuator comprises a sloping surface towards the lever actuator and the lever actuator comprises a greater downward sloping surface than the button actuator.

6. The aerosol actuator of claim 1, wherein the button actuator has a first length and the lever actuator has a second length, the first length being shorter than the second length.

7. The aerosol actuator of claim 1, wherein the at least one actuator wing comprises at least two actuator wings.

8. An aerosol dispenser, comprising:

a cap, comprising:

a cap base opening;

a trigger opening;

a spray opening; and at least one trigger support;

a locking ring connected to the cap adjacent the cap base opening defining an interior space between an upper surface of a base of the locking ring and an interior surface of a wall of the cap, wherein the locking ring has a first substantially vertical central axis extending therethrough and a lock projection extending upward from the base of the locking ring;

a manifold positioned in the interior space, the manifold comprising:

at least one actuator post; and an outlet, wherein the outlet is positioned in the spray opening and the outlet including a second substantially horizontal central axis that is substantially perpendicular to the first vertical central axis;

a trigger positioned at least partially in the trigger opening, the trigger comprising:

a button actuator;

a lever actuator extending off of the button actuator and away from the cap;

at least one pivot support extending off of the trigger;

an actuation lock configured to engage the lock projection in a first configuration to prevent the trigger from pivoting relative to the locking ring, at least one trigger retention post extending off of the trigger and configured to prevent the trigger from being disassembled from the cap; and at least one actuator wing extending away from an underside of the trigger;

wherein the at least one pivot support interacts with the at least one trigger support and the at least one actuator wing interacts with the at least one actuator post, and wherein the button actuator extends above and over the manifold.

9. The aerosol dispenser of claim 8, further comprising an aerosol container attached to the locking ring.

10. The aerosol dispenser of claim 9, further comprising a manifold valve seat and a valve attached to the aerosol container, wherein the manifold valve seat is seated on the valve.

11. The aerosol dispenser of claim 8, wherein the button actuator comprises a sloping surface sloping from a front portion thereof to the lever actuator.

12. The aerosol dispenser of claim 8, wherein the button actuator comprises a sloping surface towards the lever actuator and the lever actuator comprises a greater downward sloping surface than the button actuator.

13. The aerosol dispenser of claim 8, wherein the button actuator has a first length and the lever actuator has a second length, the first length being shorter than the second length.

14. A trigger for an aerosol actuator, comprising:

a button actuator;

a lever actuator extending off of the button actuator;

at least one pivot support extending vertically downward off of the trigger;

an actuation lock, at least one trigger retention post extending off of the trigger; and at least one actuator wing extending away from an underside of the trigger, wherein the button actuator has a first length and the lever actuator has a second length, the first length being shorter than the second length, wherein the button actuator comprises a downward sloping surface sloping from a front portion thereof to the lever actuator, wherein said lever actuator extends downwardly from said button actuator along a side surface of an aerosol container to which the trigger is attached whereby a user may grip the container with the lever actuator between a user's palm and the aerosol container, wherein the button actuator is configured and arranged to extend above the aerosol container and across a central axis of the aerosol container, wherein the actuation lock is configured, in a first configuration, to prevent the trigger from pivoting relative to the container, and wherein the at least one trigger retention post is configured to be retained in a cap of the aerosol container.

15. The trigger of claim 14, further comprising at least one trigger post extending outward from said at least one pivot support.

16. The trigger of claim 14, wherein the at least one actuator wing comprises at least two actuator wings.

17. The trigger of claim 14, further comprising a trigger actuation lock projecting off of an underside of the trigger.

* * * * *